US009666987B1

(12) United States Patent
Tanaka et al.

(10) Patent No.: US 9,666,987 B1
(45) Date of Patent: May 30, 2017

(54) CONNECTOR AND CONNECTOR ASSEMBLY

(71) Applicant: Japan Aviation Electronics Industry, Limited, Tokyo (JP)

(72) Inventors: Yukitaka Tanaka, Tokyo (JP); Akira Kimura, Tokyo (JP); Yoshihide Kuroki, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 15/262,322

(22) Filed: Sep. 12, 2016

(30) Foreign Application Priority Data

Nov. 13, 2015 (JP) ..... 2015-223146

(51) Int. Cl.
*H01R 13/627* (2006.01)
*H01R 13/639* (2006.01)

(52) U.S. Cl.
CPC ..... *H01R 13/639* (2013.01)

(58) Field of Classification Search
CPC ..... H01R 13/6275; H01R 13/639; H01R 13/6271; H01R 13/629
USPC ..... 439/352–353, 357–358
See application file for complete search history.

(56) References Cited

U.S. PATENT DOCUMENTS 5,634,809 A 6/1997 Hirai
6,315,616 B1 11/2001 Hayashi
6,953,356 B2 10/2005 Hisamatsu et al.
7,077,698 B2 7/2006 Matthys et al.
7,198,522 B1 * 4/2007 Ho ..... H01R 9/032 439/353
7,351,103 B1 * 4/2008 Peng ..... H01R 13/6275 439/595
7,354,292 B1 4/2008 Lloyd et al.
7,628,638 B2 * 12/2009 Wu ..... H01R 9/032 439/353
8,894,441 B2 * 11/2014 Wu ..... H01R 13/6598 439/607.01
9,293,875 B2 * 3/2016 Tada ..... H01R 27/00
9,350,126 B2 * 5/2016 Little ..... H01R 24/60

FOREIGN PATENT DOCUMENTS

JP H 09-63694 A 3/1997
JP H 11-283710 A 10/1999
JP 2003-297482 A 10/2003
(Continued)

*Primary Examiner* — Xuong Chung Trans
(74) *Attorney, Agent, or Firm* — Collard & Roe, P.C.

(57) ABSTRACT

A connector comprises a movable member and an operating member and is mateable with a mating connector. The movable member is movable between a front position and a rear position of a movement range. The operating member is movable between a front position and a rear position of an operation range and is movable relative to the movable member. The mated state of the connector is locked when the operating member is positioned at the front position of the operation range and when the movable member is positioned at the front position of the movement range. The mated state is unlocked when the operating member is positioned rearward of the front position of the operation range by a predetermined distance and when the movable member is positioned at the front position of the movement range.

20 Claims, 31 Drawing Sheets

(56) References Cited

FOREIGN PATENT DOCUMENTS

| | | | |
|---|---|---|---|
| JP | 2004-071291 | A | 3/2004 |
| JP | 2005-259698 | A | 9/2005 |
| JP | 2009-170391 | A | 7/2009 |
| JP | 2009-543296 | A | 12/2009 |

* cited by examiner

CONNECTOR AND CONNECTOR ASSEMBLY

CROSS REFERENCE TO RELATED APPLICATIONS

This application is based on and claims priority under 35 U.S.C. §119 to Japanese Patent Application No. JP2015-223146 filed Nov. 13, 2015, the contents of which are incorporated herein in their entirety by reference.

BACKGROUND OF THE INVENTION

This invention relates to a connector comprising a lock mechanism for locking a mated state of the connector with a mating connector.

For example, this type of connector is disclosed in JP A 2009-543296 (Patent Document 1), the content of which is incorporated herein by reference.

As shown in FIG. 60, Patent Document 1 discloses a plug 900 (connector) mateable with a receptacle (mating connector) which is not illustrated but is arranged in a guide frame 950. The plug 900 comprises an actuator 910 and a latch arm 920. The actuator 910 and the latch arm 920 form a lock mechanism, and the guide frame 950 forms a mating lock mechanism. In detail, the actuator 910 is formed with a front end portion 915 which is vertically thick. The latch arm 920 extends over the front end portion 915 of the actuator 910. The latch arm 920 has a hook 925, and the guide frame 950 is formed with an opening 955. When the plug 900 is mated with the receptacle, the hook 925 of the lock mechanism is inserted into the opening 955 of the mating lock mechanism so that the mated state is locked.

The lock mechanism of Patent Document 1 is provided outside of a fit portion of the connector. Moreover, the mating connector as disclosed in Patent Document 1 is generally arranged within a case of an electronic device. When the mating connector is arranged within the case, the mating connector is sometimes provided with no mating lock mechanism. Under a situation where no mating lock mechanism is provided, the case sometimes includes no space through which the lock mechanism can be inserted. More specifically, there is a situation where a portion or a member is provided on a moving path of the connector and blocks the lock mechanism upon mating of the connector with the mating connector. In this situation, the connector cannot be mated with the mating connector.

SUMMARY OF THE INVENTION

It is therefore an object of the present invention to provide a connector comprising a lock mechanism, wherein the connector can be mated with a mating connector even in a situation where a portion or a member is provided on a moving path of the connector and blocks the lock mechanism upon mating of the connector with the mating connector.

An aspect of the present invention provides a connector which is mateable with a mating connector when moved forward along a front-rear direction. The mating connector comprises a mating fit portion and a mating lock portion. The connector comprises a primary member, a movable member and an operating member. The primary member comprises a connector body. The connector body comprises a fit portion. The fit portion is fit to the mating fit portion under a mated state where the connector and the mating connector are mated with each other. The movable member is movable relative to the primary member between a front position and a rear position of a movement range in the front-rear direction. The operating member is movable relative to the primary member between a front position and a rear position of an operation range in the front-rear direction and is movable relative to the movable member in the front-rear direction. The movable member comprises a support portion and a lock portion. The support portion is resiliently deformable. The lock portion is supported by the support portion. The mated state is locked by the lock portion and the mating lock portion when the operating member is positioned at the front position of the operation range and when the movable member is positioned at the front position of the movement range. The mated state is unlocked when the operating member is positioned rearward of the front position of the operation range by a predetermined distance and when the movable member is positioned at the front position of the movement range.

Another aspect of the present invention provides a connector assembly comprising the connector and the mating connector.

The connector according to an aspect of the present invention comprises a lock mechanism including the support portion and the lock portion. The movable member is provided with the lock mechanism. The primary member is provided with the fit portion, and the movable member including the lock mechanism is movable relative to the primary member in the movement range along the front-rear direction, or along a mating direction of the connector with the mating connector. When the connector is mated with the mating connector which comprises the mating lock portion, the mated state can be locked by positioning the movable member at the front position of the movement range. Moreover, in a situation where a portion or a member is provided on a moving path of the connector and blocks the lock mechanism upon mating of the connector with the mating connector, the connector can be mated with the mating connector by positioning the movable member at the rear position of the movement range.

Moreover, the connector according to an aspect of the present invention comprises the operating member in addition to the movable member. The operating member is movable relative to the primary member in the operation range in the front-rear direction and is movable relative to the movable member in the front-rear direction. The mated state is unlocked when the operating member is positioned rearward by the predetermined distance from the front position of the operation range and when the movable member continues to be positioned at the front position of the movement range. Thus, the mated state can be unlocked with no rearward movement of the movable member. Therefore, the mated state can be unlocked with no abutment of the lock portion of the movable member with the mating lock portion.

An appreciation of the objectives of the present invention and a more complete understanding of its structure may be had by studying the following description of the preferred embodiment and by referring to the accompanying drawings.

Figure 1:
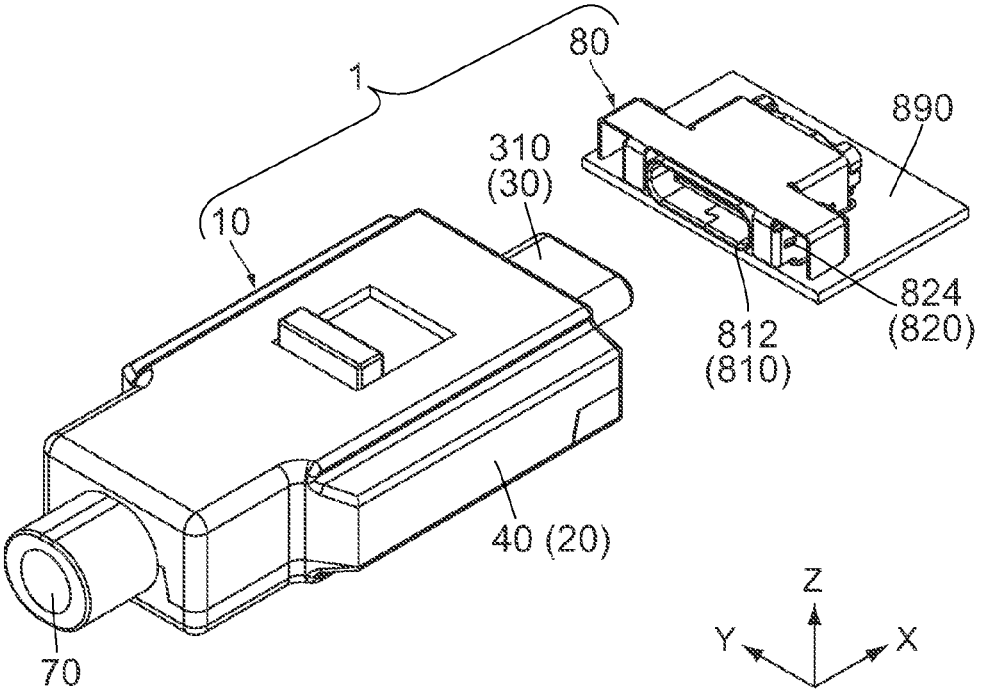
FIG. 1 is a perspective view showing a connector according to a first embodiment of the present invention together with a mating connector mounted on a mating circuit board.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

First Embodiment

Referring to FIG. 1, a connector assembly 1 according to a first embodiment of the present invention comprises a connector 10 and a mating connector 80. The connector 10 is mateable with the mating connector 80 when moved forward, or moved in the positive X-direction, along a front-rear direction (X-direction). The connector 10 according to the present embodiment is a cable connector connected to a cable 70, and the mating connector 80 is an on-board connector mounted on a mating circuit board 890. Moreover, the connector 10 according to the present embodiment is a plug, and the mating connector 80 is a receptacle. However, the present invention is not limited thereto but is applicable to various connectors and mating connectors. For example, the mating connector 80 may be a part of an electronic device (not shown).

Figure 2:
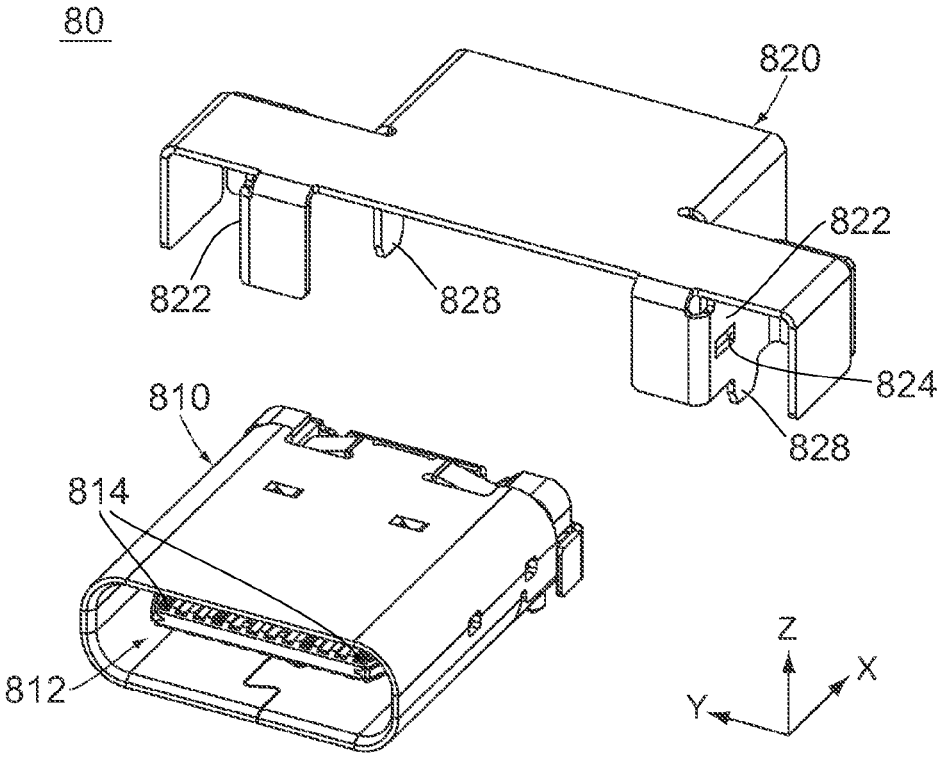
FIG. 2 is an exploded, perspective view showing the mating connector of FIG. 1.

Referring to FIGS. 1 and 2, the mating connector 80 comprises a mating fit portion 812 and two mating lock portions (lock holes) 824. More specifically, the mating connector 80 comprises a mating connector body 810 and a mating shell 820 made of metal. The mating connector body 810 is provided with the mating fit portion 812, and the mating shell 820 is provided with the mating lock portions 824. The mating fit portion 812 has a tubular shape with high aspect ratio. The mating fit portion 812 has a plurality of mating contacts 814 each of which is made of conductor and provided inside of the mating fit portion 812. The mating contacts 814 are arranged in a pitch direction (Y-direction: lateral direction). The mating contacts 814 are fixed and connected to the mating circuit board 890 via soldering, etc.

The mating shell 820 has two side plates 822 and a plurality of fixed portions 828. The side plates 822 are formed with the mating lock portions 824, respectively. Each of the mating lock portions 824 according to the present embodiment is a lock hole which pierces the corresponding side plate 822 in the Y-direction. The mating shell 820 is attached to the mating circuit board 890 so as to cover the mating connector body 810. In detail, the fixed portions 828 are fixed and connected to the mating circuit board 890 via soldering, etc. The mating fit portion 812 is positioned between the two mating lock portions 824 in the Y-direction.

Figure 3:
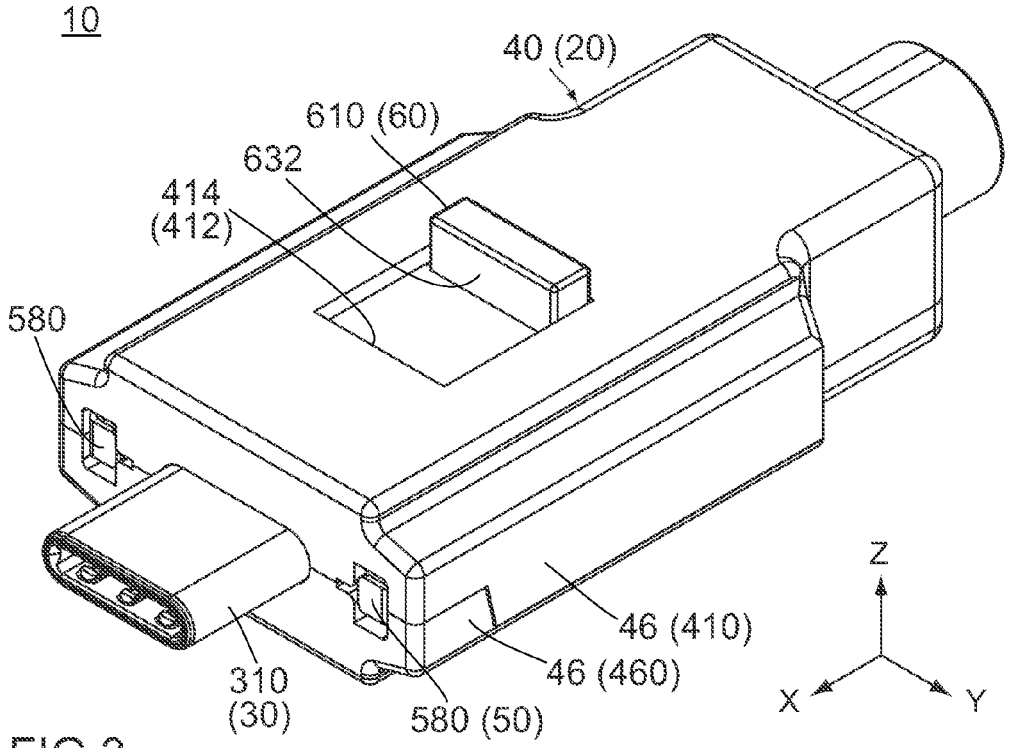
FIG. 3 is a perspective view showing the connector of FIG. 1, wherein the connector is under an initial state.
Figure 4:
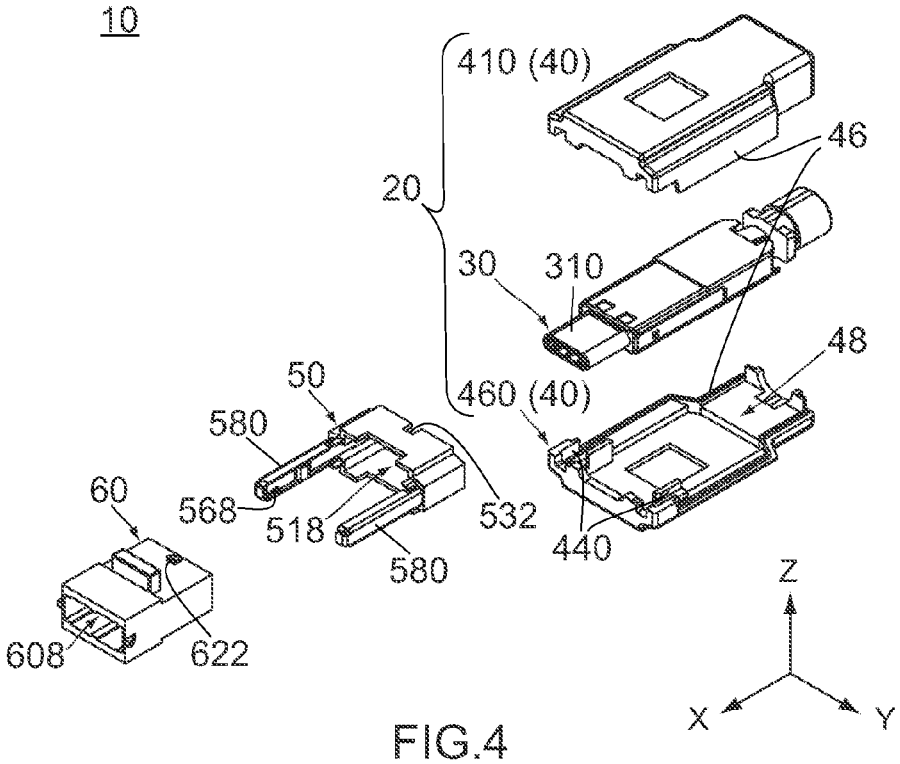
FIG. 4 is an exploded, perspective view showing the connector of FIG. 3.

Referring to FIGS. 3 and 4, the connector 10 comprises a primary member 20, a movable member 50 and an operating member 60. In the present embodiment, the movable member 50 is, at least in part, accommodated in the primary member 20. Moreover, the operating member 60 is, at least in part, accommodated in the primary member 20 and is, at least in part, accommodated in the movable member 50.

The primary member 20 comprises a connector body 30 and a hood 40 made of insulator. The hood 40 according to the present embodiment is an assembly formed of an upper hood 410 and a lower hood 460 which are vertically coupled to each other after formed separately from each other. The upper hood 410 and the lower hood 460 are positioned at an upper part (the positive Z-side part) and a lower part (the negative Z-side part) of the hood 40 in an up-down direction (Z-direction), respectively. The hood 40 has two side portions 46 which are positioned at opposite sides thereof in the Y-direction, respectively. The thus-formed hood 40 has an accommodation portion 48 formed inside thereof. The accommodation portion 48 is a space which pierces the hood 40 in the X-direction.

As described above, the hood 40 according to the present embodiment is formed of two members, namely, the upper hood 410 and the lower hood 460. However, the present invention is not limited thereto. For example, the hood 40 may be a single member. Moreover, the hood 40 may be integrally formed with the connector body 30.

Figure 5:
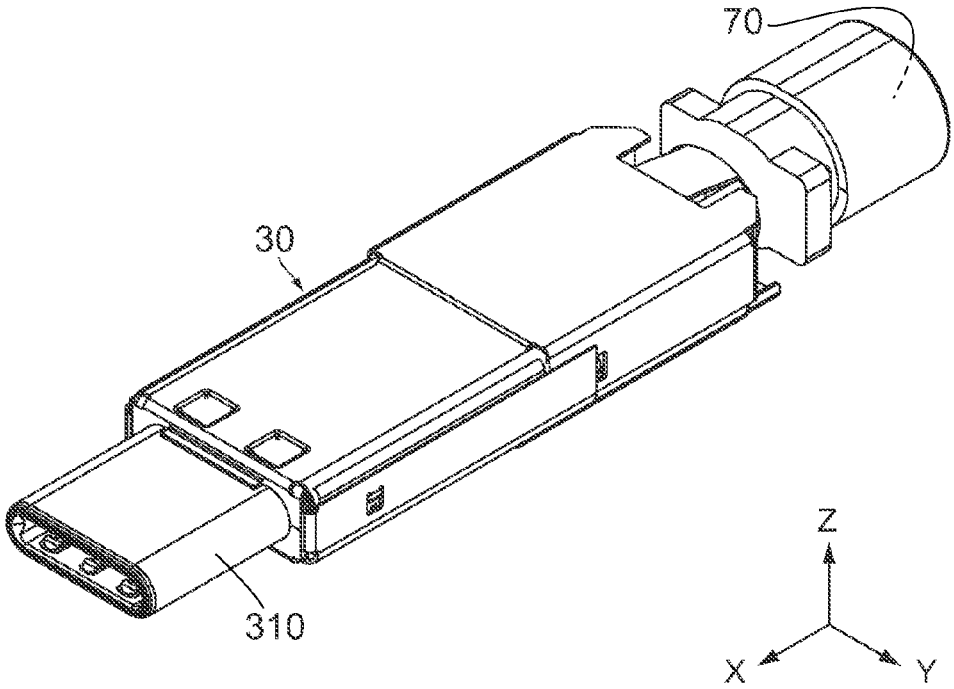
FIG. 5 is a perspective view showing a connector body of a primary member of the connector of FIG. 4.
Figure 23:
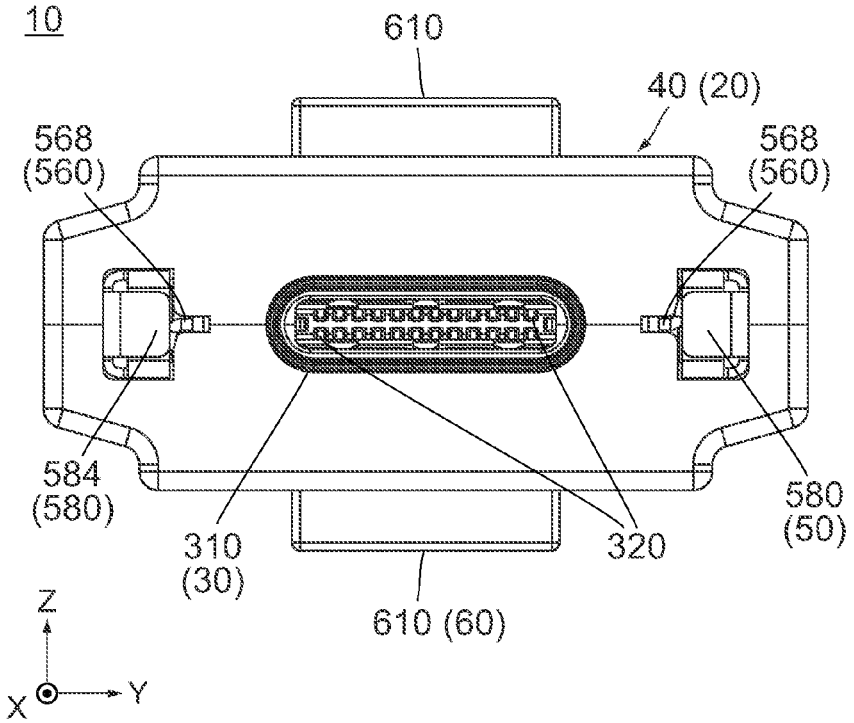
FIG. 23 is a front view showing the connector of FIG. 19.

Referring to FIGS. 3 to 5, the connector body 30 comprises a fit portion 310. The fit portion 310 has a tubular shape with high aspect ratio. Referring to FIG. 23, the fit portion 310 has a plurality of contacts 320 each of which is made of conductor and provided inside of the fit portion 310. The contacts 320 are arranged in the Y-direction (pitch direction: lateral direction). When the connector 10 is used, the contacts 320 are connected to the cable 70 (see FIG. 5). Referring to FIGS. 3 to 5, the connector body 30 is held by the hood 40 and unmovable relative to the hood 40. In detail, the connector body 30 has a rear end portion, or the negative X-side end portion, which is to be connected to the cable 70. The accommodation portion 48 of the hood 40 holds the connector body 30 therewithin except the fit portion 310 and the rear end portion of the connector body 30. The fit portion 310 projects forward from a front end, or the positive X-side end, of the hood 40.

Referring to FIGS. 1 to 3, the fit portion 310 is fit to the mating fit portion 812 under a mated state where the connector 10 and the mating connector 80 are mated with each other. According to the present embodiment, the fit portion 310 is inserted into the mating fit portion 812 under the mated state. At that time, the contacts 320 (see FIG. 23) are connected to the mating contacts 814, respectively.

Figure 6:
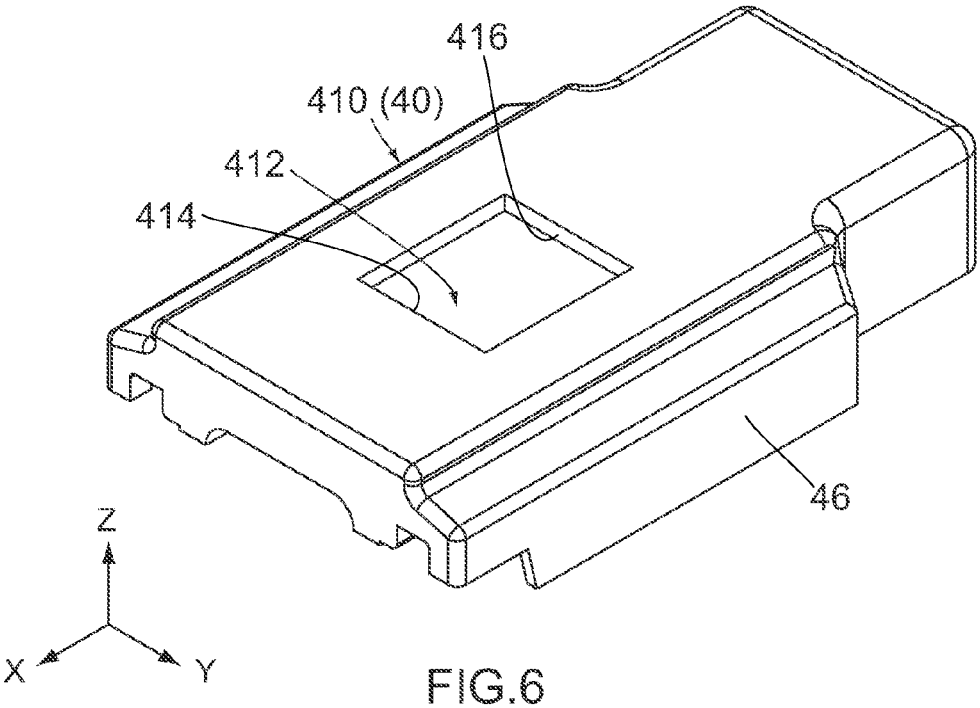
FIG. 6 is a perspective view showing an upper hood of the primary member of the connector of FIG. 4.
Figure 7:
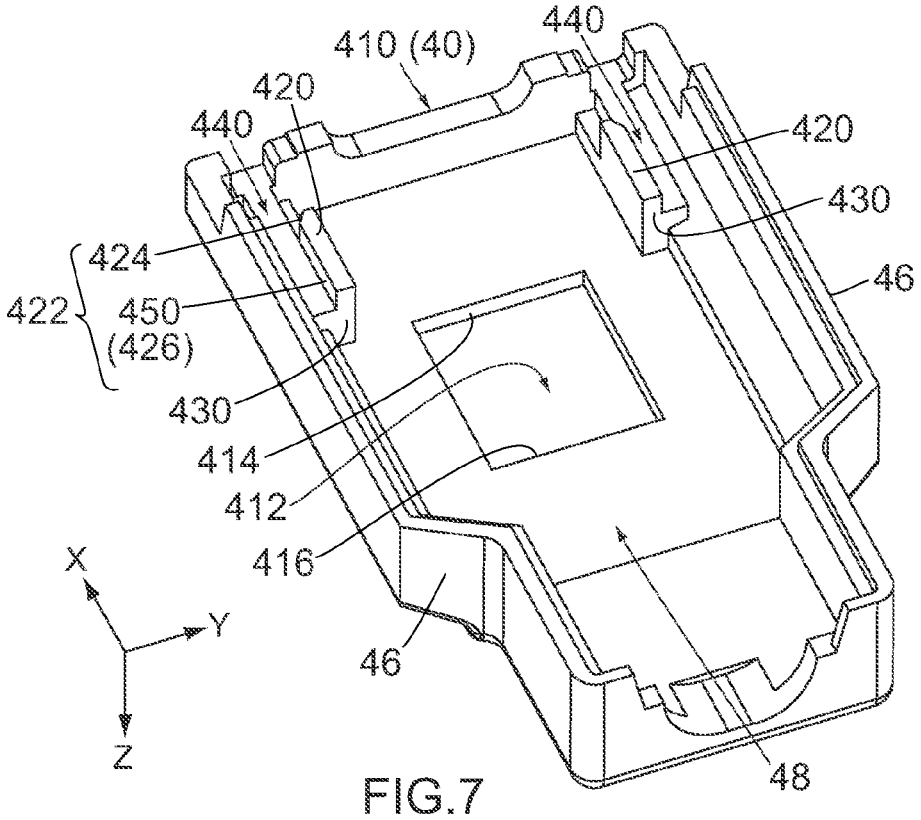
FIG. 7 is another perspective view showing the upper hood of FIG. 6.
Figure 8:
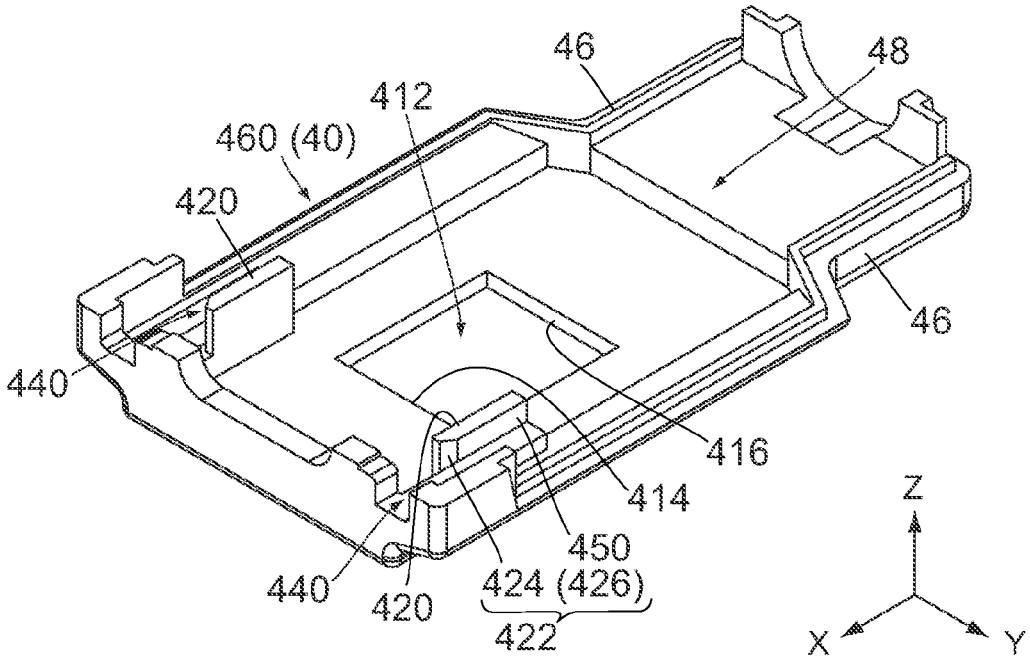
FIG. 8 is a perspective view showing a lower hood of the primary member of the connector of FIG. 4.

As can be seen from FIGS. 6 to 8, the hood 40 comprises two operation restriction holes 412, two partition walls 420 and two guide channels 440 when the upper hood 410 and the lower hood 460 are vertically coupled to each other. One of the operation restriction holes 412 is a rectangular hole which pierces the upper hood 410 in the Z-direction, and a remaining one of the operation restriction holes 412 is another rectangular hole which pierces the lower hood 460 in the Z-direction. The two partition walls 420 are positioned at opposite sides of the accommodation portion 48 in the Y-direction, respectively. One of the guide channels 440 is a channel which is formed between the positive Y-side partition wall 420 and the positive Y-side portion 46 of the operating member 60. A remaining one of the guide channels 440 is another channel which is formed between the negative Y-side partition wall 420 and the negative Y-side portion 46 of the operating member 60. Each of the guide channels 440 opens forward.

Each of the partition walls 420 of the hood 40 has an outside surface in the Y-direction which works as a maintenance portion 422 as described later. In other words, the accommodation portion 48 of the hood 40 of the primary member 20 (see FIG. 4) is provided with the two maintenance portions 422 which are positioned at opposite sides of the accommodation portion 48 in the Y-direction, respectively. Each of the maintenance portions 422 has a front end portion 424 and a rear portion 426, wherein the front end portion 424 is a sloped surface oblique to the X-direction, and the rear portion 426 extends in parallel to the XZ-plane.

Referring to FIGS. 4, 7 and 8, the hood 40 of the primary member 20 comprises two forward-operation restriction portions 414, two rearward-operation restriction portions 416 and two forward-movement restriction portions 430. The forward-operation restriction portions 414 are front inner wall surfaces of the operation restriction holes 412, respectively, and the rearward-operation restriction portions 416 are rear inner wall surfaces of the operation restriction holes 412, respectively. The forward-movement restriction portions 430 are rear end surfaces of the partition walls 420, respectively.

Figure 9:
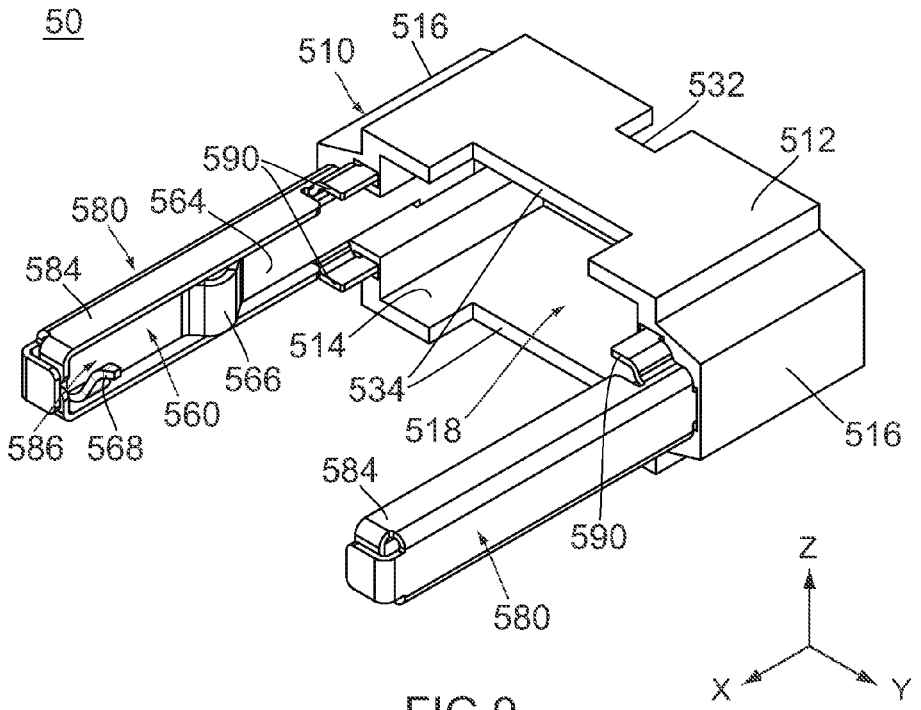
FIG. 9 is a perspective view showing a movable member of the connector of FIG. 4.
Figure 10:
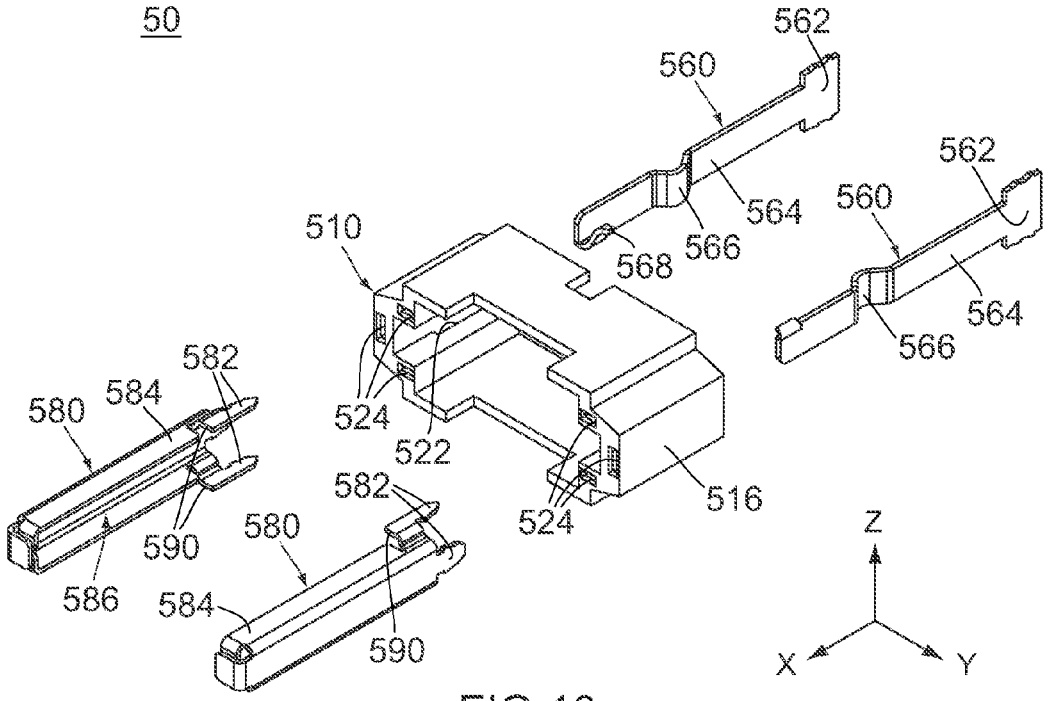
FIG. 10 is an exploded, perspective view showing the movable member of FIG. 9.

Referring to FIGS. 9 and 10, the movable member 50 comprises a body member 510 made of insulator, two lock members 560 each made of resiliently deformable material such as metal and two cover members 580 each made of metal. The movable member 50 has a shape which is 180 degrees rotational symmetric or 2-fold rotational symmetric with respect to an axis in parallel to the X-direction.

The body member 510 has an upper portion 512, a lower portion 514, two side portions 516 and a hollow portion 518. The upper portion 512 and the lower portion 514 are positioned at an upper end and a lower end of the body member 510, respectively, and extend in a horizontal plane (XY-plane) perpendicular to the Z-direction. The two side portions 516 are positioned at opposite sides of the body member 510 in the Y-direction, respectively, and couple the upper portion 512 and the lower portion 514 to each other in the Z-direction. The hollow portion 518 is a space enclosed by the upper portion 512, the lower portion 514 and the side portions 516. The hollow portion 518 opens forward and rearward (toward the negative X-side). Each of the side portions 516 is formed with a press-fit groove 522 and three press-fit holes 524. Each of the press-fit grooves 522 is positioned inside of the hollow portion 518 and opens rearward. Each of the press-fit holes 524 opens forward.

Referring to FIG. 9, the movable member 50 comprises two forward-force receiving portions 532 and two rearward-force receiving portions 534. The forward-force receiving portions 532 are provided to the upper portion 512 and the lower portion 514 of the body member 510, respectively. Similarly, the rearward-force receiving portions 534 are provided to the upper portion 512 and the lower portion 514, respectively. In detail, one of the forward-force receiving portions 532 is a front end surface of a recess which is recessed forward from a rear end surface of the upper portion 512, and a remaining one of the forward-force receiving portions 532 is a front end surface of another recess which is recessed forward from a rear end surface of the lower portion 514. One of the rearward-force receiving portions 534 is a rear end surface of a recess which is recessed rearward from a front end surface of the upper portion 512, and a remaining one the rearward-force receiving portions 534 is a rear end surface of another recess which is recessed rearward from a front end surface of the lower portion 514.

Figure 11:
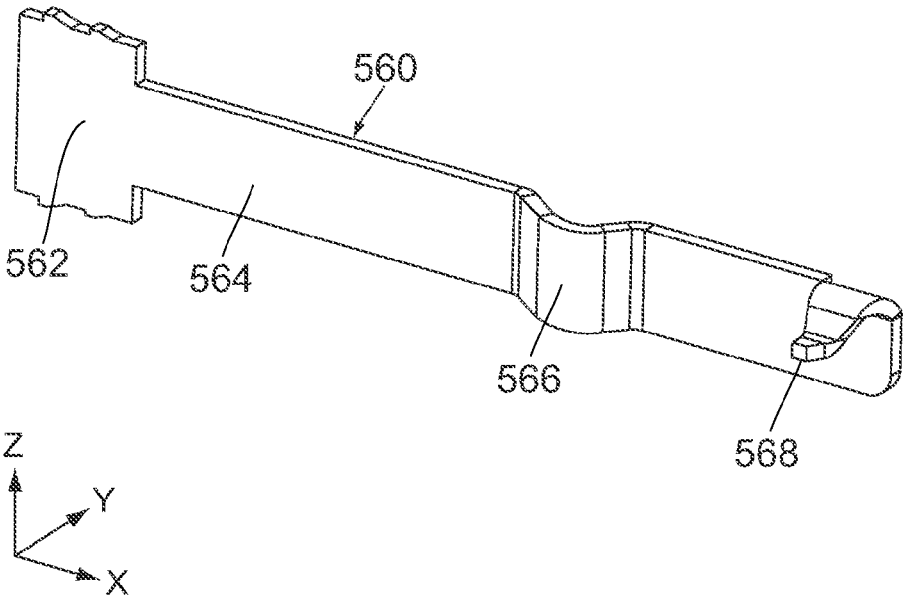
FIG. 11 is a perspective view showing a lock member of the movable member of FIG. 10.

Referring to FIGS. 9 to 11, each of the lock members 560 is formed by bending a single metal plate. In other words, each of the lock members 560 is a single plate with bends. In the present embodiment, the two lock members 560 have shapes same as each other. In other words, the two lock members 560 are the same components. The lock members 560 are arranged in 180 degrees rotational symmetry or 2-fold rotational symmetry with respect to an axis in parallel to the X-direction.

Each of the lock members 560 has a press-fit portion 562, a support portion 564, an operated portion 566 and a lock portion 568. The press-fit portion 562 is positioned at a rear end of the lock member 560. The support portion 564 extends forward from the press-fit portion 562 to be long in the X-direction and is resiliently deformable in the XY-plane. The operated portion 566 is provided at a middle part of the support portion 564 in the X-direction and protrudes inward in the Y-direction to have an arc shape. In other words, the operated portion 566 is a curved portion of the lock member 560. The lock portion 568 is provided to a front end of the support portion 564 and extends inward in the Y-direction. The lock portion 568 according to the present embodiment is a lock claw which extends inward in the Y-direction. However, the lock portion 568 may extend along a direction which is oblique to the Y-direction to some extent. In other words, the lock portion 568 may extend in a direction intersecting with the X-direction.

Referring to FIGS. 9 and 10, each of the cover members 580 is formed by bending a single metal plate. In other words, each of the cover members 580 is a single plate with bends. In the present embodiment, the two cover members 580 have shapes same as each other. In other words, the two cover members 580 are the same components. The two cover members 580 are arranged mirror symmetrically to each other with respect to the XZ-plane.

Each of the cover members 580 has three press-fit portions 582, a cover 584 and two forward-movement restricted portions 590. In addition, each of the cover members 580 is formed with a receiving portion 586. The press-fit portions 582 are positioned at a rear end of the cover member 580. The cover 584 extends forward from the press-fit portions 582 to be long in the X-direction and has a box-like shape which opens inward in the Y-direction and opens rearward. Each of the forward-movement restricted portions 590 is a front edge surface of a bent piece which is provided with the press-fit portion 582. The receiving portion 586 is a space enclosed by the cover 584. The receiving portion 586 opens rearward and inward in the Y-direction.

Referring to FIGS. 9 and 10, the press-fit portion 562 of each of the lock members 560 is press-fit into the corresponding press-fit groove 522 of the body member 510 from behind. Each of the thus-press-fit lock members 560 is held by the body member 510, and each of the support portions 564 projects forward from a front end of the body member 510. The press-fit portions 582 of each of the cover members 580 are press-fit into the corresponding press-fit holes 524 of the body member 510, respectively, from the front. Each of the thus-press-fit cover members 580 is held by the body member 510, and each of the covers 584 projects forward from the front end of the body member 510. Each of the forward-movement restricted portions 590 is positioned forward of the front end of the body member 510.

Figure 24:
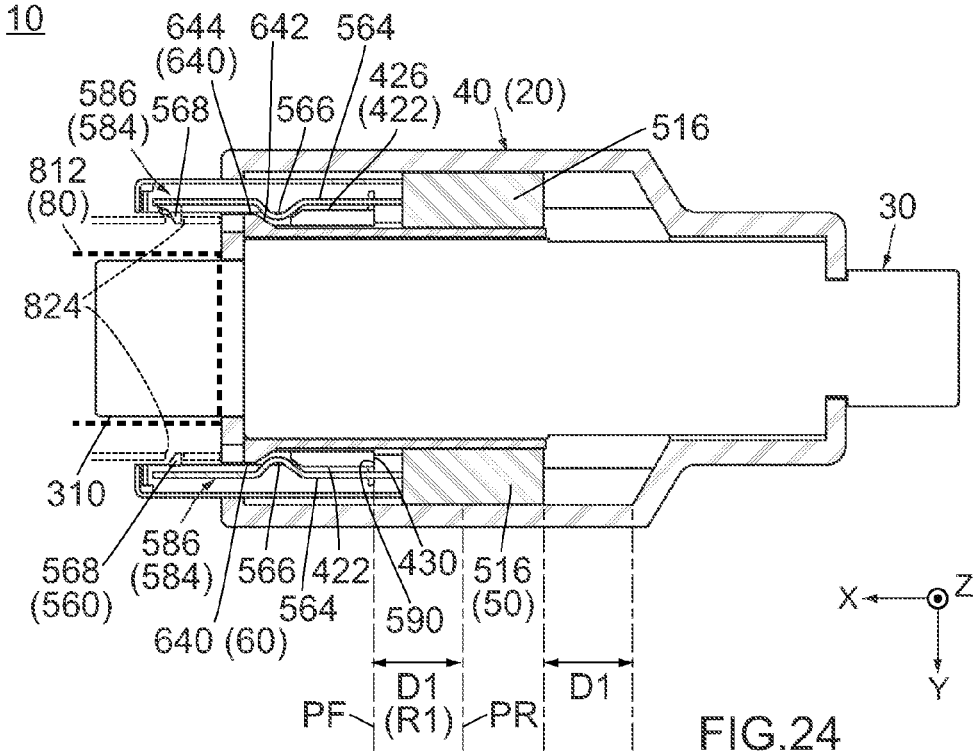
FIG. 24 is a cross-sectional view showing the connector of FIG. 19, wherein the connector body is illustrated in outline, and an outline of a mating fit portion and outlines of mating lock portions of the mating connector are illustrated by dashed line.

Referring to FIG. 9, the most part of each of the support portions 564 is received in the corresponding receiving portion 586 and is resiliently deformable in the receiving portion 586. The lock portion 568 is supported by the support portion 564 and is movable in the Y-direction. Referring to FIGS. 9 and 24, under an initial spring state of the support portion 564 where the support portion 564 is not resiliently deformed, a part of the operated portion 566 projects inward in the Y-direction from the receiving portion 586. Moreover, under the initial spring state, an end portion of the lock portion 568 projects inward in the Y-direction from the receiving portion 586.

Referring to FIG. 9, each of the support portion 564, the operated portion 566 and the lock portion 568 according to the present embodiment is a part of the corresponding lock member 560 which is formed separately from the body member 510. In other words, the movable member 50 comprised the two support portions 564, the two operated portions 566 and the two lock portions 568 each of which is provided to the corresponding one of the two lock members 560. In addition, the movable member 50 comprises the two covers 584 and the four forward-movement restricted portions 590 each of which is provided to the corresponding one of the two cover members 580.

However, the present invention is not limited thereto. For example, the lock member 560 and the cover member 580 corresponding to each other may be formed by bending a common metal plate. Moreover, the cover member 580 may be a part of the body member 510. Moreover, all of the body member 510, the lock members 560 and the cover members 580 may be formed by bending a common metal plate. Instead, the body member 510, the lock members 560 and the cover members 580 may be formed integrally with one another via insert-molding, for example.

Figure 12:
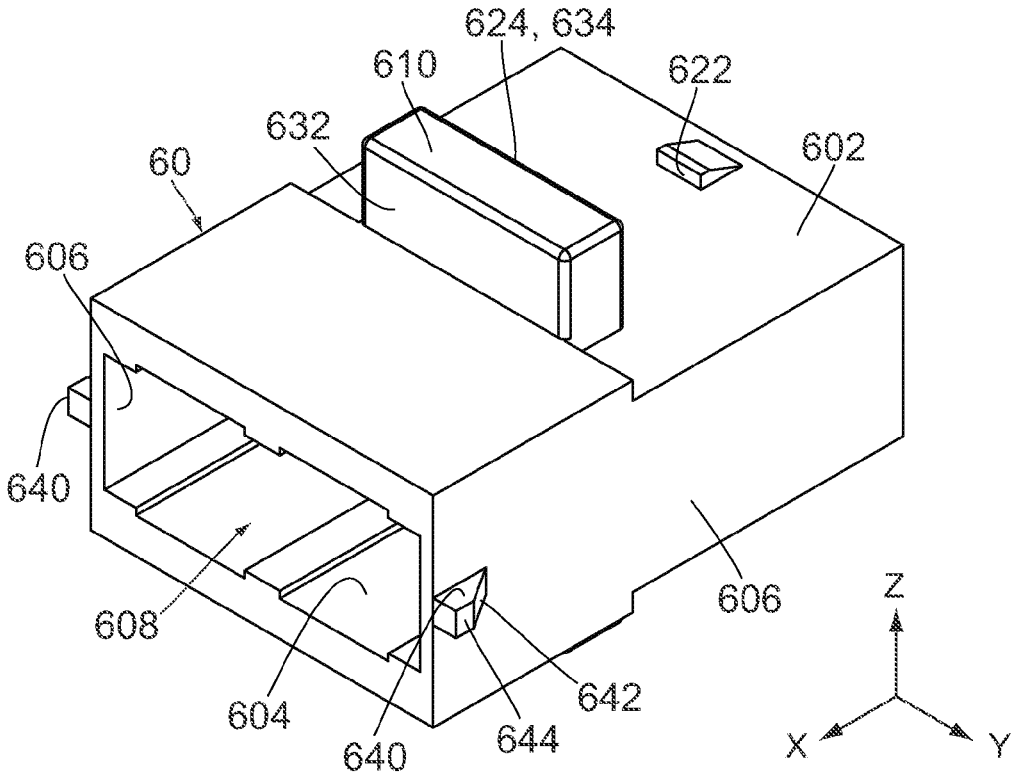
FIG. 12 is a perspective view showing an operating member of the connector of FIG. 4.
Figure 22:
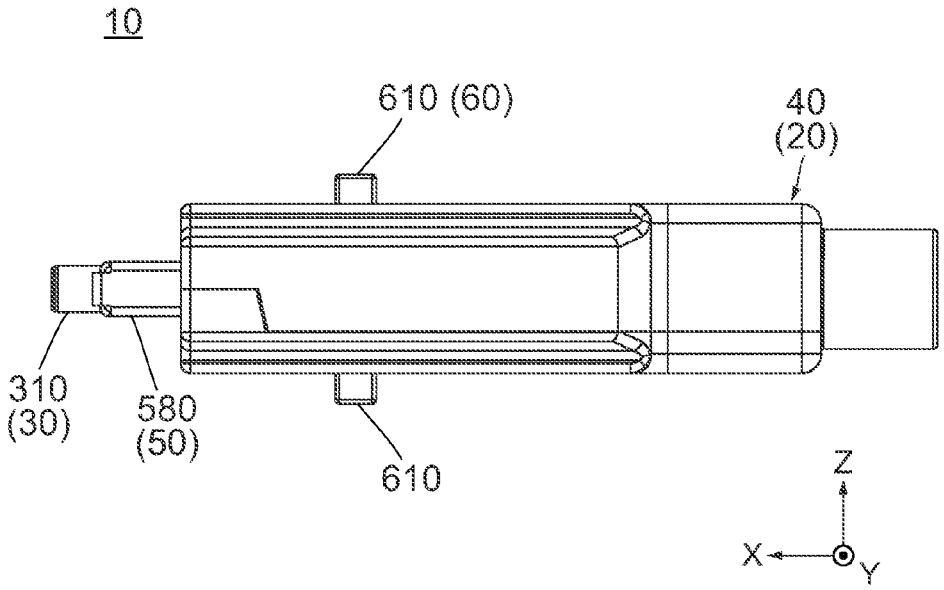
FIG. 22 is a side view showing the connector of FIG. 19.

Referring to FIG. 12, the operating member 60 has a shape which is 180 degrees rotational symmetric or 2-fold rotational symmetric with respect to an axis in parallel to the X-direction. In detail, the operating member 60 has an upper portion 602, a lower portion 604, two side portions 606 and a hollow portion 608. The upper portion 602 and the lower portion 604 are positioned at an upper end and a lower end of the operating member 60, respectively. Each of the upper portion 602 and the lower portion 604 roughly extends in the XY-plane. The two side portions 606 are positioned at opposite sides of the operating member 60 in the Y-direction, respectively, and couple the upper portion 602 and the lower portion 604 to each other in the Z-direction. The hollow portion 608 is a space enclosed by the upper portion 602, the lower portion 604 and the side portions 606. The hollow portion 608 opens forward and rearward. Referring to FIGS. 12, 22 and 23, each of the upper portion 602 and the lower portion 604 is provided with an operating portion 610. One of the operating portions 610 projects upward from the upper portion 602, and a remaining one of the operating portions 610 projects downward from the lower portion 604.

Figure 15:
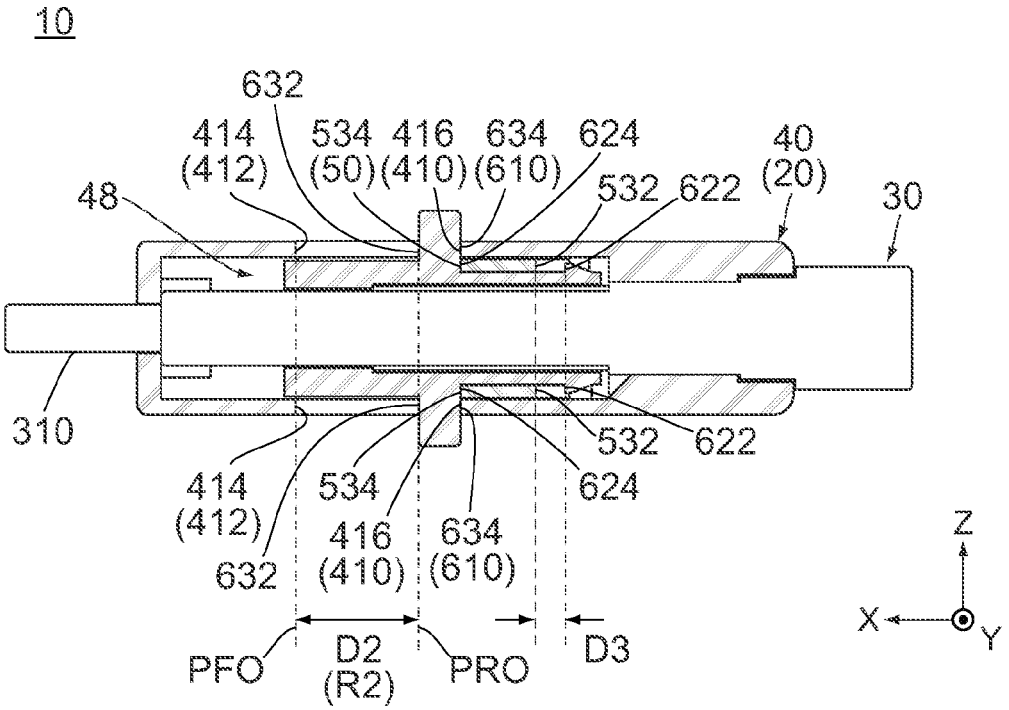
FIG. 15 is another cross-sectional view showing the connector of FIG. 3, wherein the connector body is illustrated in outline.

Referring to FIGS. 12 and 15, the operating member 60 comprises two forward-force applying portions 622, two rearward-force applying portions 624, two forward-operation restricted portions 632, two rearward-operation restricted portions 634 and two operating projections 640. One of the forward-force applying portions 622 is a front end surface of a projection which is positioned in the vicinity of a rear end of the upper portion 602 and projects upward, while a remaining one of the forward-force applying portions 622 is a front end surface of a projection which is positioned in the vicinity of a rear end of the lower portion 604 and projects downward.

In the present embodiment, a front surface of each of the two operating portions 610 works as the forward-operation restricted portion 632, and a rear surface of each of the operating portions 610 works as the rearward-force applying portion 624 and the rearward-operation restricted portion 634. In detail, each of the rearward-force applying portions 624 is a part of the rear surface of the corresponding operating portion 610, and each of the rearward-operation restricted portions 634 is another part of the rear surface of the corresponding operating portion 610. Moreover, each of the forward-operation restricted portions 632 is a part of the front surface of the corresponding operating portion 610.

Referring to FIG. 12, one of the operating projections 640 is a projection which is positioned in the vicinity of a front end of the positive Y-side portion 606 of the operating member 60 and projects in the positive Y-direction, while a remaining one of the operating projections 640 is a projection which is positioned in the vicinity of a front end of the negative Y-side portion 606 of the operating member 60 and projects in the negative Y-direction. In other words, the two operating projections 640 are provided to the side portions 606, respectively, and project outward in the Y-direction. Each of the operating projections 640 has an outside surface in the Y-direction which is formed of a sloping surface 642 and an outside surface 644. The sloping surface 642 is a surface oblique to the X-direction. The sloping surface 642 is provided to a rear part, or the negative X-side part, of the operating projection 640. The outside surface 644 is a surface in parallel to the XZ-plane. The outside surface 644 is provided to a front part, or the positive X-side part, of the operating projection 640.

Referring to FIGS. 3 and 4, the connector 10 is an assembly formed of the aforementioned members, namely, the primary member 20, the movable member 50 and the operating member 60. When the connector 10 is formed, the operating member 60 is inserted into the hollow portion 518 of the movable member 50 from the front so that the forward-force applying portions 622 are arranged rearward of the forward-force receiving portions 532, respectively. Subsequently, the connector body 30 of the primary member 20 is inserted into the hollow portion 608 of the operating member 60 from behind. Subsequently, the connector body 30, the movable member 50 and the operating member 60 are covered by the upper hood 410 and the lower hood 460 of the primary member 20. As a result of the aforementioned assembly, each of the connector body 30, the movable member 50 and the operating member 60 is, at least in part, accommodated in the accommodation portion 48 of the primary member 20, and the two cover members 580 are received in the two guide channels 440, respectively. Moreover, the fit portion 310 of the connector body 30 is positioned between the two lock portions 568 in the Y-direction (see FIG. 14).

Figure 13:
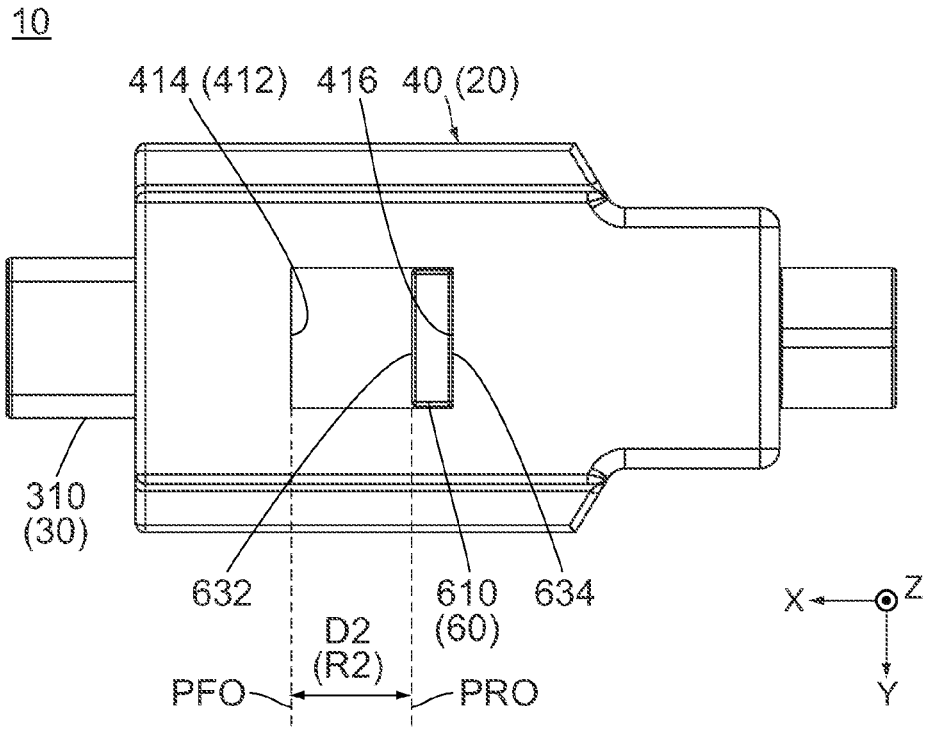
FIG. 13 is a top view showing the connector of FIG. 3.
Figure 14:
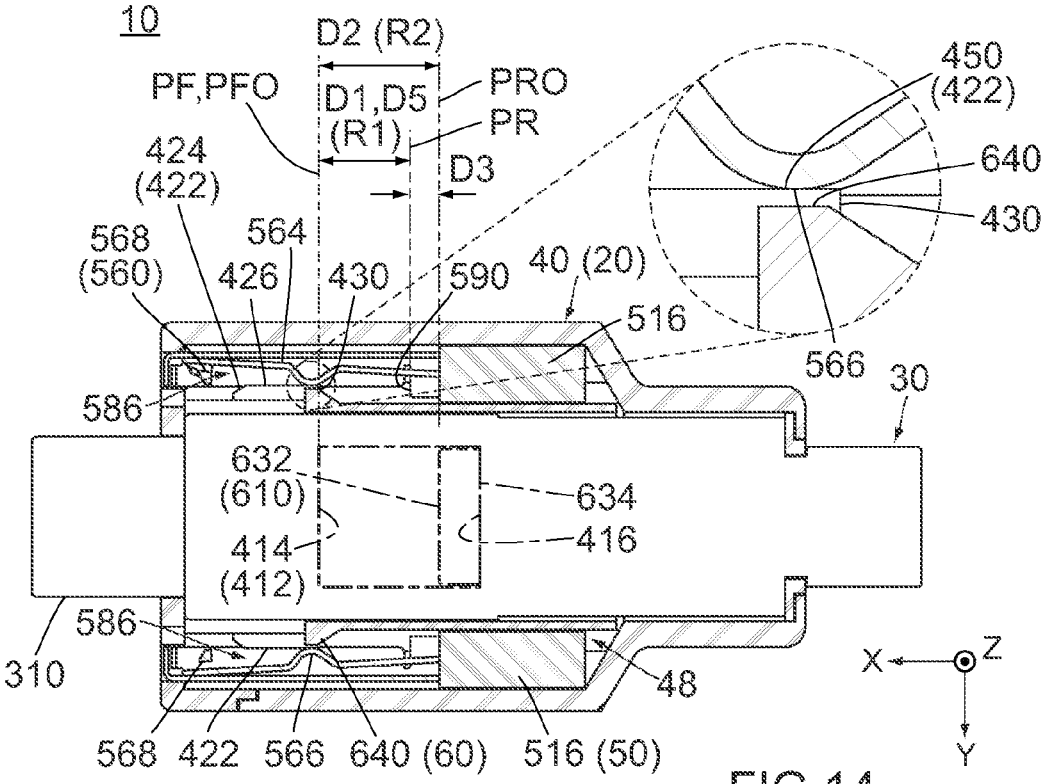
FIG. 14 is a cross-sectional view showing the connector of FIG. 3, wherein the connector body is illustrated in outline, an outline of an operation restriction hole of the primary member and an outline of an operating portion of the operating member are illustrated by chain dotted line, and an operated portion of the lock member and therearound (part enclosed by dashed line) is enlarged to be illustrated.

When the connector 10 is formed as described above, the connector 10 is under an initial state shown in FIGS. 3 and 13 to 16. Referring to FIGS. 14 and 15, when the connector 10 is under the initial state, the movable member 50 partially encloses the operating member 60 and the connector body 30 in the YZ-plane. Moreover, the movable member 50 is entirely accommodated within the accommodation portion 48 of the hood 40, and the operating member 60 is accommodated within the accommodation portion 48 except the operating portions 610. The operating portions 610 project outward from the primary member 20. The thus-arranged operating member 60 can be operated to be moved by a force applied to the operating portions 610 along the X-direction. As shown in FIG. 15, the two operating portions 610 according to the present embodiment are provided so as to project upward and downward, respectively. Therefore, an operator can vertically hold the operating portions 610 to operate the operating member 60 by one hand.

Referring to FIGS. 13 to 15, under the initial state, the rearward-operation restricted portions 634 of the operating member 60 are positioned immediately in front of the rearward-operation restriction portions 416 of the primary member 20, respectively. Therefore, the operating member 60, or the rearward-operation restricted portions 634, cannot be moved rearward. In the meantime, the forward-operation restricted portions 632 of the operating member 60 are positioned rearward of and apart from the forward-operation restriction portions 414 of the primary member 20 by a movement distance D2, respectively. Moreover, there is no portion and no member, between the operating member 60 and the primary member 20 in the X-direction, which stops a forward movement of the operating member 60. Therefore, the operating member 60, or the forward-operation restricted portions 632, can be moved forward by the movement distance D2.

The forward-operation restriction portions 414 are positioned straight forward of the forward-operation restricted portions 632, respectively. The thus-positioned forward-operation restricted portions 632 are brought into contact with the forward-operation restriction portions 414, respectively, when moved forward by the movement distance D2. Therefore, the forward-operation restricted portions 632 cannot be moved forward beyond the forward-operation restriction portions 414. However, the forward-operation restricted portions 632 can be moved rearward by the movement distance D2 after moved forward by the movement distance D2.

As can be seen from the above explanation, the forward-operation restricted portions 632 are movable forward and rearward by the movement distance D2. In detail, the forward-operation restricted portions 632 are movable forward and rearward relative to the primary member 20 by the movement distance D2 between a front position PFO and a rear position PRO of a predetermined operation range R2 in the X-direction. The front position PFO is a position of the forward-operation restriction portions 414 of the primary member 20 in the X-direction. The rear position PRO is a position of the forward-operation restricted portions 632 in the X-direction under a state where the rearward-operation restricted portions 634 are in contact with the rearward-operation restriction portions 416 of the primary member 20.

Each of the forward-operation restricted portions 632 is a part of the operating member 60. Therefore, when the forward-operation restricted portions 632 are moved, the whole of the operating member 60 is moved in a direction same as the moving direction of the forward-operation restricted portions 632 by a distance same as the movement distance of the forward-operation restricted portions 632. In the following explanation, the position of the operating member 60 means the position of the forward-operation restricted portions 632. Thus, the operating member 60 is movable forward and rearward relative to the primary member 20 by the movement distance D2 between the front position PFO and the rear position PRO of the operation range R2 in the X-direction. The forward-operation restriction portions 414 restrict the forward movement of the operating member 60 to define the front position PFO of the operation range R2. In addition, the rearward-operation restriction portions 416 restrict the rearward movement of the operating member 60 to define the rear position PRO of the operation range R2.

Referring to FIG. 14, under the initial state, a rear end of the movable member 50 is positioned immediately in front of a part of an inner wall of the hood 40. The thus-positioned movable member 50 cannot be moved rearward. In the meantime, the forward-movement restricted portions 590 of the movable member 50 are positioned rearward of and apart from the forward-movement restriction portions 430 of the primary member 20 by a movement distance D1, respectively. Moreover, except the operating member 60, there is no portion and no member, between the movable member 50 and the primary member 20 in the X-direction, which stops a forward movement of the movable member 50. Moreover, the operating member 60 is movable relative to the primary member 20. Therefore, the movable member 50, or the forward-movement restricted portions 590, can be moved forward by the movement distance D1.

The forward-movement restriction portions 430 are positioned straight forward of the forward-movement restricted portions 590, respectively. The thus-positioned forward-movement restricted portions 590 are brought into contact with the forward-movement restriction portions 430, respectively, when moved forward by the movement distance D1. Therefore, the forward-movement restricted portions 590 cannot be moved forward beyond the forward-movement restriction portions 430. However, the forward-movement restricted portions 590 can be moved rearward by the movement distance D1 after moved forward by the movement distance D1.

As can be seen from the above explanation, the forward-movement restricted portions 590 are movable forward and rearward by the movement distance D1. In detail, the forward-movement restricted portions 590 are movable forward and rearward relative to the primary member 20 by the movement distance D1 between a front position PF and a rear position PR of a predetermined movement range R1 in the X-direction. The front position PF is a position of the forward-movement restriction portions 430 of the primary member 20 in the X-direction. The rear position PR is a position of the forward-movement restricted portions 590 in the X-direction under a state where the rear end of the movable member 50 is in contact with the inner wall of the hood 40.

Each of the forward-movement restricted portions 590 is a part of the movable member 50. Therefore, when the forward-movement restricted portions 590 are moved, the whole of the movable member 50 is moved in a direction same as the moving direction of the forward-movement restricted portions 590 by a distance same as the movement distance of the forward-movement restricted portions 590. In the following explanation, the position of the movable member 50 means the position of the forward-movement restricted portions 590. Thus, the movable member 50 is movable forward and rearward relative to the primary member 20 by the movement distance D1 between the front position PF and the rear position PR of the movement range R1 in the X-direction. The forward-movement restriction portions 430 restrict the forward movement of the movable member 50 to define the front position PF of the movement range R1. In addition, a rearward-movement restriction portion, or the part of the inner wall of the hood 40 which is to be in contact with the rear end of the movable member 50, restricts the rearward movement of the movable member 50 to define the rear position PR of the movement range R1.

Referring to FIG. 1, when the connector 10 under the aforementioned initial state is entirely moved toward the mating connector 80, the fit portion 310 is inserted into the mating fit portion 812, and the contacts 320 (see FIG. 23) are connected to the mating contacts 814 (see FIG. 2), respectively. The thus-mated connector 10 can be removed from the mating connector 80 only by pulling the connector 10 rearward. In other words, the connector 10 is under the mated state where the connector 10 and the mating connector 80 are mated with each other while maintaining its initial state where the operating member 60 is positioned at the rear position PRO of the operation range R2 and the movable member 50 is positioned at the rear position PR of the movement range R1 (see FIG. 14). Hereafter, explanation will be made about an operation for locking the mated state of the connector 10 with the mating connector 80 and another operation for unlocking the mated state.

Referring to FIG. 15, under the initial state, the rearward-force receiving portions 534 of the movable member 50 are positioned immediately behind the rearward-force applying portions 624 of the operating member 60, respectively, and in contact with the rearward-force applying portions 624, respectively. In the meantime, the forward-force receiving portions 532 of the movable member 50 are positioned straight forward of the forward-force applying portions 622 of the operating member 60, respectively.

Figure 18:
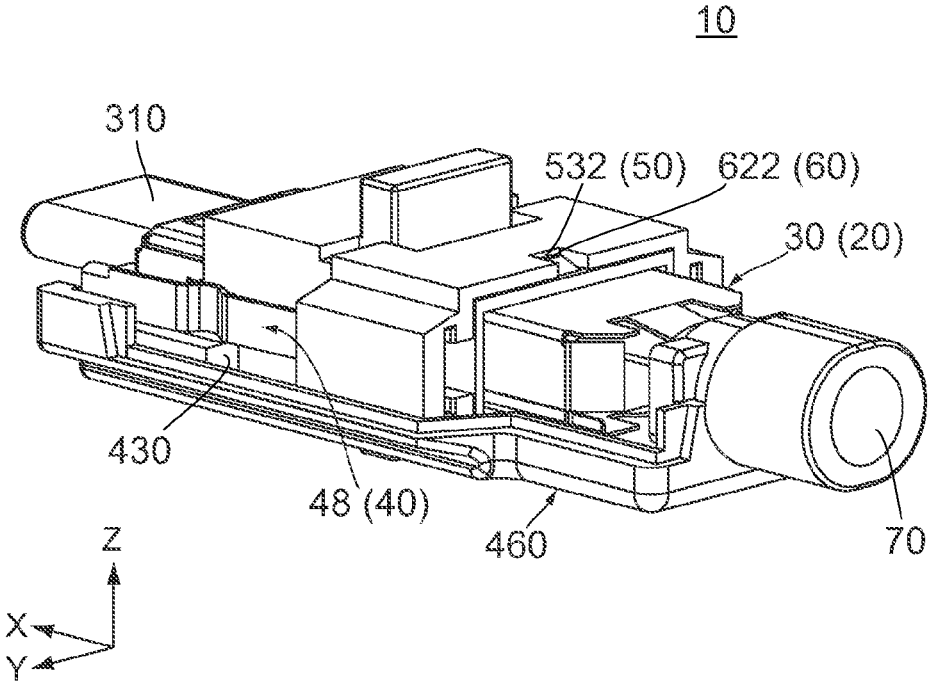
FIG. 18 is a perspective view showing the connector of FIG. 17, wherein the upper hood and the cover member are not illustrated.

In detail, referring to FIG. 18, a position of the forward-force applying portions 622 in a perpendicular plane (YZ-plane) perpendicular to the X-direction is equal to or overlaps with another position of the forward-force receiving portions 532 in the YZ-plane. Moreover, referring to FIGS. 14 and 15, under the initial state where the operating member 60 is positioned at the rear position PRO of the operation range R2 and where the movable member 50 is positioned at the rear position PR of the movement range R1, the forward-force applying portions 622 are positioned rearward of and apart from the forward-force receiving portions 532 by a predetermined distance D3, respectively, and face the forward-force receiving portions 532 in the X-direction, respectively. The predetermined distance D3 is shorter than the movement distance D2. Therefore, when the operating member 60 is moved forward from the rear position PRO of the operation range R2 by the predetermined distance D3, the forward-force applying portions 622 are brought into contact with the forward-force receiving portions 532, respectively.

Figure 17:
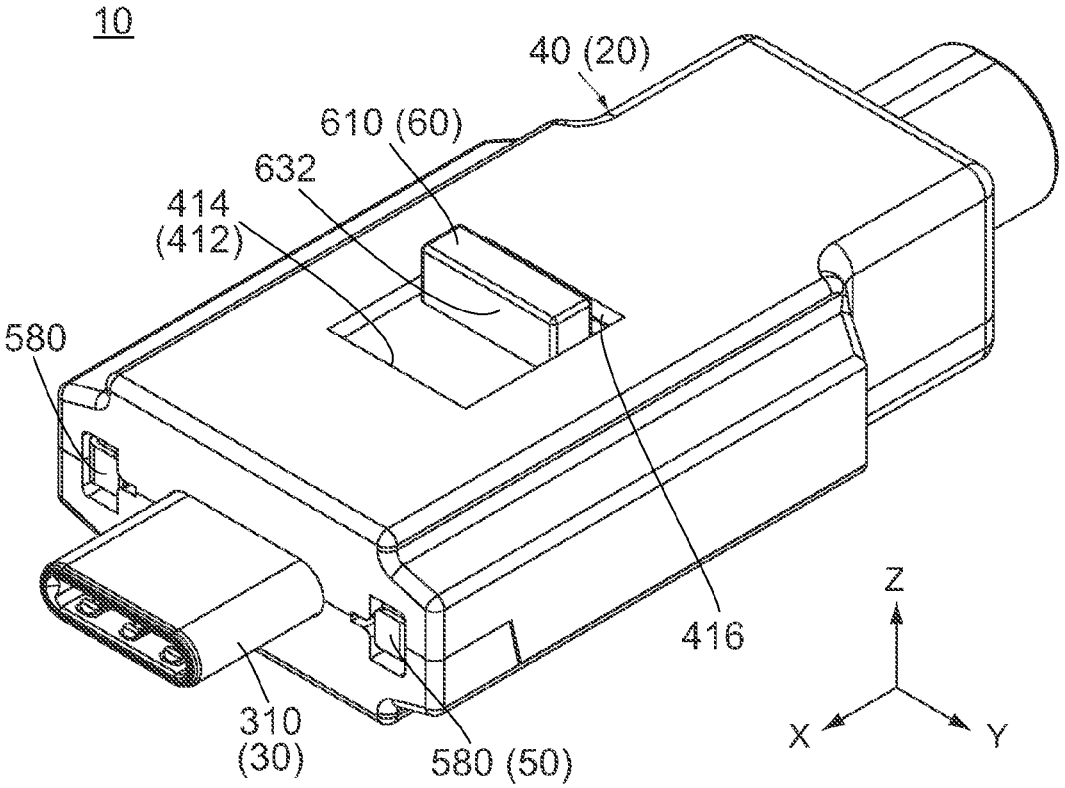
FIG. 17 is a perspective view showing the connector of FIG. 3, wherein the connector is under a transitional state.

When the forward-force applying portions 622 are brought into contact with the forward-force receiving portions 532, the connector 10 is under a transitional state shown in FIGS. 17 and 18.

Figure 16:
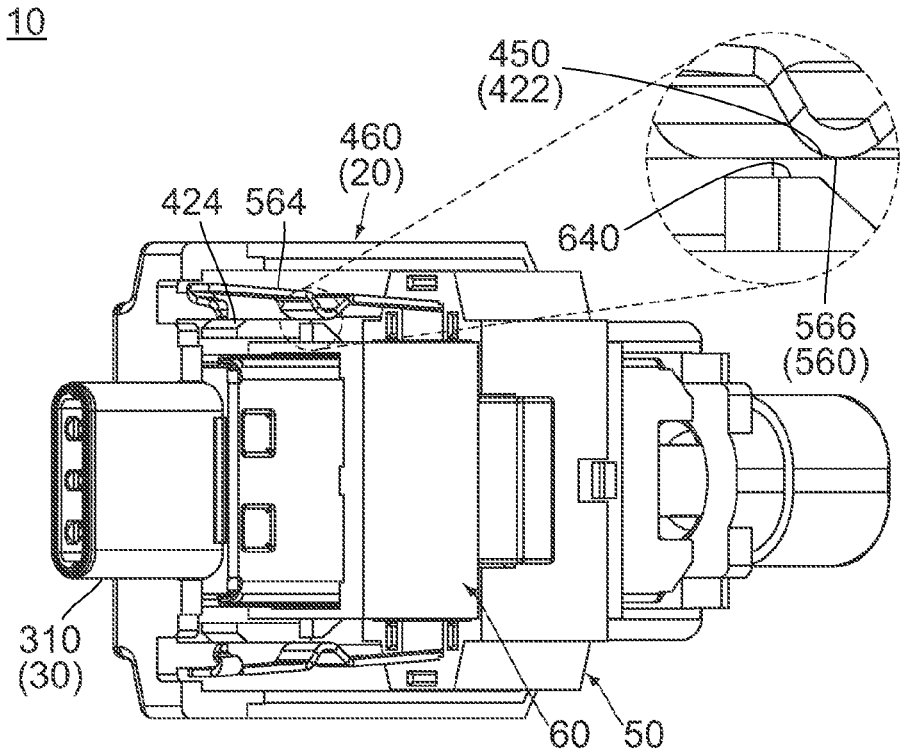
FIG. 16 is a view showing the connector of FIG. 3 from the upper front thereof, wherein the upper hood and cover members of the movable member are not illustrated, and the operated portion and therearound (part enclosed by dashed line) is enlarged to be illustrated.

Referring to FIGS. 14 and 16, the maintenance portions 422 of the primary member 20, except the front end portions 424 thereof, are positioned outward in the Y-direction beyond the operating projections 640 of the operating member 60, respectively. Moreover, under the initial state, rear ends of the maintenance portions 422 are positioned rearward beyond top points of curves of the operated portions 566 of the movable member 50, respectively. As a result, the support portions 564 of the movable member 50 are resiliently deformed outward in the Y-direction. In detail, the operated portions 566 are positioned outward of the maintenance portions 422 in the Y-direction, respectively, and positioned outward of and apart from the operating projections 640 in the Y-direction, respectively. Therefore, while the operating member 60 is moved forward from the rear position PRO by the predetermined distance D3, the operating member 60 applies no direct force to the operated portions 566.

As can be seen from the above explanation, each of the maintenance portions 422 has a predetermined part which is positioned inward of the corresponding operated portions 566 in the Y-direction when the movable member 50 is positioned in the vicinity of the rear position PR. The predetermined part works as a temporarily holding portion 450 which temporarily holds the corresponding operated portion 566. In other words, the maintenance portions 422 are provided with the temporarily holding portions 450, respectively. The temporarily holding portions 450 are positioned outward beyond the operating projections 640 of the operating member 60 in the Y-direction, respectively. When the operating member 60 is positioned at the rear position PRO of the operation range R2, the operated portions 566 are positioned outward of the temporarily holding portions 450 in the Y-direction, respectively.

The temporarily holding of the temporarily holding portions 450 keeps the movable member 50 at the rear position PR of the movement range R1 while the operating member 60 is moved forward from the rear position PRO of the operation range R2 by the predetermined distance D3. Therefore, the operating member 60 is moved relative to the primary member 20 and is moved relative to the movable member 50. Thus, the operating member 60 is movable forward relative to the movable member 50 by the predetermined distance D3 in the X-direction.

Figure 19:
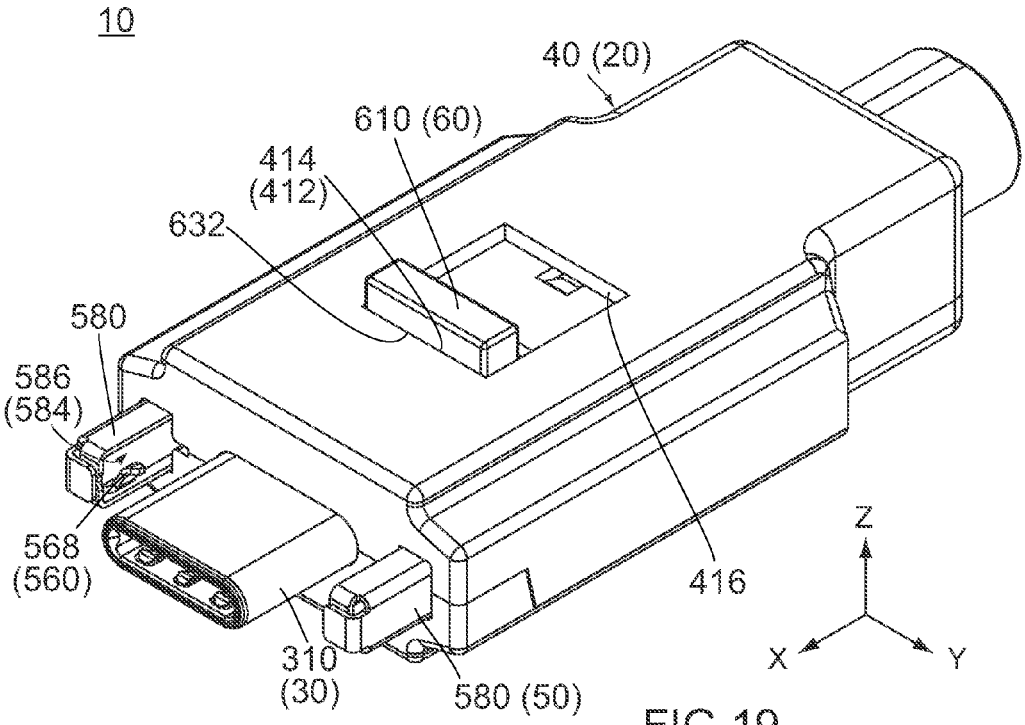
FIG. 19 is a perspective view showing the connector of FIG. 3, wherein the connector is under a lockable state.
Figure 21:
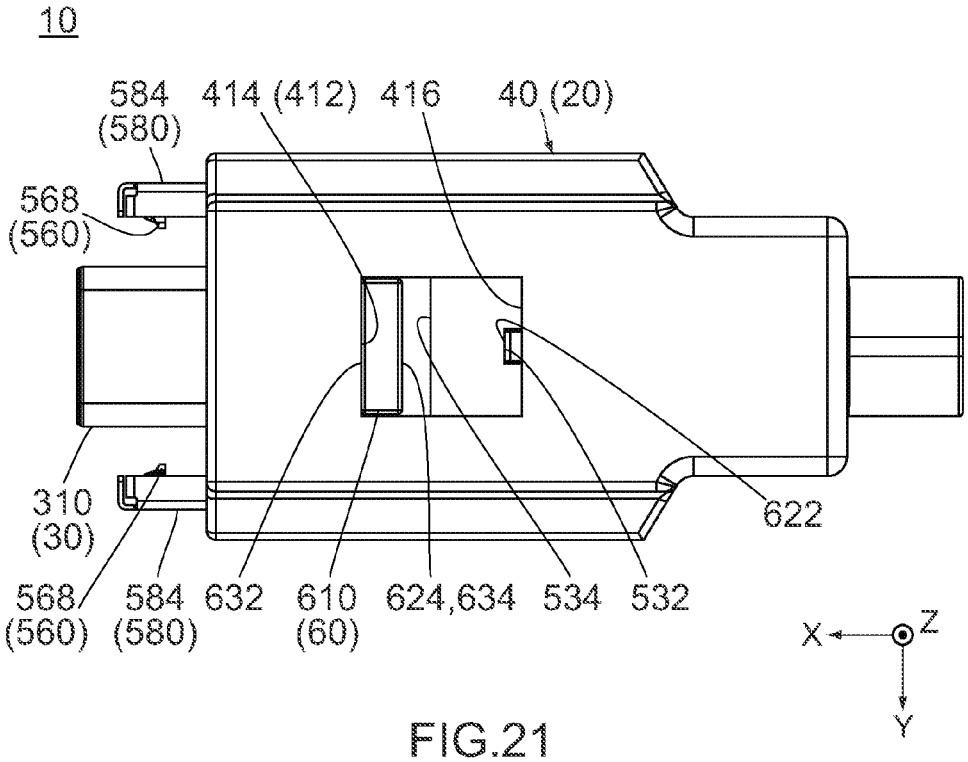
FIG. 21 is a top view showing the connector of FIG. 19.

Referring to FIGS. 15 and 18, when the operating member 60, which is positioned forward of the rear position PRO by the predetermined distance D3, is further moved forward, the forward-force applying portions 622 apply a forward force, which forces the forward-force receiving portions 532 to be moved forward, to the forward-force receiving portions 532. The forward force moves the movable member 50 forward together with the operating member 60. Referring to FIGS. 19 and 21, when the operating member 60 continues to be moved forward, the forward-operation restricted portions 632 of the operating member 60 are brought into abutment with the forward-operation restriction portions 414 of the primary member 20, respectively, so that the operating member 60 is stopped relative to the primary member 20.

When the forward-operation restricted portions 632 are brought into abutment with the forward-operation restriction portions 414, the connector 10 is under a lockable state shown in FIGS. 19 to 25.

Figure 20:
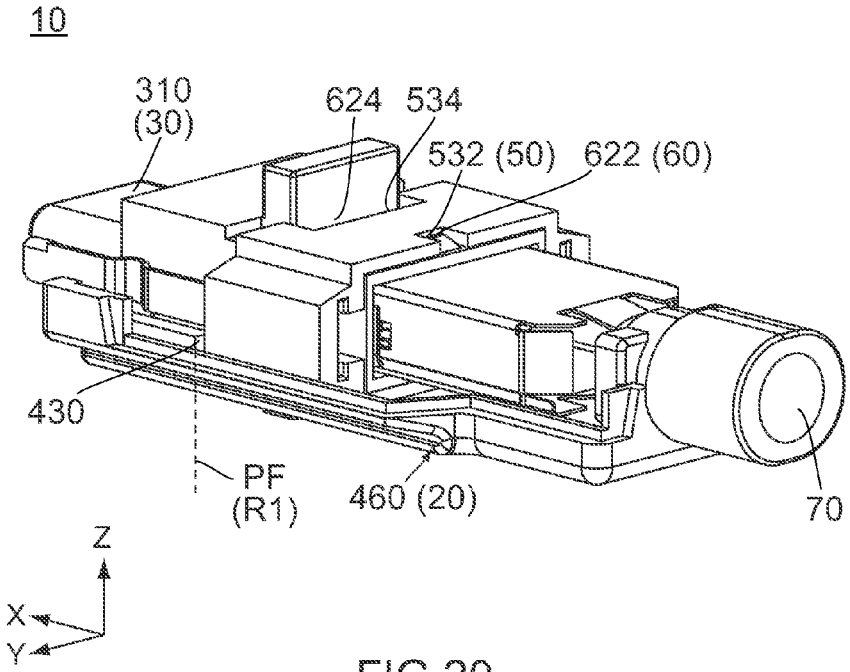
FIG. 20 is a perspective view showing the connector of FIG. 19, wherein the upper hood and the cover member are not illustrated.
Figure 25:
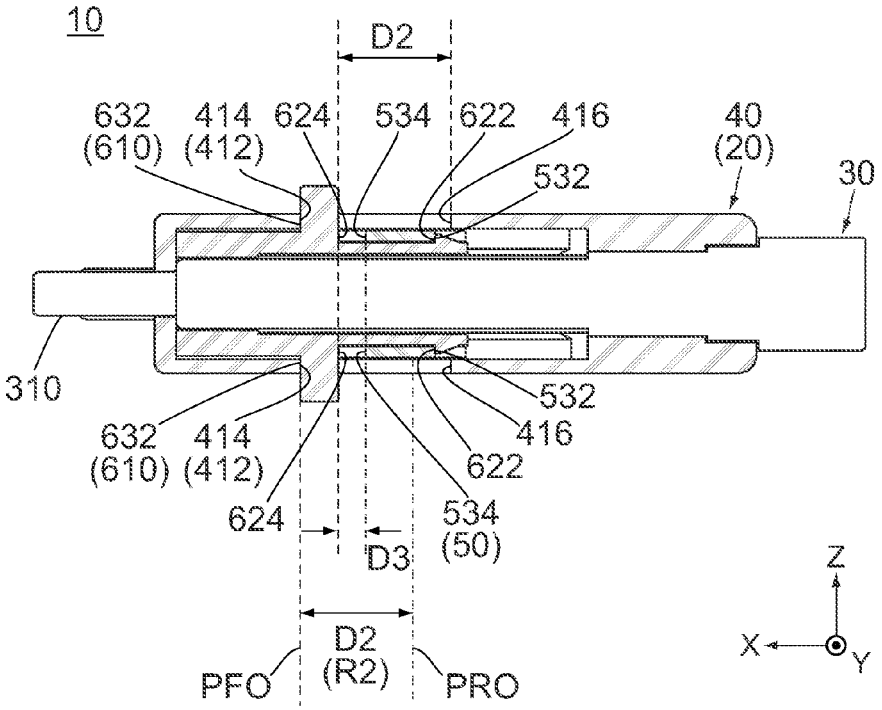
FIG. 25 is another cross-sectional view showing the connector of FIG. 19, wherein the connector body is illustrated in outline.
Figure 26:
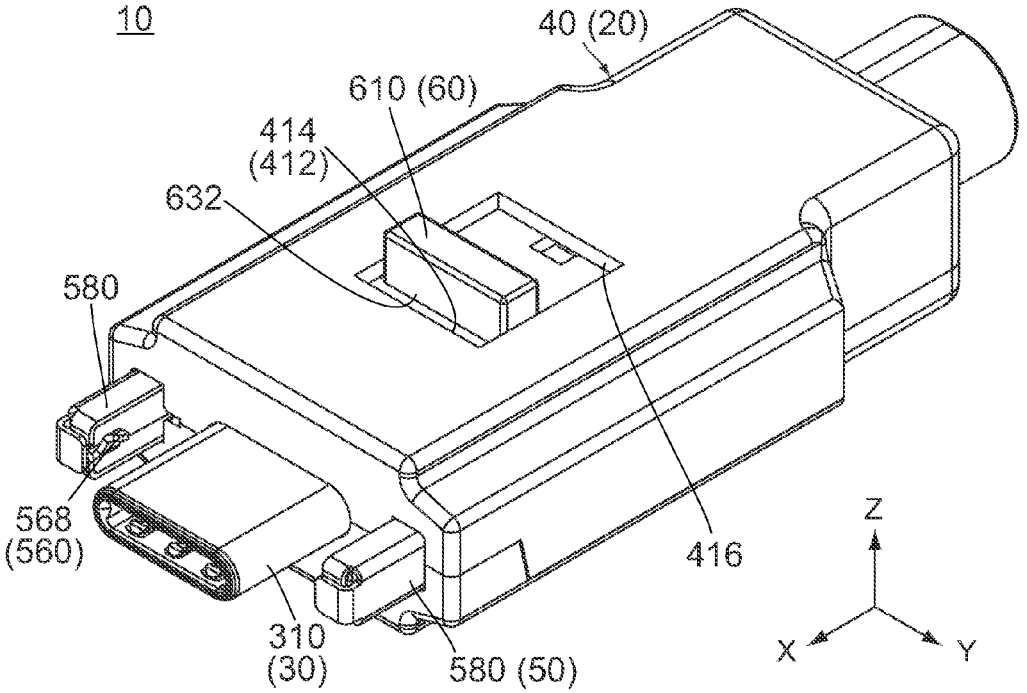
FIG. 26 is a perspective view showing the connector of FIG. 3, wherein the connector is under an unlock state.

Referring to FIG. 25, under the lockable state, the operating member 60 is positioned at the front position PFO of the operation range R2. Referring to FIGS. 20 and 24, under the lockable state, the movable member 50 is positioned at the front position PF of the movement range R1, and the forward-movement restricted portions 590 of the movable member 50 are positioned immediately behind the forward-movement restriction portions 430 of the primary member 20, respectively. The thus-positioned movable member 50 is prevented from being independently moved forward.

Referring to FIG. 24, under the lockable state, the operated portions 566 of the movable member 50 are positioned forward of the rear portions 426 of the maintenance portions 422 of the primary member 20, respectively, and not in contact with the maintenance portions 422, respectively.

Moreover, the operated portions 566 are positioned rearward of the outside surfaces 644 of the operating projections 640, respectively, and not in contact with the operating projections 640, respectively. The thus-positioned operated portions 566 receive no force directed outward in the Y-direction, so that the resiliently deformed support portions 564 return to their initial spring state. As a result, as shown in FIGS. 19, 21, 23 and 24, the lock portions 568 project inward in the Y-direction from the receiving portions 586 of the covers 584, respectively.

Referring to FIG. 24, the end portions of the lock portions 568 project from the covers 584, respectively, and are positioned inside of the mating lock portions 824 of the mating connector 80 under the mated state, respectively. The thus-positioned lock portions 568 prevent the connector 10 from being removed from the mating connector 80. In other words, the mated state is locked by the lock portions 568 and the mating lock portions 824 when the operating member 60 is positioned at the front position PFO of the operation range R2 under the mated state (see FIG. 25) and when the movable member 50 is positioned at the front position PF of the movement range R1 under the mated state. Moreover, a rear edge of each of the lock portions 568 extends along the Y-direction under the mated state. Even if the connector 10 is entirely pulled rearward, the thus-extending rear edges of the lock portions 568 are brought into abutment with rear edges of the mating lock portions 824, respectively, so that the mated state is maintained.

Referring to FIG. 25, under the lockable state, the rearward-force receiving portions 534 of the movable member 50 are positioned straight rearward of the rearward-force applying portions 624 of the operating member 60, respectively. In detail, referring to FIG. 20, a position of the rearward-force applying portions 624 in the YZ-plane is equal to or overlaps with another position of the rearward-force receiving portions 534 in the YZ-plane. Referring to FIGS. 24 and 25, when the operating member 60 is positioned at the front position PFO of the operation range R2 and when the movable member 50 is positioned at the front position PF of the movement range R1, the rearward-force applying portions 624 are positioned forward of and apart from the rearward-force receiving portions 534 by the predetermined distance D3, respectively, and face the rearward-force receiving portions 534 in the X-direction, respectively. Therefore, when the operating member 60 is moved rearward from the front position PFO of the operation range R2 by the predetermined distance D3, the rearward-force applying portions 624 are brought into contact with the rearward-force receiving portions 534, respectively.

When the rearward-force applying portions 624 are brought into contact with the rearward-force receiving portions 534, the connector 10 is under an unlock state shown in FIGS. 26 to 29.

Referring to FIGS. 24 and 25, while the operating member 60 is moved rearward from the front position PFO of the operation range R2 by the predetermined distance D3, the movable member 50 is kept at the front position PF of the movement range R1. Therefore, the operating member 60 is moved relative to the primary member 20 and is moved relative to the movable member 50. Thus, the operating member 60 is movable rearward relative to the movable member 50 by the predetermined distance D3 in the X-direction.

Figure 28:
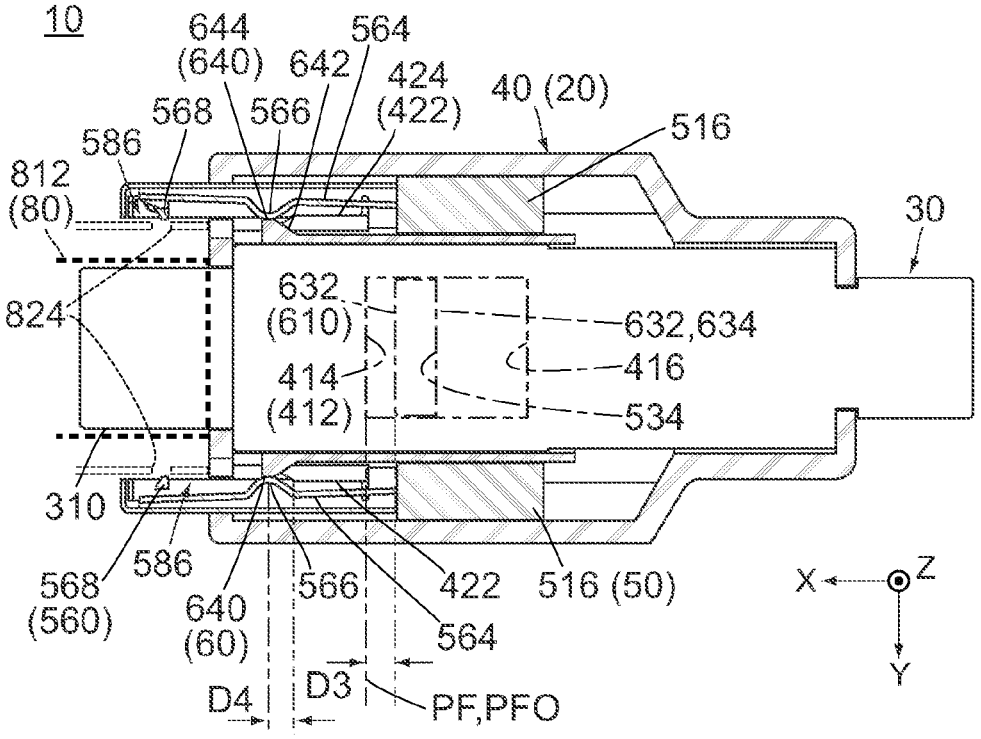
FIG. 28 is a cross-sectional view showing the connector of FIG. 26, wherein the connector body is illustrated in outline, an outline of the operation restriction hole and an outline of the operating portion are illustrated by chain dotted line, and an outline of the mating fit portion and outlines of the mating lock portions are illustrated by dashed line.

Referring to FIGS. 24, 25 and 28, when the operating member 60 is moved rearward from the front position PFO by the predetermined distance D3, the sloping surfaces 642 of the operating projections 640 of the operating member 60 are brought into contact with the operated portions 566 of the movable member 50, respectively, and push the operated portions 566 outward in the Y-direction, respectively. As a result, the support portions 564 are resiliently deformed outward in the Y-direction, and the lock portions 568 are moved outward in the Y-direction. When the operating member 60 is positioned rearward of and apart from the front position PFO by the predetermined distance D3, the operated portions 566 are positioned on the outside surfaces 644 of the operating projections 640, respectively.

In other words, the operated portions 566 are positioned outward of the operating projections 640 in the Y-direction, respectively, when the operating member 60 is positioned rearward of the front position PFO of the operation range R2 by the predetermined distance D3 and when the movable member 50 is positioned at the front position PF of the movement range R1. The lock portions 568 under the mated state are moved outward of the mating lock portions 824 in the Y-direction, respectively, to unlock the mated state. When the mated state is unlocked, the lock portions 568 are received in the covers 584, respectively.

According to the present embodiment, the mated state is unlocked when the operating member 60 is positioned rearward of the front position PFO of the operation range R2 by the predetermined distance D3 and when the movable member 50 continues to be positioned at the front position PF of the movement range R1. Thus, the mated state can be unlocked with no rearward movement of the movable member 50, or with no abutment of the lock portion 568 with the rear edge of the mating lock portion 824.

Figure 27:
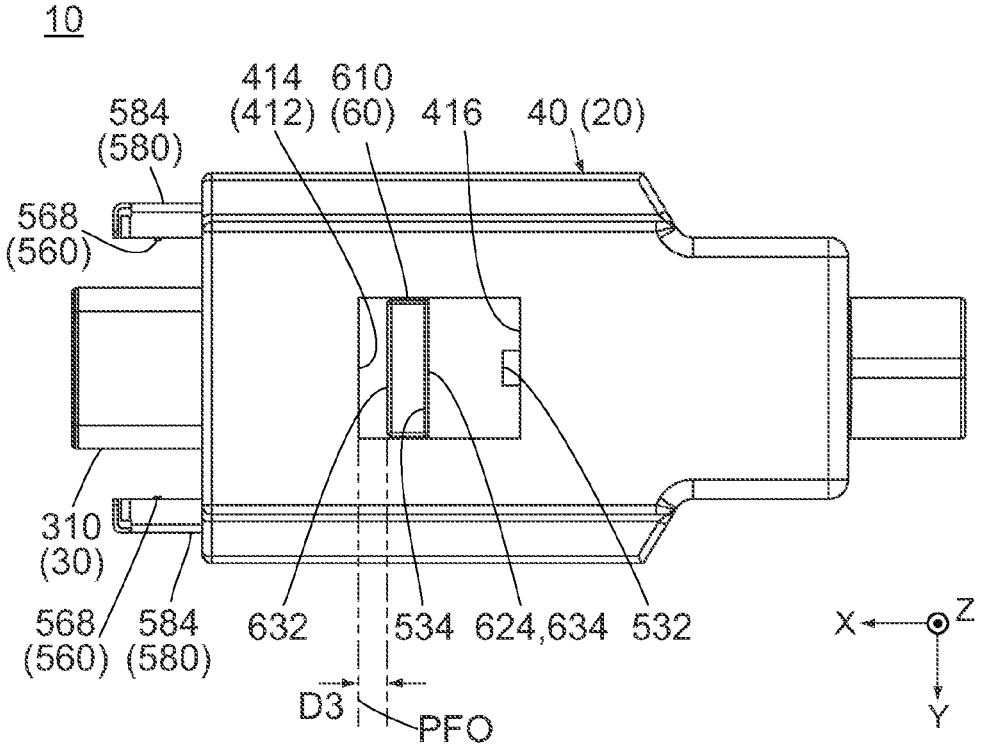
FIG. 27 is a top view showing the connector of FIG. 26.
Figure 29:
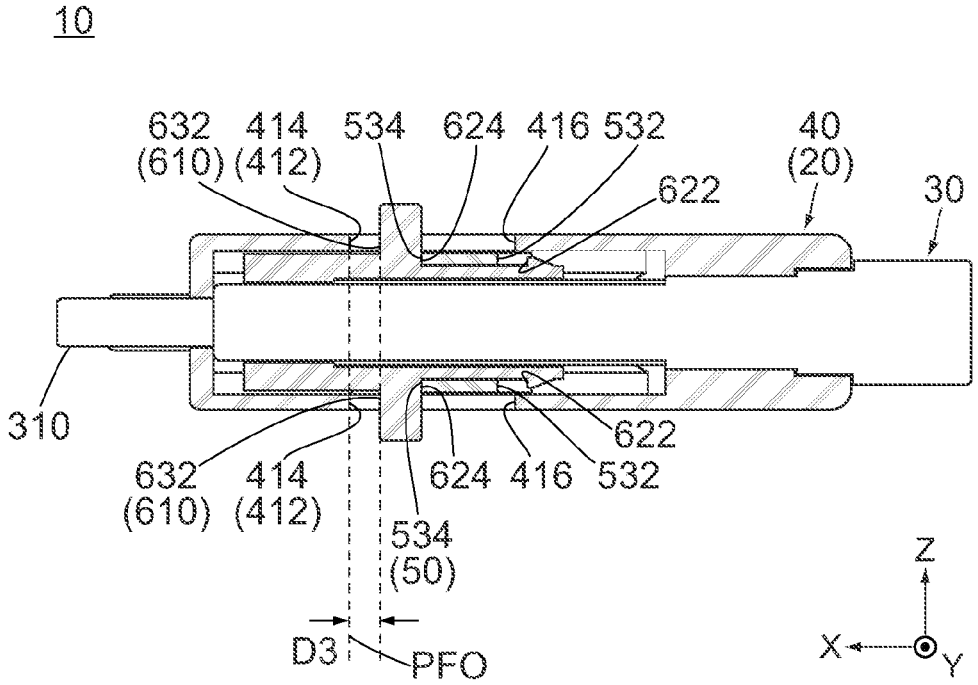
FIG. 29 is another cross-sectional view showing the connector of FIG. 26, wherein the connector body is illustrated in outline.

Referring to FIGS. 27 to 29, when the operating member 60, which is positioned rearward of the front position PFO by the predetermined distance D3, is further moved rearward, the rearward-force applying portions 624 apply a rearward force, which forces the rearward-force receiving portions 534 to be moved rearward, to the rearward-force receiving portions 534. The rearward force moves the movable member 50 rearward together with the operating member 60.

As can be seen from FIG. 28, when the operating member 60 is further moved rearward by an additional predetermined distance D4 from the position which is rearward of and apart from the front position PFO by the predetermined distance D3, the operated portions 566 of the movable member 50 ride on the rear portions 426 of the maintenance portions 422, respectively. The thus-positioned operated portions 566 keep the lock portions 568 in the covers 584, respectively. In other words, when the operating member 60 is positioned rearward of the front position PFO of the operation range R2 by a distance, which is more than the predetermined distance D3 by the additional predetermined distance D4, and when the movable member 50 is positioned rearward of the front position PF of the movement range R1 by the additional predetermined distance D4, the operated portions 566 are positioned outward of the maintenance portions 422 in the Y-direction, respectively, and the lock portions 568 are kept under a state where the lock portions 568 are moved outward in the Y-direction.

Referring to FIGS. 27 to 29 together with FIGS. 13 to 15, when the operating member 60 continues to be moved rearward, the rearward-operation restricted portions 634 of the operating member 60 are brought into contact with the rearward-operation restriction portions 416 of the primary member 20, respectively, and the operating member 60 is positioned at the rear position PRO of the operation range R2. Referring to FIG. 14, according to the present embodiment, when the operating member 60 is positioned at the rear position PRO of the operation range R2, the rear end of the movable member 50 is brought into contact with the inner wall of the hood 40 so that the movable member 50 is positioned at the rear position PR of the movement range R1. At that time, the connector 10 is under the initial state shown in FIGS. 3 and 13 to 16.

When the operating member 60 is further moved rearward under the initial state of the connector 10, the connector 10 is removed from the mating connector 80 (see FIG. 1).

Referring to FIG. 14, in the present embodiment, the movement distance D2 between the front position PFO and the rear position PRO of the operation range R2 of the operating member 60 is more than the movement distance D1 between the front position PF and the rear position PR of the movement range R1 of the movable member 50 by the predetermined distance D3.

According to the present embodiment, when the operating member 60 is positioned at the rear position PRO of the operation range R2, the movable member 50 is positioned at the rear position PR and cannot be moved rearward beyond the rear position PR. The movable member 50 is kept at the rear position PR of the movement range R1 unless the operating member 60 is moved forward. Thus, the movable member 50 is prevented from being unintentionally moved in the accommodation portion 48. Moreover, when the operating member 60 is positioned at the front position PFO of the operation range R2, the movable member 50 is positioned at the front position PF and cannot be moved forward beyond the front position PF. As can be seen from the above explanation, the movement distance D1 according to the present embodiment is equal to a movable distance D5 of a movable range in which the movable member 50 is actually movable in the front-rear direction. In detail, the front position PF and the rear position PR are equal to the position of the front end and the position of the rear end of the movable range having the movable distance D5, respectively.

However, the present invention is not limited thereto. For example, the movable member 50 may be allowed to be moved rearward from the rear position PR to some extent. In other words, the movable member 50 may be movable rearward relative to the operating member 60 which is positioned at the rear position PRO of the operation range R2. Similarly, the movable member 50 may be movable forward relative to the operating member 60 which is positioned at the front position PFO of the operation range R2. In other words, the movement distance D2 of the operation range R2 of the operating member 60 may be shorter than a distance that is more than the movable distance D5 of the movement range R1 of the movable member 50 by the predetermined distance D3.

Figure 31:
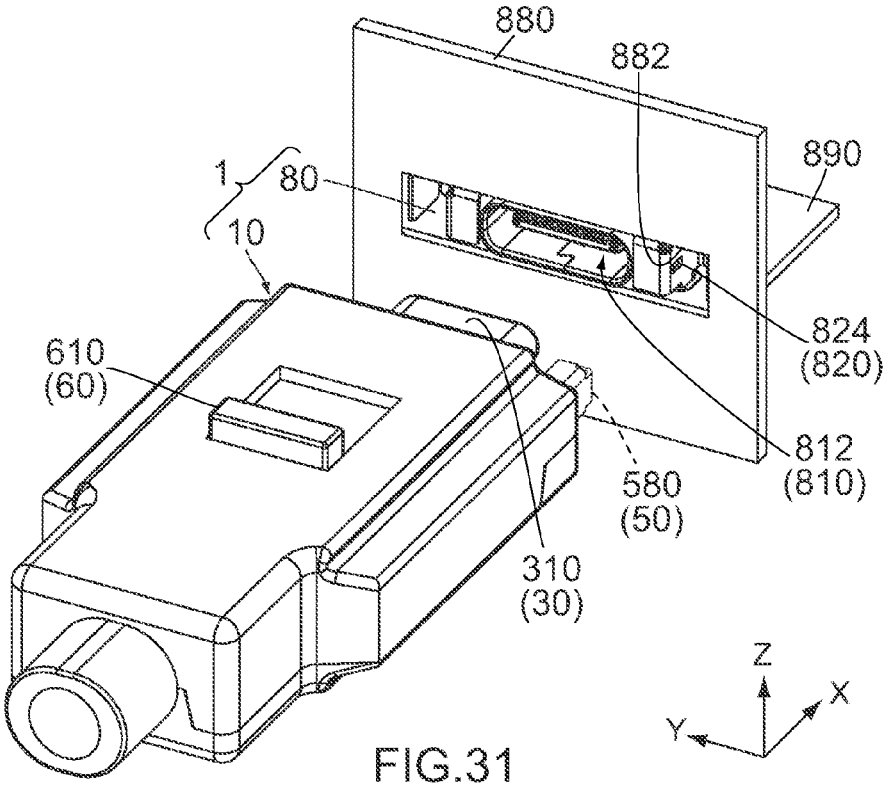
FIG. 31 is a perspective view showing the connector and the mating connector of FIG. 1, wherein the mating connector is mounted on the mating circuit board and arranged within a case, and an outline of the cover member under the lockable state of the connector is illustrated by dashed line.
Figure 32:
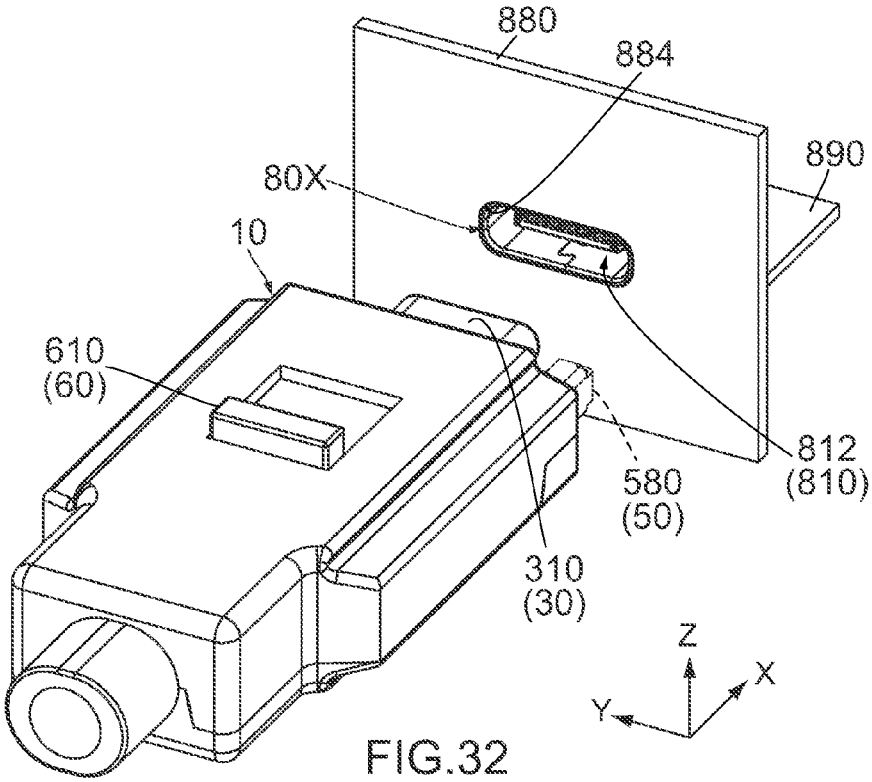
FIG. 32 is a perspective view showing the connector and the mating connector of FIG. 1, wherein the mating connector is mounted on the mating circuit board and arranged within another case, and an outline of the cover member under the lockable state of the connector is illustrated by dashed line.

Referring to FIG. 14, the connector 10 comprises a lock mechanism which includes the support portions 564 and the lock portions 568. This lock mechanism is provided to the movable member 50. The movable member 50 is movable between the front position PF and the rear position PR of the movement range R1 in the X-direction relative to the primary member 20 which is provided with the fit portion 310. Therefore, the lock mechanism is movable along the X-direction. Referring to FIGS. 31 and 32, this structure enables the connector 10 to be mateable with the mating connector 80 even if the mating connector 80 is arranged within a case 880.

Referring to FIG. 31, for example, in a situation where the connector 10 is required to be mated with the mating connector 80 comprising the mating lock portions 824 and where the case 880 is formed with an attachment hole 882 which allows the cover members 580 to pass therethrough, the mated state can be locked by positioning the movable member 50 at the front position PF of the movement range R1.

Referring to FIG. 32, for example, in a situation where the connector 10 is required to be mated with a mating connector 80X comprising no mating lock portion 824 and where the case 880 is formed with an attachment hole 884 which prevents the cover members 580 from passing therethrough, the connector 10 can be mated with the mating connector 80X by positioning the movable member 50 at the rear position PR of the movement range R1. In other words, the connector according to the present invention can be mated with the mating connector even in a situation where a portion or a member is provided on a moving path of the connector and blocks the lock mechanism upon mating of the connector with the mating connector.

The present embodiment can be further variously modified in addition to the already explained modifications.

Figure 30:
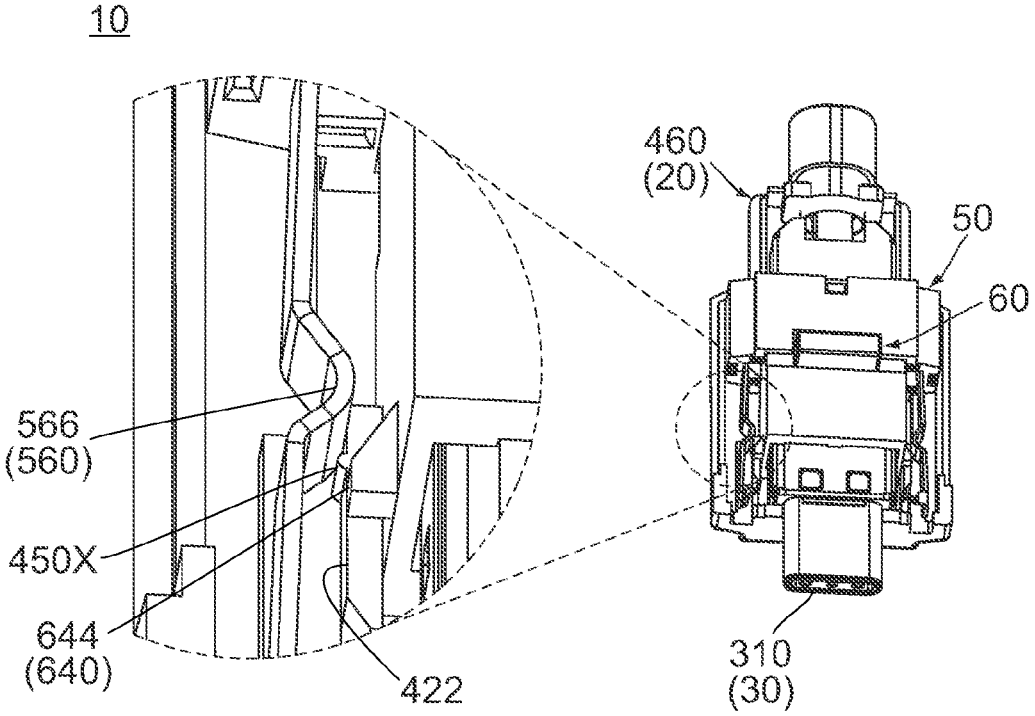
FIG. 30 is a view showing a modification of the connector of FIG. 16, wherein the connector is under the transitional state, the upper hood and the cover members are not illustrated, and the operated portion and therearound (part enclosed by dashed line) is enlarged to be illustrated.

For example, referring to FIGS. 16 and 30, the connector 10 may comprise temporarily holding portions (ribs) 450X instead of the temporarily holding portions 450 which are parts of the maintenance portions 422, respectively. More specifically, as shown in FIG. 30, each of the maintenance portions 422 may be provided with a rib which works as a temporarily holding portion. The illustrated temporarily holding portions 450X project outward in the Y-direction beyond the operating projections 640 of the operating member 60, respectively. When the operating member 60 is positioned at the rear position PRO of the operation range R2, the temporarily holding portions 450X partially cover the operated portions 566 from the front, respectively.

The thus-provided temporarily holding portion 450X can temporarily hold the operated portion 566 even in a situation where the maintenance portion 422 is positioned at a position same as that of the outside surface 644 of the operating projection 640 in the Y-direction, and even in another situation where the maintenance portion 422 is positioned slightly inward of the outside surface 644 in the Y-direction.

As described above, when the temporarily holding portion such as the temporarily holding portion 450 or the temporarily holding portion 450X is provided as a part of the primary member 20, the movable member 50 can be kept at the rear position PR without using a member such as a spring. Referring to FIG. 14, when the operating member 60 is moved forward from the rear position PRO shown in FIG. 15 by the predetermined distance D3, the thus-provided temporarily holding portion prevents inward projection of the end portion of the lock portion 568 in the Y-direction which might be caused because of the forward movement of the movable member 50.

Second Embodiment

Figure 33:
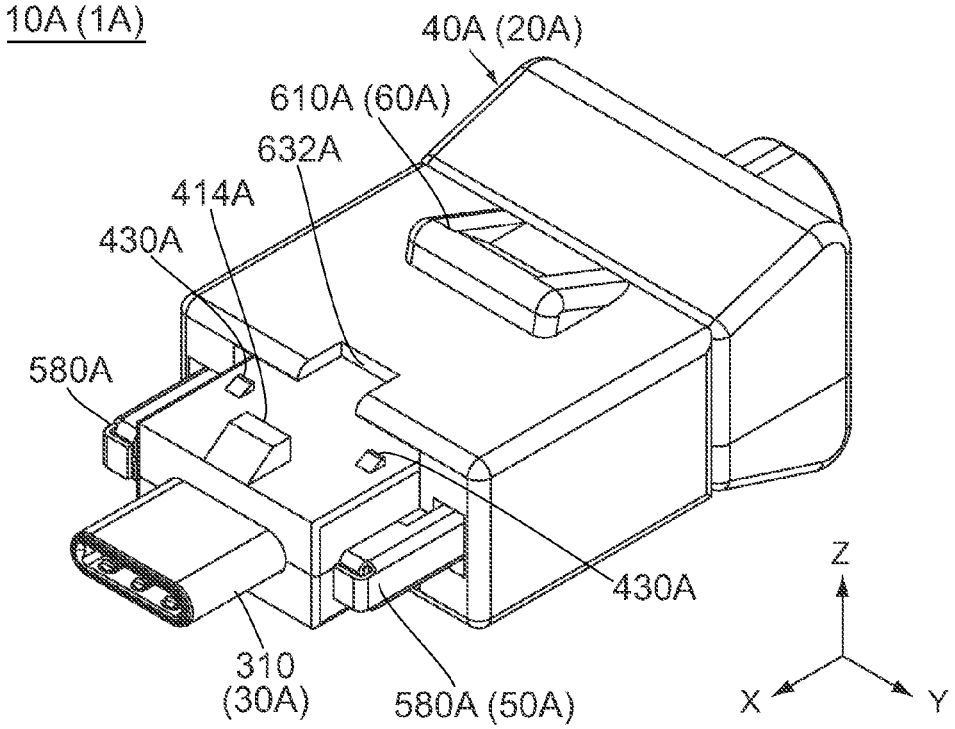
FIG. 33 is a perspective view showing a connector according to a second embodiment of the present invention, wherein the connector is under an initial state.

Referring to FIGS. 2 and 33, a connector assembly 1A according to a second embodiment of the present invention comprises a connector 10A and the mating connector 80. The connector 10A is mateable with the mating connector 80 when moved forward along a front-rear direction (X-direction). The connector 10A according to the present embodiment is a plug and a cable connector connected to the cable 70 similar to the connector 10 (see FIG. 1).

Figure 34:
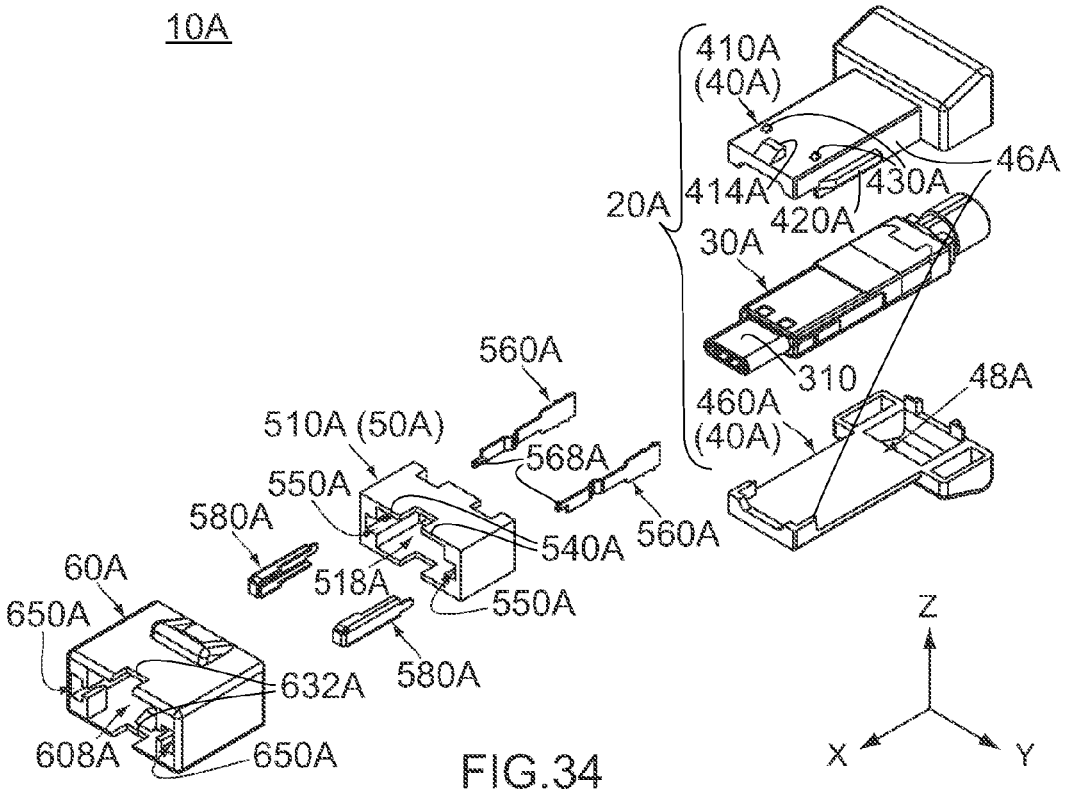
FIG. 34 is an exploded, perspective view showing the connector of FIG. 33.

Referring to FIGS. 4 and 34, the connector 10A comprises a primary member 20A, a movable member 50A and an operating member 60A similar to the connector 10. As explained below, the inclusion relation among the primary member 20A, the movable member 50A and the operating member 60A is different from the inclusion relation among the primary member 20, the movable member 50 and the operating member 60, but the connector 10A works similar to the connector 10 and shows effect similar to that of the connector 10. In addition, the connector 10A includes members and portions (Hereafter, referred to simply as "components") each of which has structure and function same as or similar to those of corresponding one of the various members and portions (Hereafter, referred to simply as "components") of the connector 10.

In the following explanation, if a component of the connector 10A has structure and function same as those of a corresponding component of the connector 10, this component has the reference sign of the corresponding component, and explanation about this component will be omitted unless necessary. Moreover, if a component of the connector 10A has structure and function different from but similar to those of a corresponding component of the connector 10, this component has the reference sign of the corresponding component followed by "A", and explanation will be mainly made about structure and function different from those of the corresponding component of the connector 10.

Referring to FIGS. 33 and 34, in the present embodiment, the primary member 20A is, at least in part, accommodated in the operating member 60A. Moreover, the movable member 50A is, at least in part, accommodated in the operating member 60A, and the primary member 20A is, at least in part, accommodated in the movable member 50A.

The primary member 20A comprises a connector body 30A and a hood 40A made of insulator. The hood 40A is an assembly formed of an upper hood 410A and a lower hood 460A. The hood 40A has two side portions 46A.

As can be seen from FIGS. 33 and 34, the upper hood 410A and the lower hood 460A of the hood 40A are positioned at an upper part and a lower part of the hood 40A in an up-down direction (Z-direction), respectively. The two side portions 46A are positioned at opposite sides of the hood 40A in a lateral direction (Y-direction), respectively. The thus-formed hood 40A has an accommodation portion 48A formed inside thereof. The accommodation portion 48A is a space which pierces the hood 40A in the X-direction.

Figure 35:
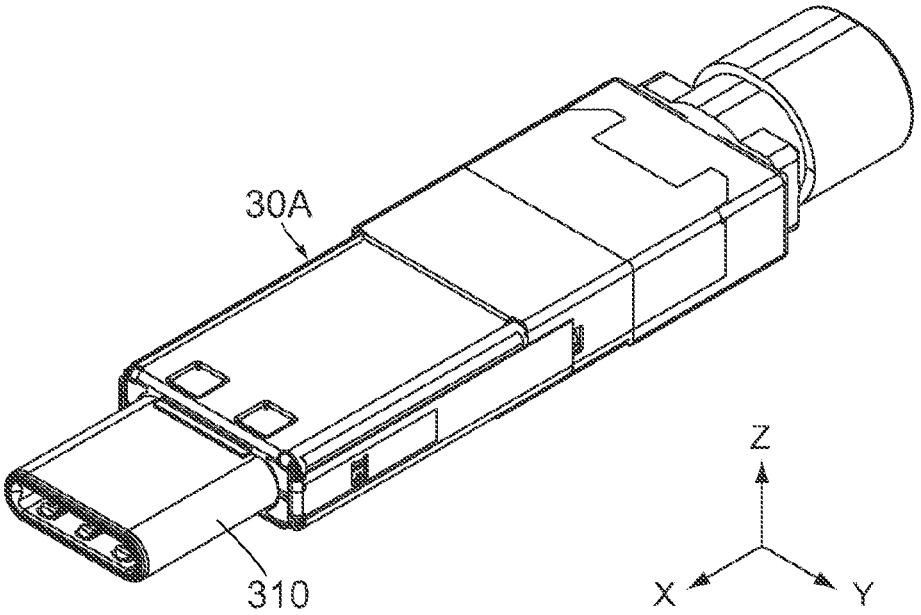
FIG. 35 is a perspective view showing a connector body of a primary member of the connector of FIG. 34.

Referring to FIGS. 33 to 35, the connector body 30A comprises the fit portion 310. The connector body 30A, except the fit portion 310 and a rear end portion thereof, is held within the accommodation portion 48A of the hood 40A and unmovable relative to the hood 40A. The fit portion 310 projects forward from a front end of the hood 40A. The fit portion 310 is fit to the mating fit portion 812 (see FIG. 1) under a mated state where the connector 10A and the mating connector 80 (see FIG. 1) are mated with each other.

Figure 36:
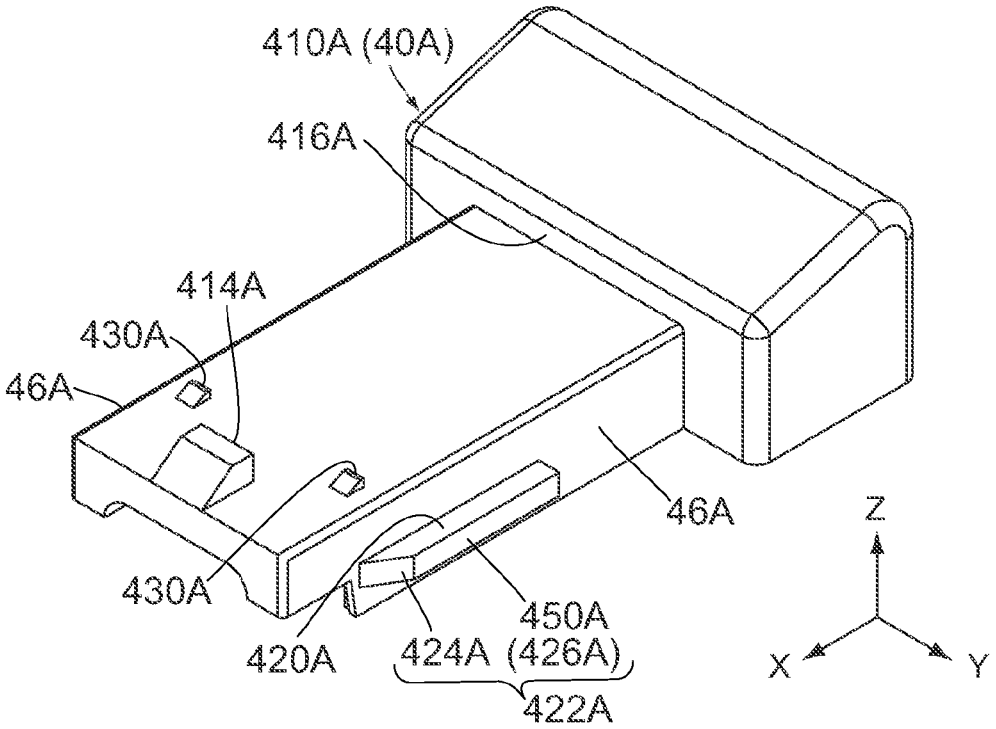
FIG. 36 is a perspective view showing an upper hood of the primary member of the connector of FIG. 34.
Figure 37:
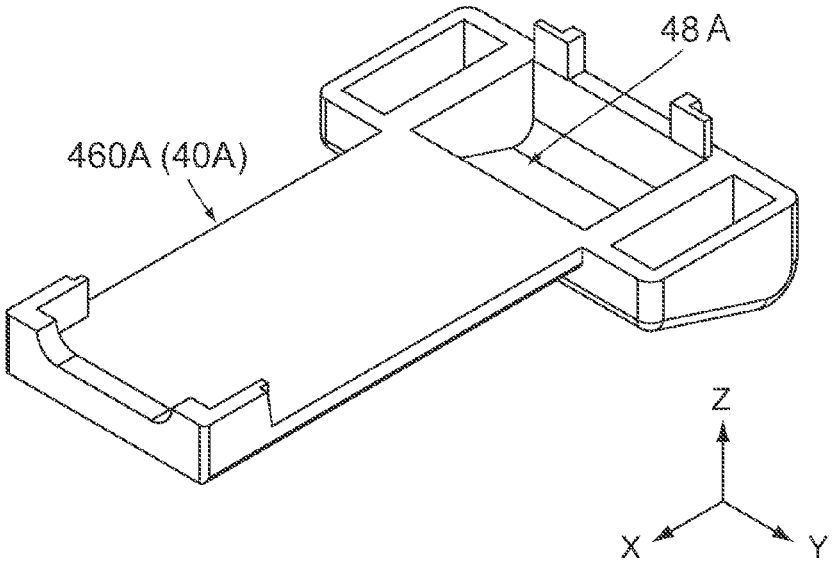
FIG. 37 is a perspective view showing a lower hood of the primary member of the connector of FIG. 34.
Figure 38:
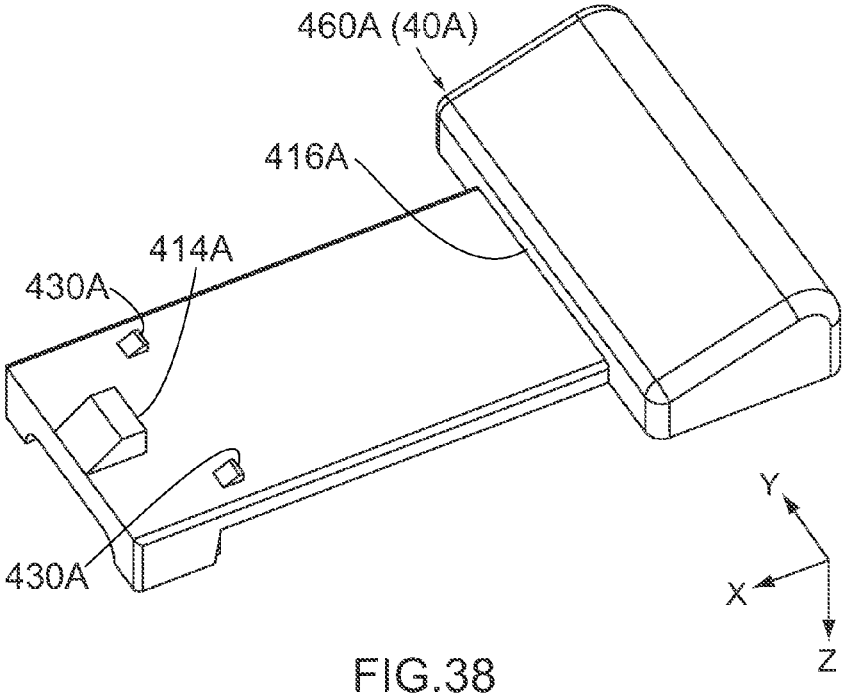
FIG. 38 is another perspective view showing the lower hood of FIG. 37.

Referring to FIGS. 36 to 38, the hood 40A comprises two forward-operation restriction portions 414A, one rearward-operation restriction portion 416A, two projecting portions 420A, two maintenance portions 422A and four forward-movement restriction portions 430A.

One of the forward-operation restriction portions 414A is a rear end surface of a projection provided to the upper hood 410A, and a remaining one of the forward-operation restriction portions 414A is a rear end surface of a projection provided to the lower hood 460A. The rearward-operation restriction portion 416A is a surface of the hood 40A which is positioned at a rear part of the hood 40A. Two of the forward-movement restriction portions 430A are rear end surfaces of two projections provided to the upper hood 410A, and remaining two of the forward-movement restriction portions 430A are rear end surfaces of two projections provided to the lower hood 460A.

The projecting portions 420A are provided to the two side portions 46A, respectively. Each of the projecting portions 420A projects outward in the Y-direction from the corresponding side portion 46A and extends long in the X-direction. The projecting portions 420A are provided with the maintenance portions 422A, respectively. In detail, each of the maintenance portions 422A is an outside surface of the corresponding projecting portion 420A in the Y-direction. Each of the maintenance portions 422A has a front end portion 424A and a rear portion 426A, wherein the front end portion 424A is a sloped surface oblique to the X-direction, and the rear portion 426A extends in parallel to the XZ-plane.

Figure 39:
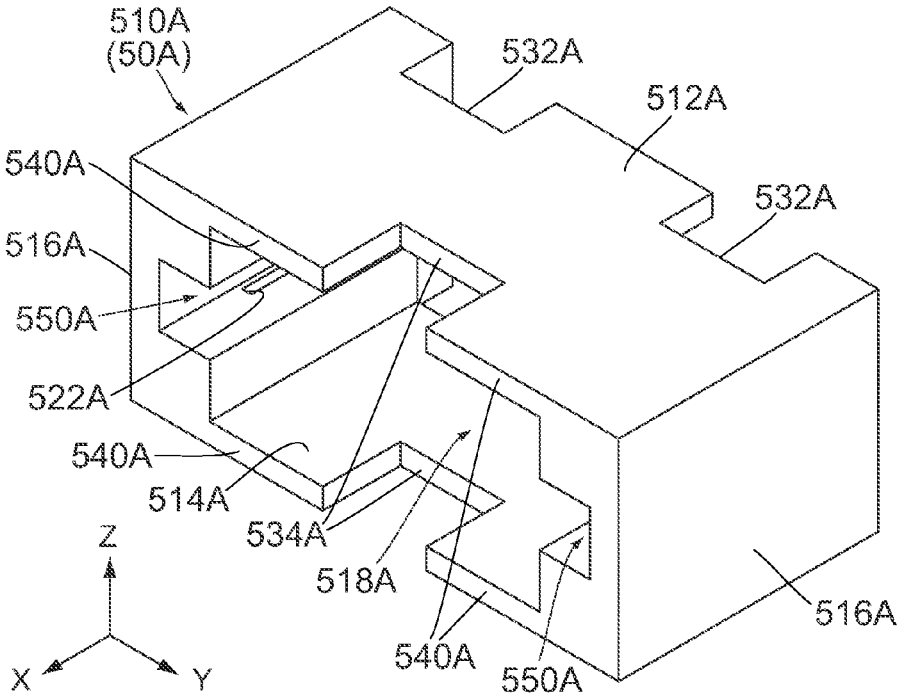
FIG. 39 is a perspective view showing a body member of a movable member of the connector of FIG. 34.
Figure 40:
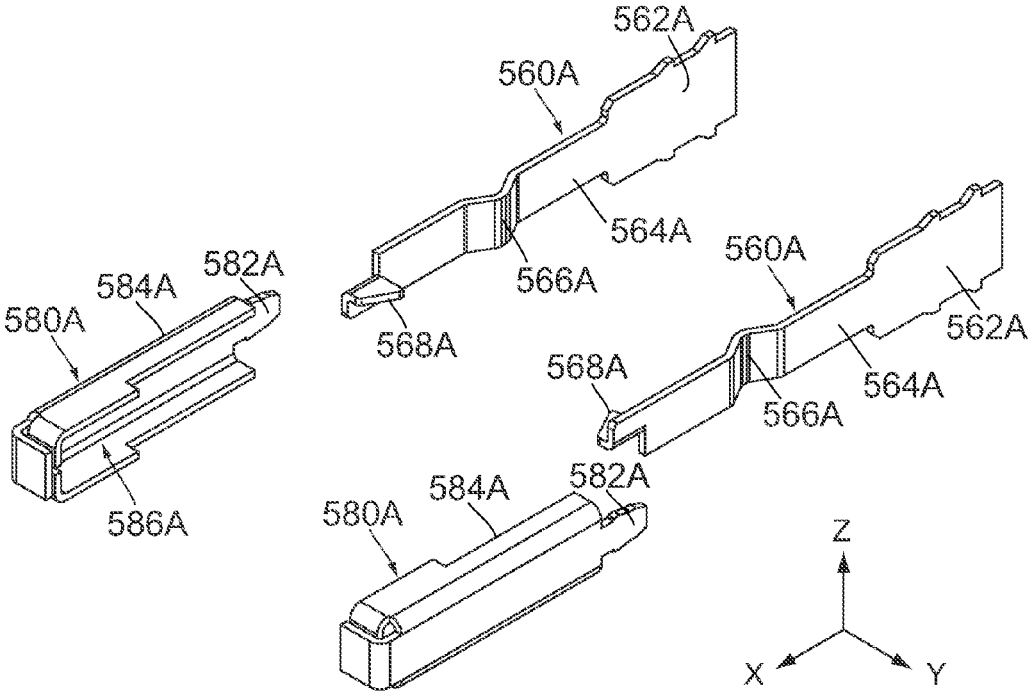
FIG. 40 is a perspective view showing lock members and cover members of the movable member of the connector of FIG. 34.

Referring to FIGS. 39 and 40, the movable member 50A comprises a body member 510A made of insulator, two lock members 560A each made of metal and two cover members 580A each made of metal. The movable member 50A has a shape which is 180 degrees rotational symmetric or 2-fold rotational symmetric with respect to an axis in parallel to the X-direction.

Referring to FIG. 39, the body member 510A has an upper portion 512A, a lower portion 514A, two side portions 516A and a hollow portion 518A. The hollow portion 518A is a space enclosed by the upper portion 512A, the lower portion 514A and the side portions 516A. The hollow portion 518A opens forward and rearward. Each of the side portions 516A is formed with a guide channel 550A. The guide channels 550A are positioned at opposite sides of the hollow portion 518A in the Y-direction, respectively. Each of the guide channels 550A opens forward and rearward. Each of the guide channels 550A is vertically covered by an inner wall which is formed with a press-fit groove 522A. Each of the press-fit grooves 522A opens rearward.

The movable member 50A comprises four forward-force receiving portions 532A, two rearward-force receiving portions 534A and four forward-movement restricted portions 540A. Two of the forward-force receiving portions 532A are front end surfaces of two recesses each of which is recessed forward from a rear end surface of the upper portion 512A, and remaining two of the forward-force receiving portions 532A are front end surfaces of two recesses each of which is recessed forward from a rear end surface of the lower portion 514A. One of the rearward-force receiving portions 534A is a rear end surface of a recess which is recessed rearward from a front end surface of the upper portion 512A, and a remaining one of the rearward-force receiving portions 534A is a rear end surface of another recess which is recessed rearward from a front end surface of the lower portion 514A. Two of the forward-movement restricted portions 540A are parts of the front end surface of the upper portion 512A and are positioned at opposite sides across the rearward-force receiving portion 534A of the upper portion 512A in the Y-direction, respectively. Remaining two of the forward-movement restricted portions 540A are parts of the front end surface of the lower portion 514A and are positioned at opposite sides across the rearward-force receiving portion 534A of the lower portion 514A in the Y-direction, respectively.

Referring to FIG. 40, each of the lock members 560A is a single plate with bends. The two lock members 560A have shapes same as each other. The lock members 560A are arranged in 180 degrees rotational symmetry or 2-fold rotational symmetry with respect to an axis in parallel to the X-direction.

Each of the lock members 560A has a press-fit portion 562A, a support portion 564A, an operated portion 566A and a lock portion 568A. The press-fit portion 562A is positioned at a rear end of the lock member 560A. The support portion 564A extends forward from the press-fit portion 562A to be long in the X-direction and is resiliently deformable in the XY-plane. The operated portion 566A is a curved portion of the lock member 560A. The lock portion 568A is a lock claw which extends in a direction intersecting with the X-direction. The lock portion 568A is provided to a front end of the support portion 564A.

Each of the cover members 580A is a single plate with bends. The two cover members 580A have shapes same as each other. The two cover members 580A are arranged mirror symmetrically to each other with respect to the XZ-plane. Each of the cover members 580A has a press-fit portion 582A and a cover 584A. In addition, each of the cover members 580A is formed with a receiving portion 586A. The press-fit portion 582A is positioned at a rear end of the cover member 580A. The cover 584A extends forward from the press-fit portion 582A. The receiving portion 586A is a space enclosed by the cover 584A. The receiving portion 586A opens rearward and inward in the Y-direction.

Referring to FIGS. 39 and 40, the lock members 560A are attached to the body member 510A from behind and held by the press-fit grooves 522A, respectively. The cover members 580A are attached to the body member 510A from the front and held by the side portions 516A of the body member 510A, respectively. The support portions 564A and the covers 584A project forward from a front end of the body member 510A.

Figure 53:
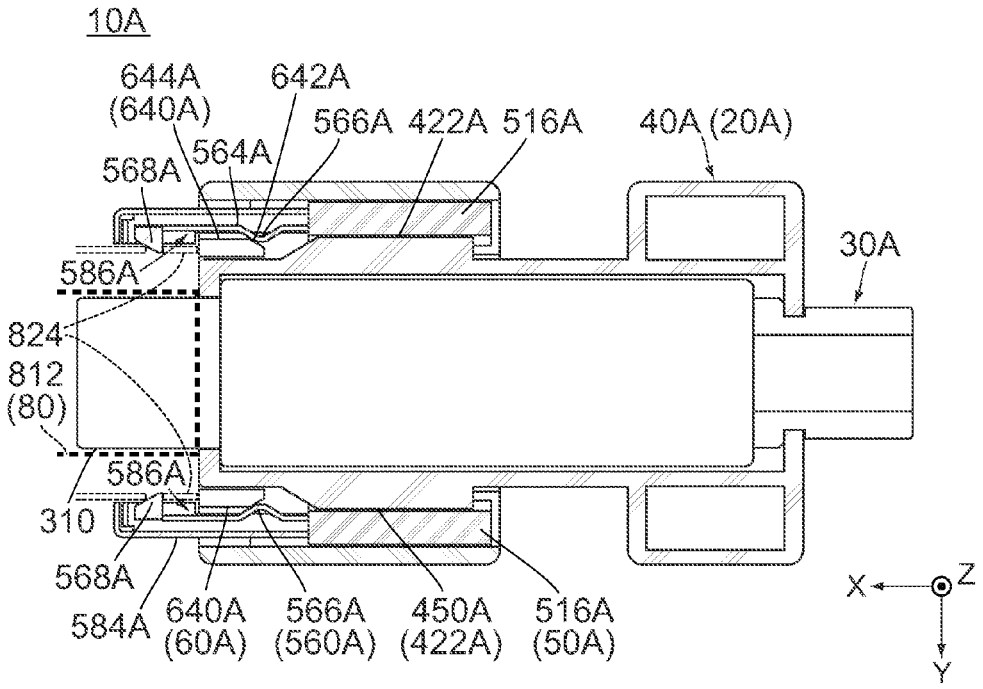
FIG. 53 is a cross-sectional view showing the connector of FIG. 48, wherein the connector body is illustrated in outline, and an outline of the mating fit portion and outlines of the mating lock portions of the mating connector are illustrated by dashed line.

Referring to FIG. 53, the most part of each of the support portions 564A is received in the corresponding receiving portion 586A and is resiliently deformable in the receiving portion 586A. The lock portion 568A is supported by the support portion 564A and is movable in the Y-direction. Under an initial spring state of the support portion 564A where the support portion 564A is not resiliently deformed, a part of the operated portion 566A projects inward in the Y-direction from the receiving portion 586A. Moreover, under the initial spring state, an end portion of the lock portion 568A projects inward in the Y-direction from the receiving portion 586A.

Figure 41:
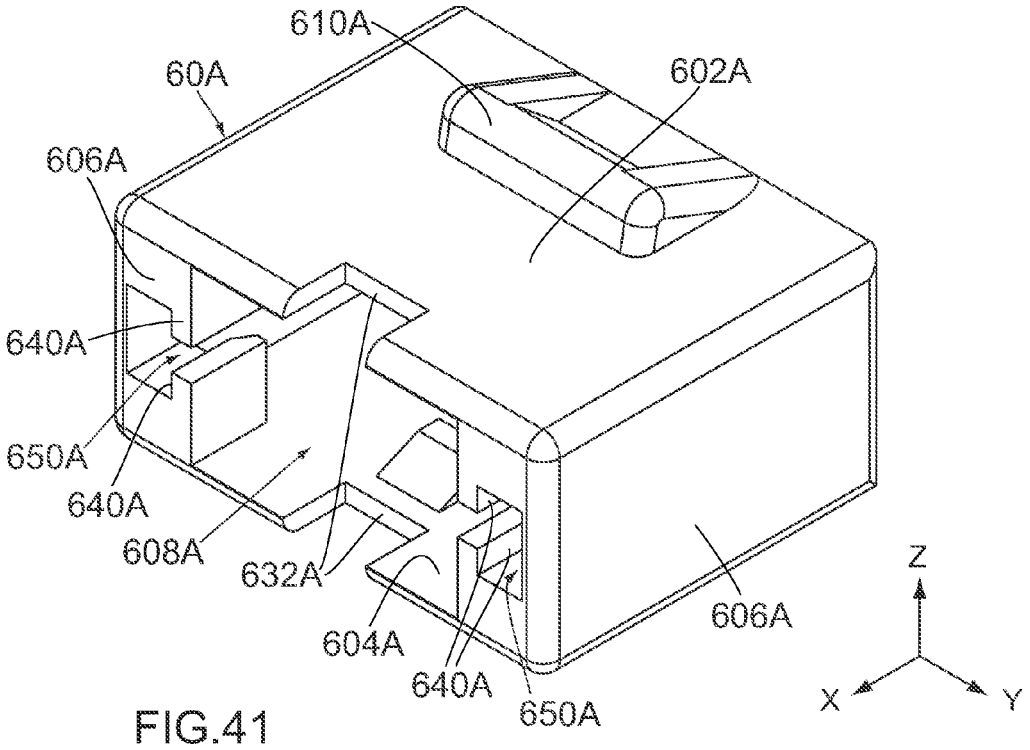
FIG. 41 is a perspective view showing an operating member of the connector of FIG. 34.
Figure 51:
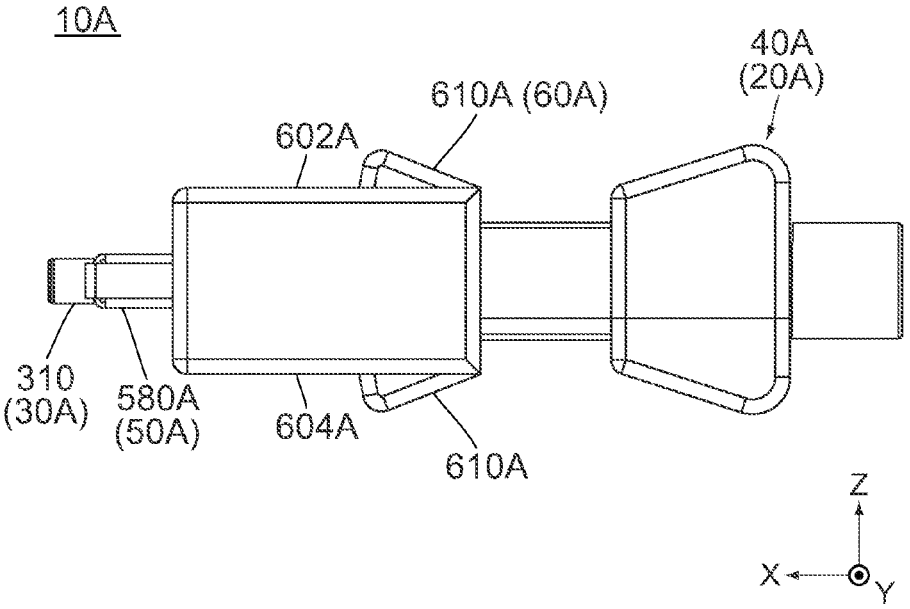
FIG. 51 is a side view showing the connector of FIG. 48.
Figure 52:
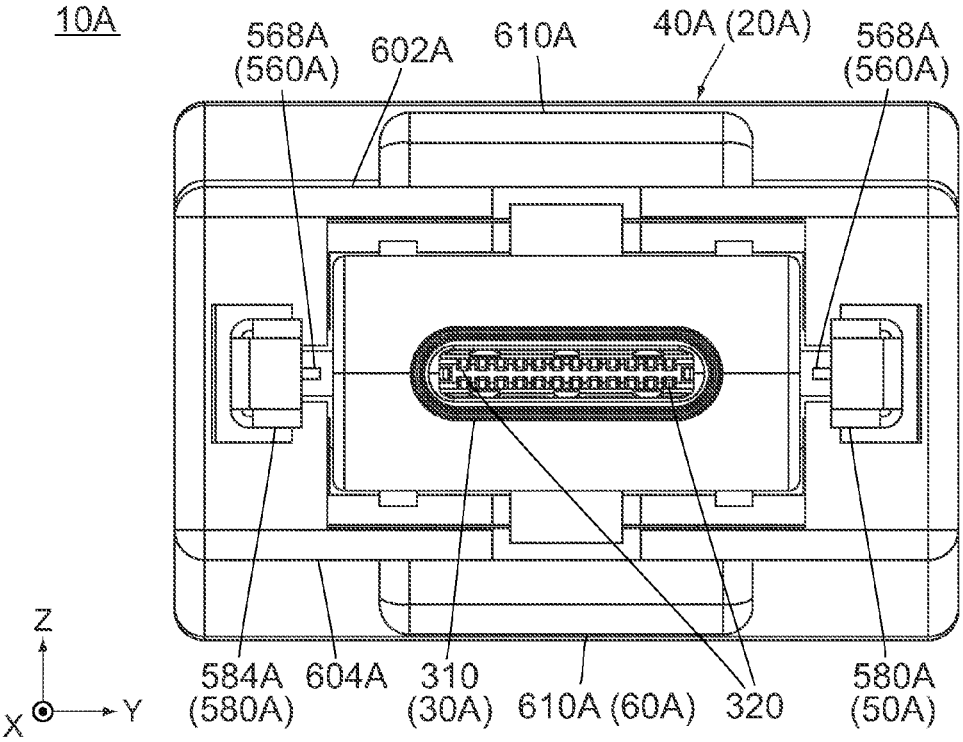
FIG. 52 is a front view showing the connector of FIG. 48.

Referring to FIG. 41, the operating member 60A has a shape which is 180 degrees rotational symmetric or 2-fold rotational symmetric with respect to an axis in parallel to the X-direction. In detail, the operating member 60A has an upper portion 602A, a lower portion 604A, two side portions 606A and a hollow portion 608A. The hollow portion 608A is a space enclosed by the upper portion 602A, the lower portion 604A and the side portions 606A. The hollow portion 608A opens forward and rearward. Referring to FIGS. 41, 51 and 52, each of the upper portion 602A and the lower portion 604A is provided with an operating portion 610A.

Figure 42:
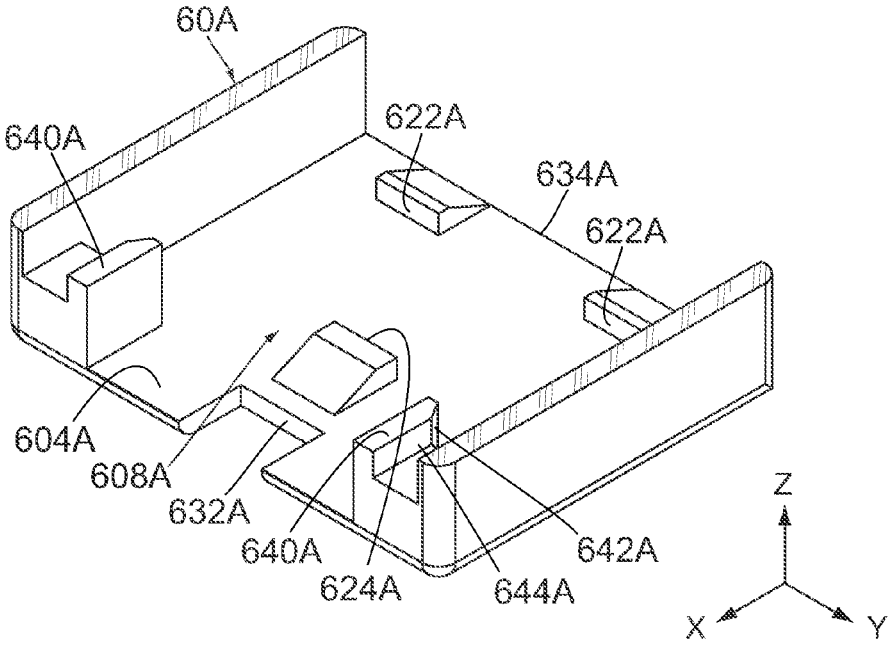
FIG. 42 is a partially cut-away, perspective view showing the operating member of FIG. 41.

Referring to FIGS. 41 and 42, the operating member 60A comprises four forward-force applying portions 622A, two rearward-force applying portions 624A, two forward-operation restricted portions 632A, one rearward-operation restricted portion 634A, four operating projections 640A and two guide channels 650A. The forward-force applying portions 622A, the rearward-force applying portions 624A, the operating projections 640A and the guide channels 650A are provided in the hollow portion 608A.

Two of the forward-force applying portions 622A are front end surfaces of two projections which are positioned in the vicinity of a rear end of the upper portion 602A in the hollow portion 608A and project downward, while remaining two of the forward-force applying portions 622A are front end surfaces of two projections which are positioned in the vicinity of a rear end of the lower portion 604A in the hollow portion 608A and project upward. One of the rearward-force applying portions 624A is a rear end surface of a projection which is positioned in the vicinity of a front end of the upper portion 602A in the hollow portion 608A and projects downward, while a remaining one of the rearward-force applying portions 624A is a rear end surface of another projection which is positioned in the vicinity of a front end of the lower portion 604A in the hollow portion 608A and projects upward.

Two of the operating projections 640A correspond to the positive Y-side portion 606A of the operating member 60A, and remaining two of the operating projections 640A correspond to the negative Y-side portion 606A of the operating member 60A. In detail, the two positive Y-side operating projections 640A are apart inward in the Y-direction from the positive Y-side portion 606A of the operating member 60A and face the positive Y-side portion 606A of the operating member 60A in the Y-direction. Similarly, the two negative Y-side operating projections 640A face the negative Y-side portion 606A of the operating member 60A in the Y-direction. In the two operating projections 640A corresponding to each of the side portions 606A, one of the operating projections 640A extends rearward while projecting downward, and a remaining one of the operating projections 640A extends rearward while projecting upward.

Figure 49:
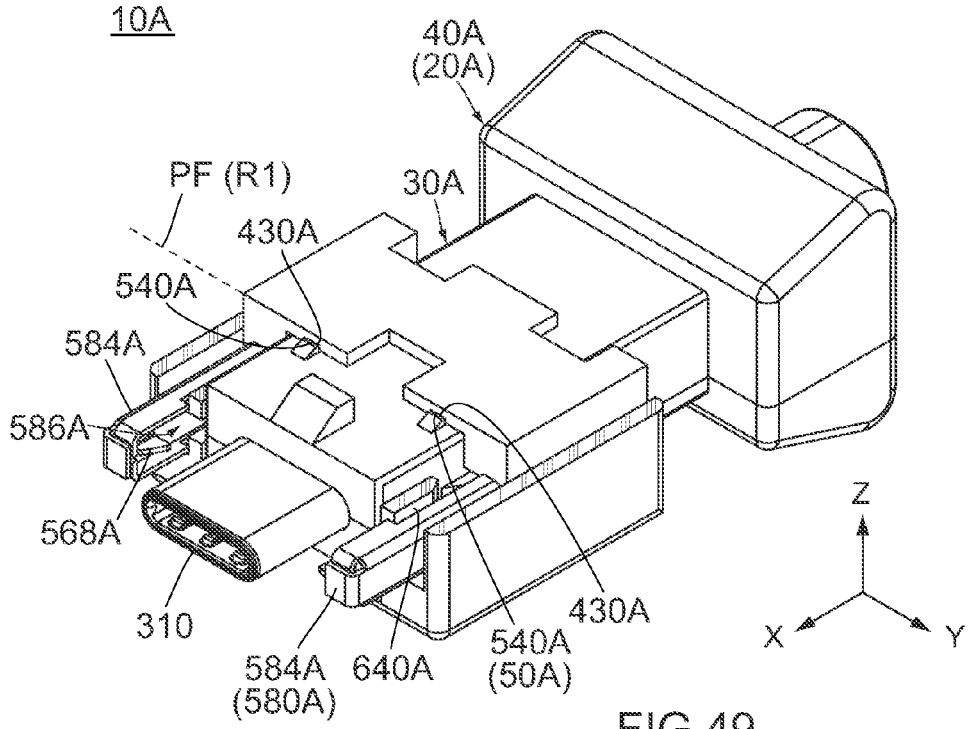
FIG. 49 is a partially cut-away, perspective view showing the connector of FIG. 48.

Referring to FIG. 49, in the XY-plane, each of the operating projections 640A projects outward in the Y-direction. Referring to FIGS. 41 and 42, each of the operating projections 640A has an outside surface in the Y-direction which is formed of a sloping surface 642A and an outside surface 644A. The sloping surface 642A is a surface oblique to the X-direction. The sloping surface 642A is provided to a rear part of the operating projection 640A. The outside surface 644A is a surface in parallel to the XZ-plane. The outside surface 644A is provided to a front part of the operating projection 640A. One of the guide channels 650A is a channel which is formed between the two positive Y-side operating projections 640A and the positive Y-side portion 606A of the operating member 60A, and a remaining one of the guide channels 650A is another channel which is formed between the two negative Y-side operating projections 640A and the negative Y-side portion 606A of the operating member 60A. Each of the guide channels 650A is positioned outward of the hollow portion 608A in the Y-direction. Each of the guide channels 650A opens forward and rearward.

One of the forward-operation restricted portions 632A is a rear end surface of a recess which is recessed rearward from a front end surface of the upper portion 602A, and a remaining one of the forward-operation restricted portions 632A is a rear end surface of another recess which is recessed rearward from a front end surface of the lower portion 604A. The rearward-operation restricted portion 634A is a rear end surface of the operating member 60A. The rearward-operation restricted portion 634A includes a rear end surface of the upper portion 602A, a rear end surface of the lower portion 604A and rear end surfaces of the side portions 606A.

Figure 45:
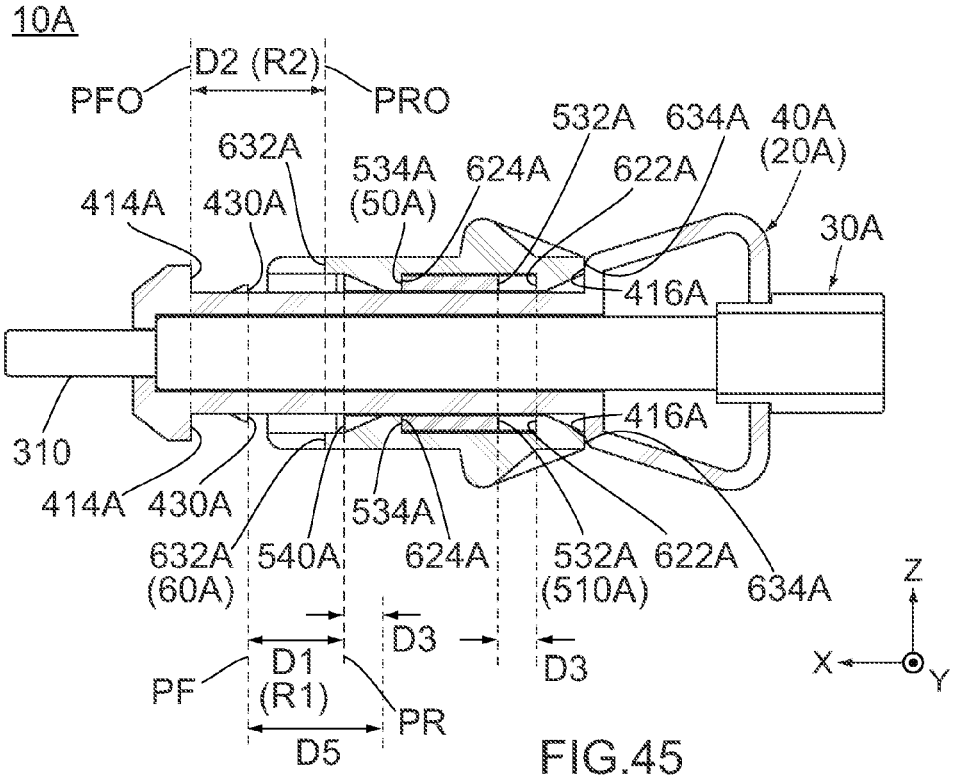
FIG. 45 is another cross-sectional view showing the connector of FIG. 33, wherein the connector body is illustrated in outline.

Referring to FIGS. 33, 34 and 45, the connector 10A is an assembly formed of the aforementioned members, namely, the primary member 20A, the movable member 50A and the operating member 60A. When the connector 10A is formed, the movable member 50A is inserted into the hollow portion 608A of the operating member 60A from behind so that the forward-force receiving portions 532A are arranged forward of the forward-force applying portions 622A, respectively. As a result of this insertion, the two cover members 580A pass the two guide channels 650A, respectively, to project forward from a front end of the operating member 60A. Subsequently, the primary member 20A, which accommodates the connector body 30A, is inserted into the hollow portion 518A of the movable member 50A from behind so that the forward-operation restriction portions 414A are arranged forward of the forward-operation restricted portions 632A, respectively, and that the forward-movement restriction portions 430A are arranged forward of the forward-movement restricted portions 540A, respectively. As a result of this insertion, the two projecting portions 420A are received in the guide channels 550A of the movable member 50A, respectively, and a front part of the primary member 20A including the fit portion 310 projects forward from a front end of the operating member 60A. At that time, the fit portion 310 of the connector body 30A is positioned between the two lock portions 568A in the Y-direction.

When the connector 10A is formed as described above, the connector 10A is under an initial state shown in FIGS. 33 and 43 to 46. Referring to FIGS. 43 to 46, when the connector 10A is under the initial state, the operating member 60A partially encloses the movable member 50A and the primary member 20A in the YZ-plane. In detail, the whole of the body member 510A of the movable member 50A and a middle part of the primary member 20A in the X-direction are accommodated within the hollow portion 608A of the operating member 60A. Also in the present embodiment, the operating member 60A can be operated to be moved by a force applied to the operating portions 610A along the X-direction. Referring to FIGS. 51 and 52, an operator can vertically hold the two operating portions 610A to operate the operating member 60A by one hand.

Figure 43:
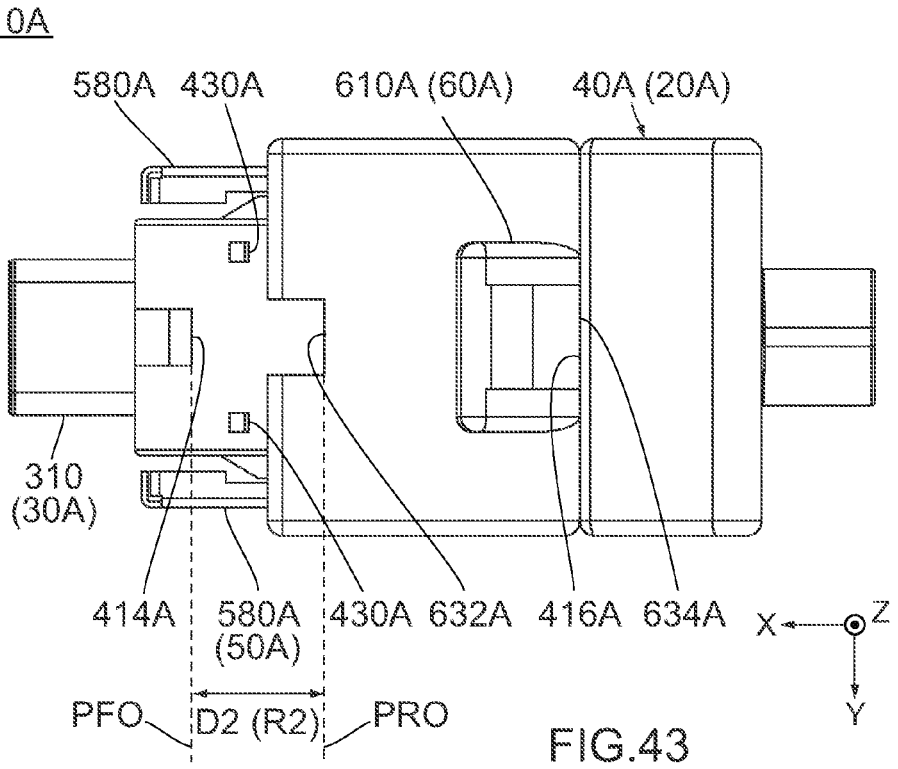
FIG. 43 is a top view showing the connector of FIG. 33.
Figure 44:
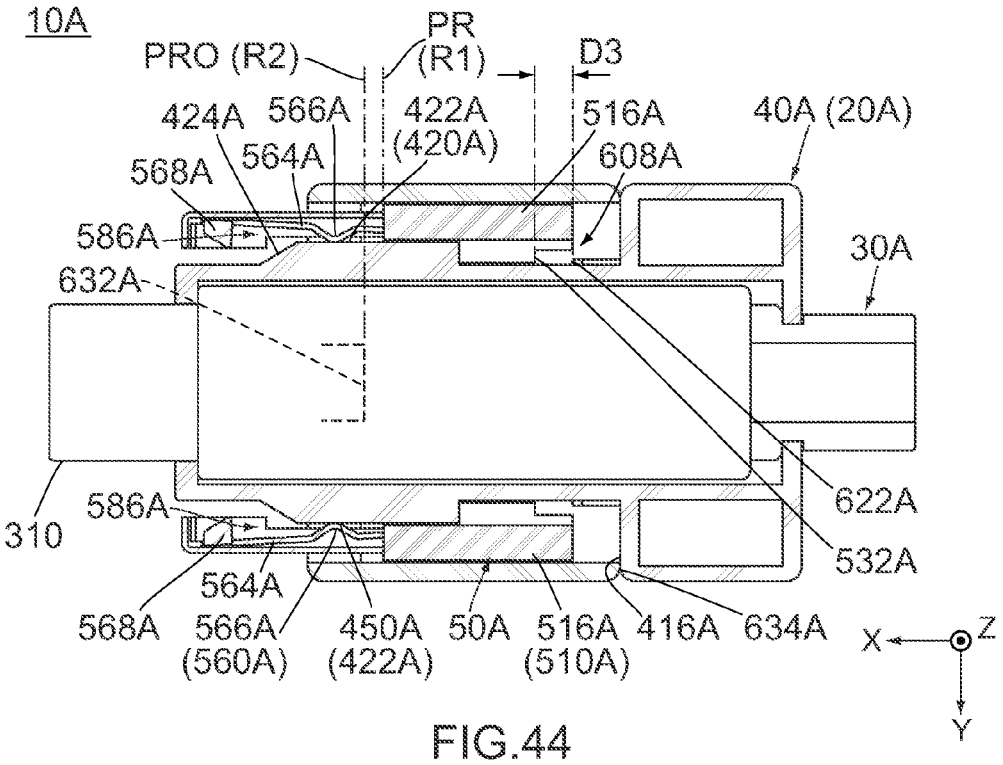
FIG. 44 is a cross-sectional view showing the connector of FIG. 33, wherein the connector body is illustrated in outline, and a position of a forward-operation restricted portion of the operating member is illustrated by dashed line.

Referring to FIGS. 43 to 45, under the initial state, the rearward-operation restricted portion 634A of the operating member 60A is positioned immediately in front of the rearward-operation restriction portion 416A of the primary member 20A. Therefore, the operating member 60A, or the rearward-operation restricted portion 634A, cannot be moved rearward. In the meantime, the forward-operation restricted portions 632A of the operating member 60A are positioned rearward of and apart from the forward-operation restriction portions 414A of the primary member 20A by a movement distance D2. Therefore, the operating member 60A, or the forward-operation restricted portions 632A, can be moved forward by the movement distance D2 similar to the first embodiment. Moreover, the forward-operation restricted portions 632A can be moved rearward by the movement distance D2 after moved forward by the movement distance D2.

As can be seen from the above explanation, the forward-operation restricted portions 632A are movable forward and rearward relative to the primary member 20A by the movement distance D2 between a front position PFO and a rear position PRO of a predetermined operation range R2 in the X-direction. The front position PFO is a position of the forward-operation restriction portions 414A of the primary member 20A in the X-direction. The rear position PRO is a position of the forward-operation restricted portions 632A in the X-direction under a state where the rearward-operation restricted portion 634A is in contact with the rearward-operation restriction portion 416A of the primary member 20A.

Each of the forward-operation restricted portions 632A is a part of the operating member 60A. In the following explanation, the position of the operating member 60A means the position of the forward-operation restricted portions 632A similar to the explanation of the first embodiment. Thus, the operating member 60A is movable forward and rearward relative to the primary member 20A by the movement distance D2 between the front position PFO and the rear position PRO of the operation range R2 in the X-direction. The forward-operation restriction portions 414A restrict the forward movement of the operating member 60A to define the front position PFO of the operation range R2. In addition, the rearward-operation restriction portion 416A restricts the rearward movement of the operating member 60A to define the rear position PRO of the operation range R2.

Referring to FIG. 45, under the initial state, the forward-movement restricted portions 540A of the movable member 50A are positioned at a rear position PR which is rearward of and apart from the forward-movement restriction portions 430A of the primary member 20A by a movement distance D1. Therefore, the movable member 50A, or the forward-movement restricted portions 540A, can be moved forward by the movement distance D1. Moreover, the forward-movement restricted portions 540A can be moved rearward by the movement distance D1 after moved forward by the movement distance D1. According to the present embodiment, under the initial state, the forward-force receiving portions 532A, each of which defines a rear end of the movable member 50A, are positioned forward of and apart from the forward-force applying portions 622A of the operating member 60A by a predetermined distance D3, respectively. Therefore, the movable member 50A, or the forward-movement restricted portions 540A, can be moved rearward by the predetermined distance D3. Moreover, the forward-movement restricted portions 540A can be moved forward by the predetermined distance D3 after moved rearward by the predetermined distance D3.

As can be seen from the above explanation, the forward-movement restricted portions 540A are movable forward and rearward relative to the primary member 20A by the movement distance D1 between a front position PF and the rear position PR of a movement range R1 in the X-direction. The front position PF is a position of the forward-movement restriction portions 430A of the primary member 20A in the X-direction. The rear position PR is a position of the forward-movement restricted portions 540A in the X-direction under a state where the rearward-operation restricted portion 634A of the operating member 60A is in contact with the rearward-operation restriction portion 416A of the primary member 20A and where the forward-force receiving portions 532A are forward of and apart from the forward-force applying portions 622A by the predetermined distance D3, respectively.

Each of the forward-movement restricted portions 540A is a part of the movable member 50A. In the following explanation, the position of the movable member 50A means the position of the forward-movement restricted portions 540A similar to the explanation of the first embodiment. Thus, the movable member 50A is movable forward and rearward relative to the primary member 20A by the movement distance D1 between the front position PF and the rear position PR of the movement range R1 in the X-direction. The forward-movement restriction portions 430A restrict the forward movement of the movable member 50A to define the front position PF of the movement range R1 similar to the first embodiment. However, differently from the first embodiment, the primary member 20A comprises no portion which directly restricts the rearward movement of the movable member 50A. The rear position PR of the movement range R1 is defined by the forward-force applying portions 622A of the operating member 60A which is positioned at the rear position PRO.

Referring to FIGS. 1 and 33, when the connector 10A under the aforementioned initial state is entirely moved toward the mating connector 80, the connector 10A is under the mated state where the connector 10A and the mating connector 80 are mated with each other while maintaining its initial state. Hereafter, explanation will be made mainly about differences from the first embodiment in an operation for locking the mated state of the connector 10A with the mating connector 80 and in another operation for unlocking the mated state.

Figure 47:
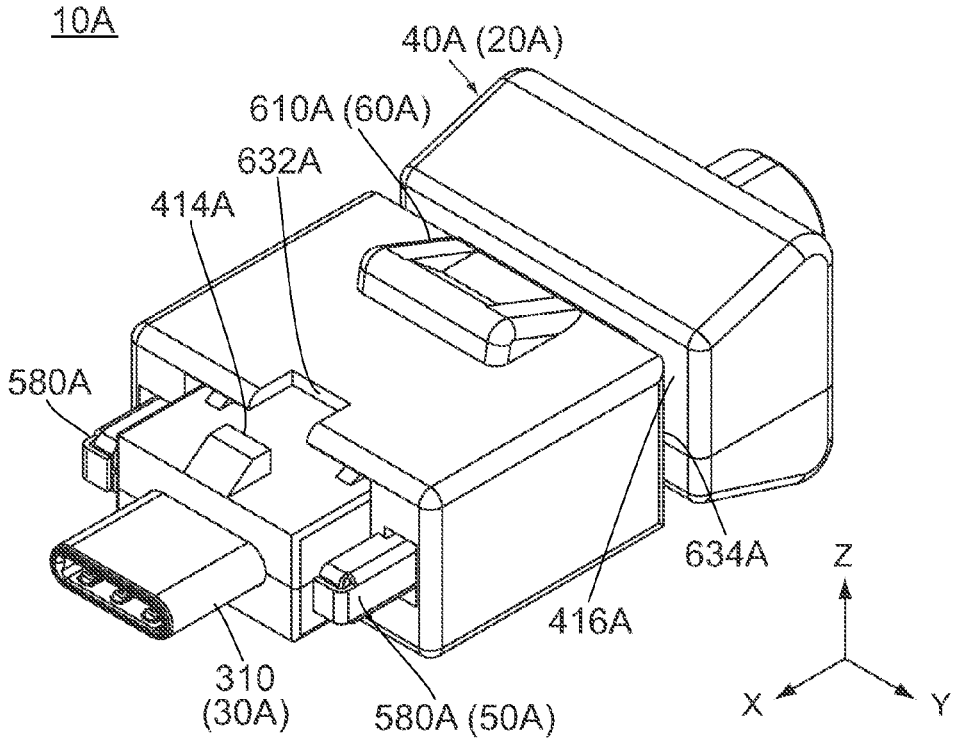
FIG. 47 is a perspective view showing the connector of FIG. 33, wherein the connector is under a transitional state.

Referring to FIG. 45, under the initial state, the forward-force applying portions 622A of the operating member 60A are positioned rearward of and apart from the forward-force receiving portions 532A of the movable member 50A by the predetermined distance D3, respectively, and face the forward-force receiving portions 532A in the X-direction, respectively, similar to the first embodiment. The predetermined distance D3 is shorter than the movement distance D2. Therefore, when the operating member 60A is moved forward from the rear position PRO of the operation range R2 by the predetermined distance D3, the forward-force applying portions 622A are brought into contact with the forward-force receiving portions 532A, respectively. When the forward-force applying portions 622A are brought into contact with the forward-force receiving portions 532A, the connector 10A is under a transitional state shown in FIG. 47.

Figure 46:
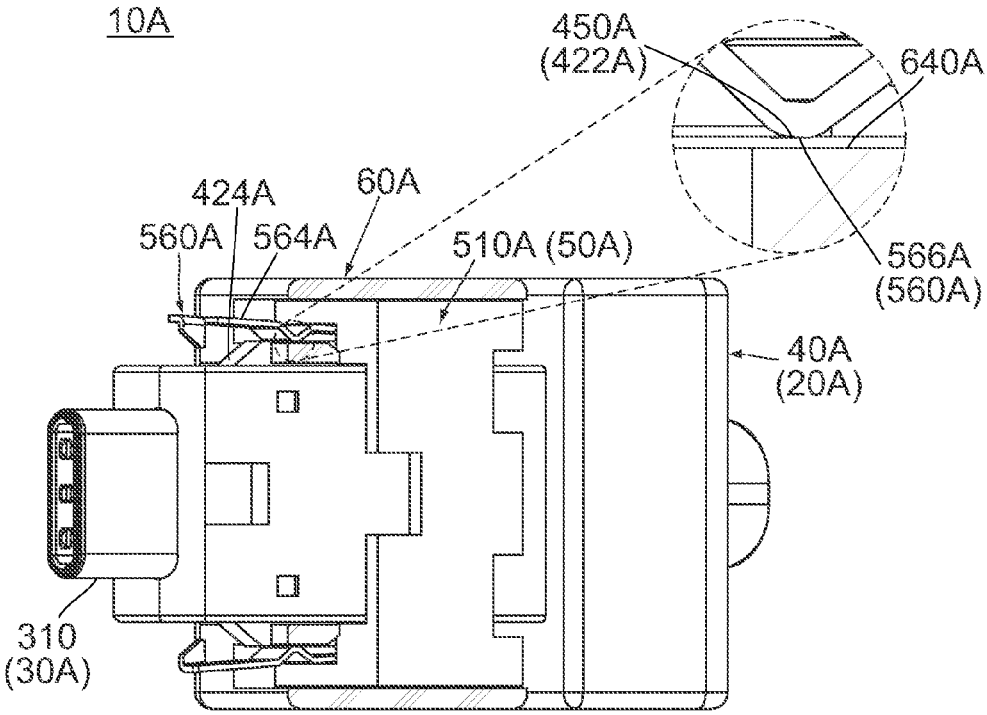
FIG. 46 is a partially cut-away view showing the connector of FIG. 33 from the upper front thereof, wherein the cover members are not illustrated, and an operated portion of the lock member and therearound (part enclosed by dashed line) is enlarged to be illustrated.

Referring to FIGS. 44 and 46, each of the maintenance portions 422A of the primary member 20A, except the front end portion 424A thereof, are positioned outward in the Y-direction beyond the operating projections 640A of the operating member 60A. Moreover, under the initial state, rear ends of the maintenance portions 422A are positioned rearward of the operated portions 566A of the movable member 50A, respectively, by a distance much longer than the predetermined distance D3. As a result, the support portions 564A of the movable member 50A are resiliently deformed outward in the Y-direction. In detail, the operated portions 566A are positioned outward of the maintenance portions 422A in the Y-direction, respectively, and positioned outward of and apart from the operating projections 640A in the Y-direction, respectively. Therefore, while the operating member 60A is moved forward from the rear position PRO by the predetermined distance D3, the operating member 60A applies no direct force to the operated portions 566A.

As can be seen from the above explanation, each of the maintenance portions 422A according the present embodiment is provided with a temporarily holding portion 450A similar to that of the first embodiment. The temporarily holding portions 450A are positioned outward beyond the operating projections 640A of the operating member 60A in the Y-direction, respectively. When the operating member 60A is positioned at the rear position PRO of the operation range R2, the operated portions 566A are positioned outward of the temporarily holding portions 450A in the Y-direction, respectively. Referring to FIGS. 44 and 45, the temporarily holding of the temporarily holding portions 450A keeps the movable member 50A at the rear position PR while the operating member 60A is moved forward from the rear position PRO by the predetermined distance D3. Thus, the operating member 60A is movable forward relative to the movable member 50A by the predetermined distance D3 in the X-direction.

Figure 48:
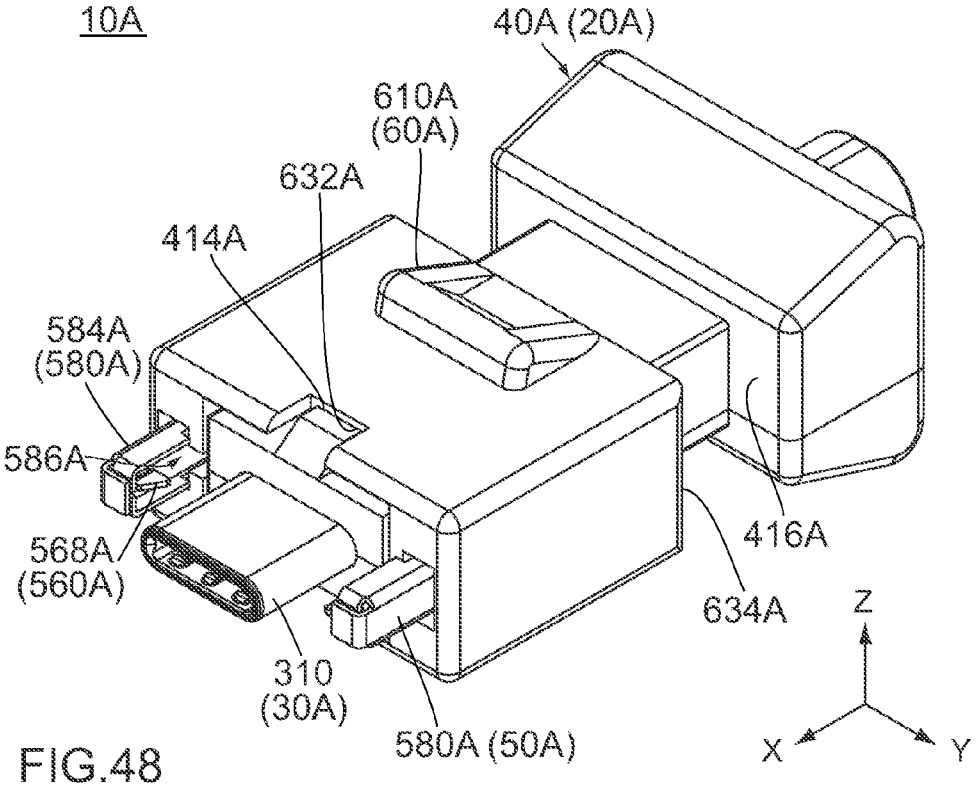
FIG. 48 is a perspective view showing the connector of FIG. 33, wherein the connector is under a lockable state.
Figure 50:
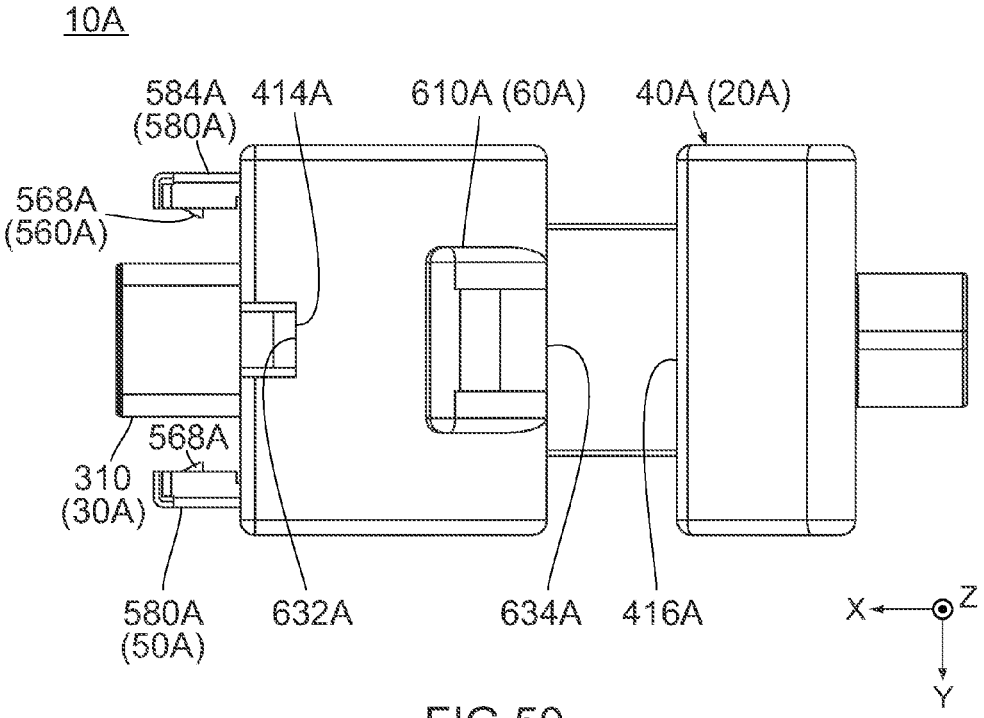
FIG. 50 is a top view showing the connector of FIG. 48.

Referring to FIG. 45, when the operating member 60A, which is positioned forward of the rear position PRO by the predetermined distance D3 (see FIG. 47), is further moved forward, the forward-force applying portions 622A apply a forward force, which forces the forward-force receiving portions 532A to be moved forward, to the forward-force receiving portions 532A. The forward force moves the movable member 50A forward together with the operating member 60A. Referring to FIGS. 48 and 50, when the operating member 60A continues to be moved forward, the forward-operation restricted portions 632A of the operating member 60A are brought into abutment with the forward-operation restriction portions 414A of the primary member 20A, respectively, so that the operating member 60A is stopped relative to the primary member 20A. When the forward-operation restricted portions 632A are brought into abutment with the forward-operation restriction portions 414A, the connector 10A is under a lockable state shown in FIGS. 48 to 54.

Figure 54:
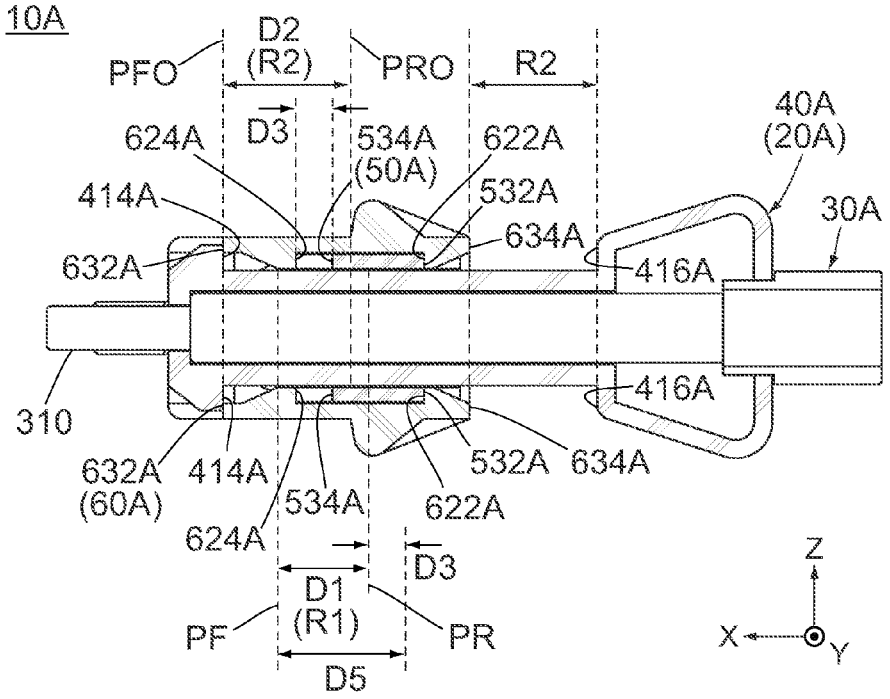
FIG. 54 is another cross-sectional view showing the connector of FIG. 48, wherein the connector body is illustrated in outline.

Referring to FIG. 54, under the lockable state, the operating member 60A is positioned at the front position PFO of the operation range R2. Referring to FIGS. 49 and 54, under the lockable state, the movable member 50A is positioned at the front position PF of the movement range R1, and the forward-movement restricted portions 540A of the movable member 50A are positioned immediately behind the forward-movement restriction portions 430A of the primary member 20A, respectively. Similar to the first embodiment, the movable member 50A cannot be moved forward beyond the front position PF.

Referring to FIG. 53, under the lockable state, the operated portions 566A of the movable member 50A are positioned forward of the maintenance portions 422A of the primary member 20A, respectively, and not in contact with the maintenance portions 422A, respectively. Moreover, the operated portions 566A are positioned rearward of the outside surfaces 644A of the operating projections 640A, respectively, and not in contact with the operating projections 640A, respectively. The thus-positioned operated portions 566A receive no force directed outward in the Y-direction, so that the resiliently deformed support portions 564A return to their initial spring state. As a result, as shown in FIGS. 48, 49, 50, 52 and 53, the lock portions 568A project inward in the Y-direction from the receiving portions 586A of the covers 584A, respectively.

Referring to FIG. 53, the end portions of the lock portions 568A project from the covers 584A, respectively, and are positioned inside of the mating lock portions 824 of the mating connector 80 under the mated state, respectively. Referring to FIGS. 53 and 54, similar to the first embodiment, the mated state is locked by the lock portions 568A and the mating lock portions 824 when the operating member 60A is positioned at the front position PFO of the operation range R2 under the mated state and when the movable member 50A is positioned at the front position PF of the movement range R1 under the mated state. This lock prevents the connector 10A from being removed from the mating connector 80.

Referring to FIG. 54, under the lockable state, the rearward-force applying portions 624A of the operating member 60A are positioned forward of the rearward-force receiving portions 534A of the movable member 50A by the predetermined distance D3, respectively, and face the rearward-force receiving portions 534A in the X-direction. Therefore, when the operating member 60A is moved rearward from the front position PFO of the operation range R2 by the predetermined distance D3, the rearward-force applying portions 624A are brought into contact with the rearward-force receiving portions 534A, respectively. When the rearward-force applying portions 624A are brought into contact with the rearward-force receiving portions 534A, the connector 10A is under an unlock state shown in FIGS. 55 to 58.

Referring to FIG. 54, while the operating member 60A is moved rearward from the front position PFO of the operation range R2 by the predetermined distance D3, the movable member 50A is kept at the front position PF of the movement range R1. Thus, the operating member 60A is movable relative to the movable member 50A by the predetermined distance D3 in the X-direction.

Figure 57:
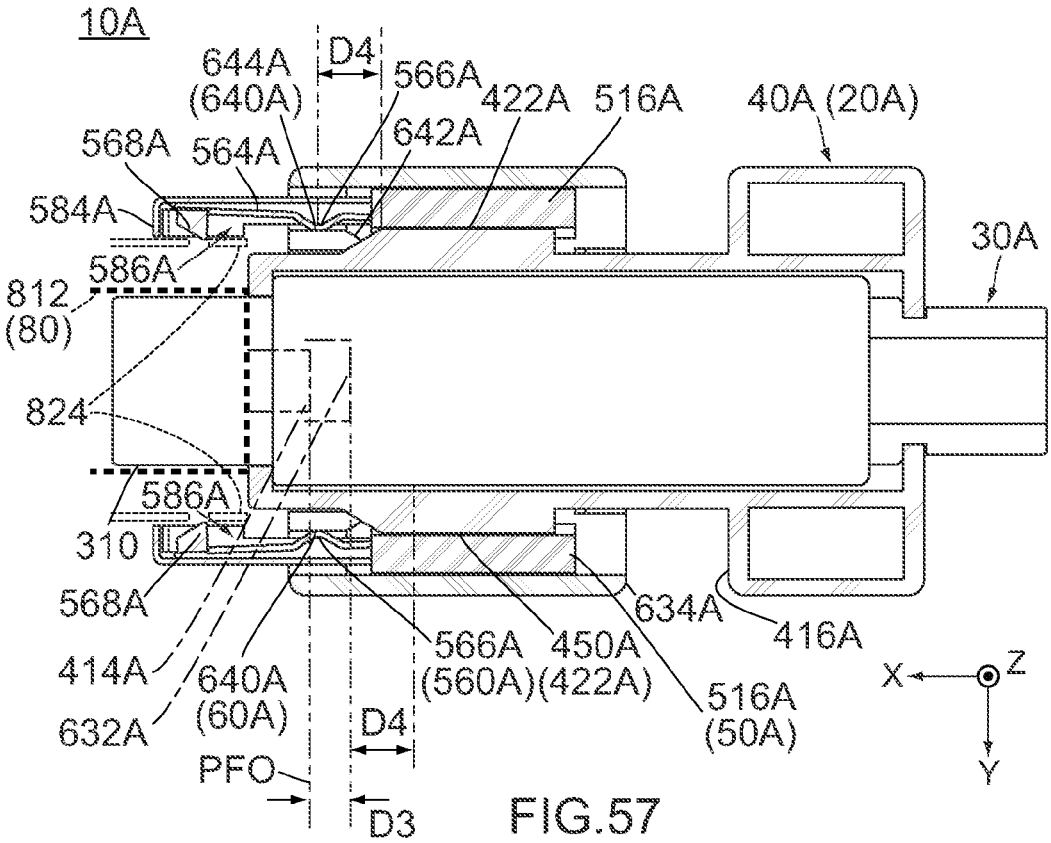
FIG. 57 is a cross-sectional view showing the connector of FIG. 55, wherein the connector body is illustrated in outline, a position of a forward-operation restriction portion of the primary member and a position of the forward-operation restricted portion of the operating member are illustrated by chain dotted line, and an outline of the mating fit portion and outlines of the mating lock portions of the mating connector are illustrated by dashed line.

Referring to FIGS. 53, 54 and 57, when the operating member 60A is moved rearward from the front position PFO by the predetermined distance D3, the sloping surfaces 642A of the operating projections 640A of the operating member 60A are brought into contact with the operated portions 566A of the movable member 50A, respectively, and push the operated portions 566A outward in the Y-direction, respectively. As a result, the support portions 564A are resiliently deformed outward in the Y-direction, and the lock portions 568A are moved outward in the Y-direction. When the operating member 60A is positioned rearward of and apart from the front position PFO by the predetermined distance D3, the operated portions 566A are positioned on the outside surfaces 644A of the operating projections 640A, respectively.

Figure 55:
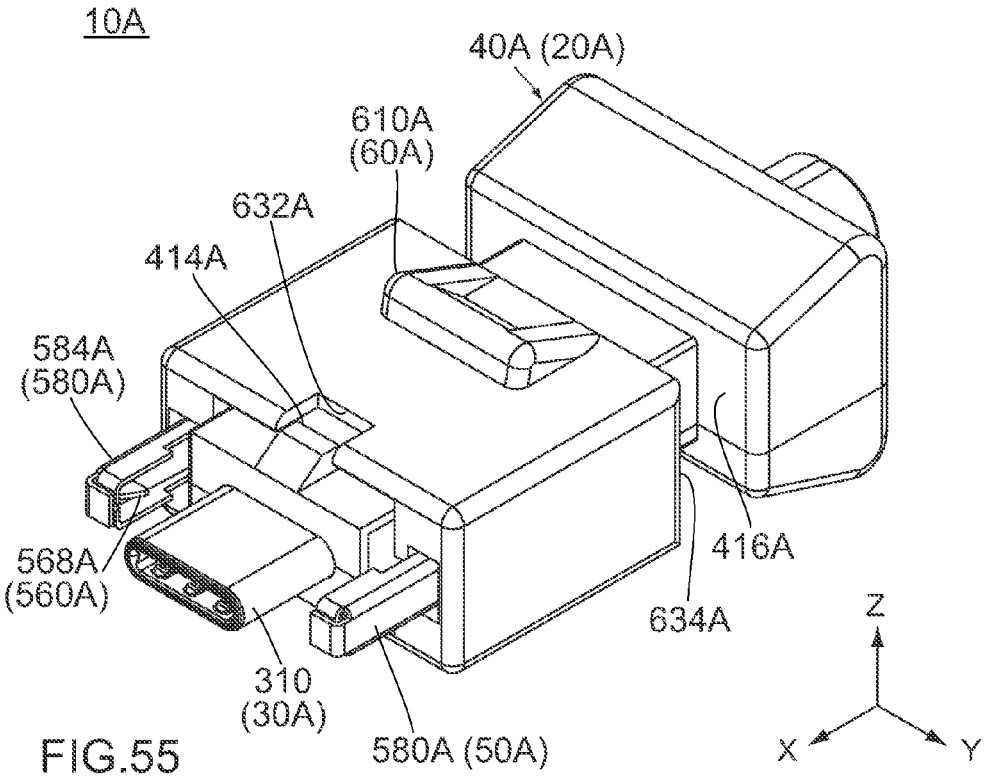
FIG. 55 is a perspective view showing the connector of FIG. 33, wherein the connector is under an unlock state.
Figure 56:
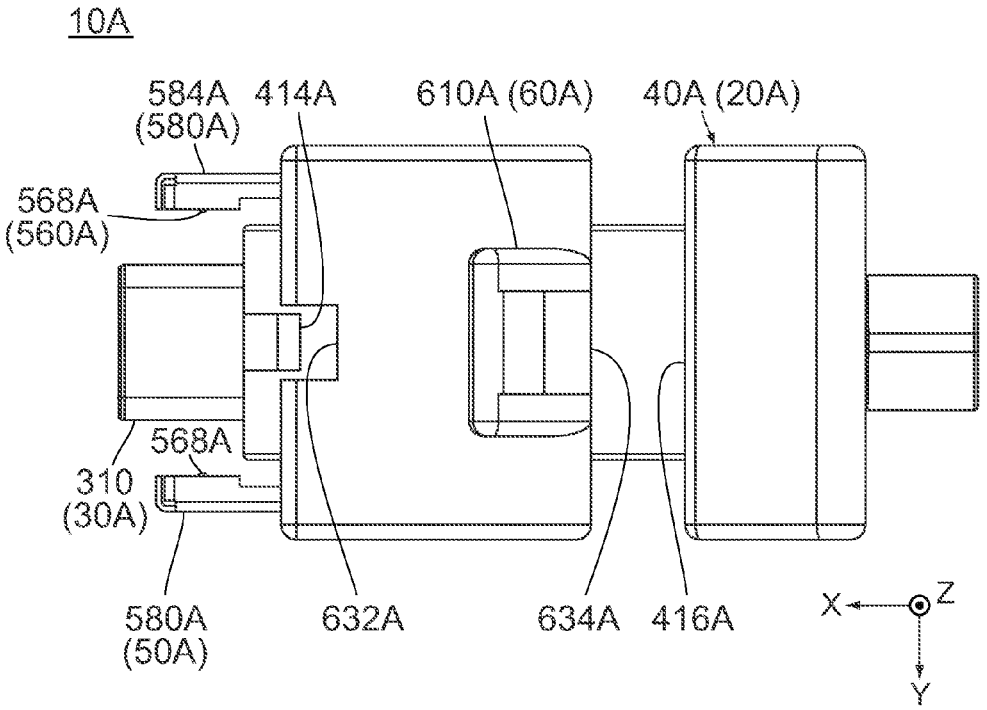
FIG. 56 is a top view showing the connector of FIG. 55.

In other words, the operated portions 566A are positioned outward of the operating projections 640A in the Y-direction, respectively, when the operating member 60A is positioned rearward of the front position PFO of the operation range R2 by the predetermined distance D3 and when the movable member 50A is positioned at the front position PF of the movement range R1. The lock portions 568A under the mated state are moved outward of the mating lock portion 824 in the Y-direction, respectively, to unlock the mated state. Referring to FIGS. 55, 56 and 57, when the mated state is unlocked, the lock portions 568A are received in the cover 584A, respectively.

Figure 58:
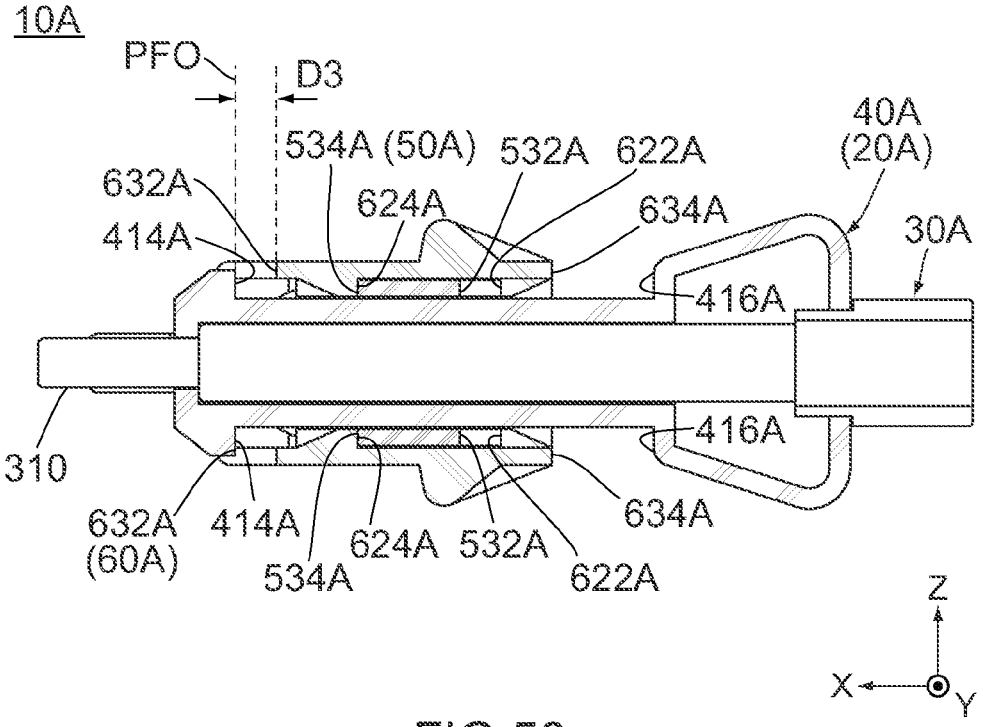
FIG. 58 is another cross-sectional view showing the connector of FIG. 55, wherein the connector body is illustrated in outline.

Referring to FIG. 58, when the operating member 60A, which is positioned rearward of the front position PFO by the predetermined distance D3, is further moved rearward, the rearward-force applying portions 624A apply a rearward force, which forces the rearward-force receiving portions 534A to be moved rearward, to the rearward-force applying portions 624A. The rearward force moves the movable member 50A rearward together with the operating member 60A.

The operating member 60A illustrated in FIG. 54 is positioned at the front position PFO of the operation range R2, while the operating member 60A illustrated in FIG. 57 is positioned rearward of the front position PFO of the operation range R2 by the predetermined distance D3. As can be seen from FIGS. 54 and 57, similar to the first embodiment, when the operating member 60A is positioned rearward of the front position PFO of the operation range R2 by a distance, which is more than the predetermined distance D3 by an additional predetermined distance D4, and when the movable member 50A is positioned rearward of the front position PF of the movement range R1 by the additional predetermined distance D4, the operated portions 566A are positioned outward of the maintenance portions 422A in the Y-direction, respectively, and the lock portions 568A are kept under a state where the lock portions 568A are moved outward in the Y-direction.

Referring to FIGS. 56 to 58 together with FIGS. 43 to 45, when the operating member 60A continues to be moved rearward, the rearward-operation restricted portion 634A of the operating member 60A is brought into contact with the rearward-operation restriction portion 416A of the primary member 20A, and the operating member 60A is positioned at the rear position PRO of the operation range R2. Referring to FIG. 45, according to the present embodiment, when the operating member 60A is positioned at the rear position PRO of the operation range R2, the movable member 50A is positioned at the rear position PR of the movement range R1. At that time, the connector 10A is under the initial state shown in FIGS. 33 and 43 to 46. When the operating member 60A is further moved rearward under the initial state of the connector 10A, the connector 10A is removed from the mating connector 80 (see FIG. 1).

Referring to FIG. 45, similar to the first embodiment, the movement distance D2 between the front position PFO and the rear position PRO of the operation range R2 of the operating member 60A according to the present embodiment is more than the movement distance D1 between the front position PF and the rear position PR of the movement range R1 of the movable member 50A by the predetermined distance D3. However, unlike the first embodiment, the movable member 50A can be moved rearward beyond the rear position PR. In other words, the movement distance D1 according to the present embodiment is shorter than a movable distance D5 of a movable range in which the movable member 50A is actually movable in the front-rear direction. In detail, the front position PF is equal to the position of the front end of the movable range having the movable distance D5, while the rear position PR is positioned forward of the rear end of the movable range having the movable distance D5 by the predetermined distance D3. However, referring to FIG. 44, since the maintenance portions 422A push the operated portions 566A outward in the Y-direction, respectively, undesirable movement of the movable member 50A can be prevented to some extent.

Referring to FIG. 33 together with FIGS. 31 and 32, the connector 10A according to the present embodiment can be mated with the mating connector 80 and the mating connector 80X similar to the connector 10 even in a situation where the mating connector 80 or the mating connector 80X is arranged within the case 880 which is formed with the attachment hole 882 or the attachment hole 884.

The present embodiment can be further variously modified in addition to the already explained modifications.

Figure 59:
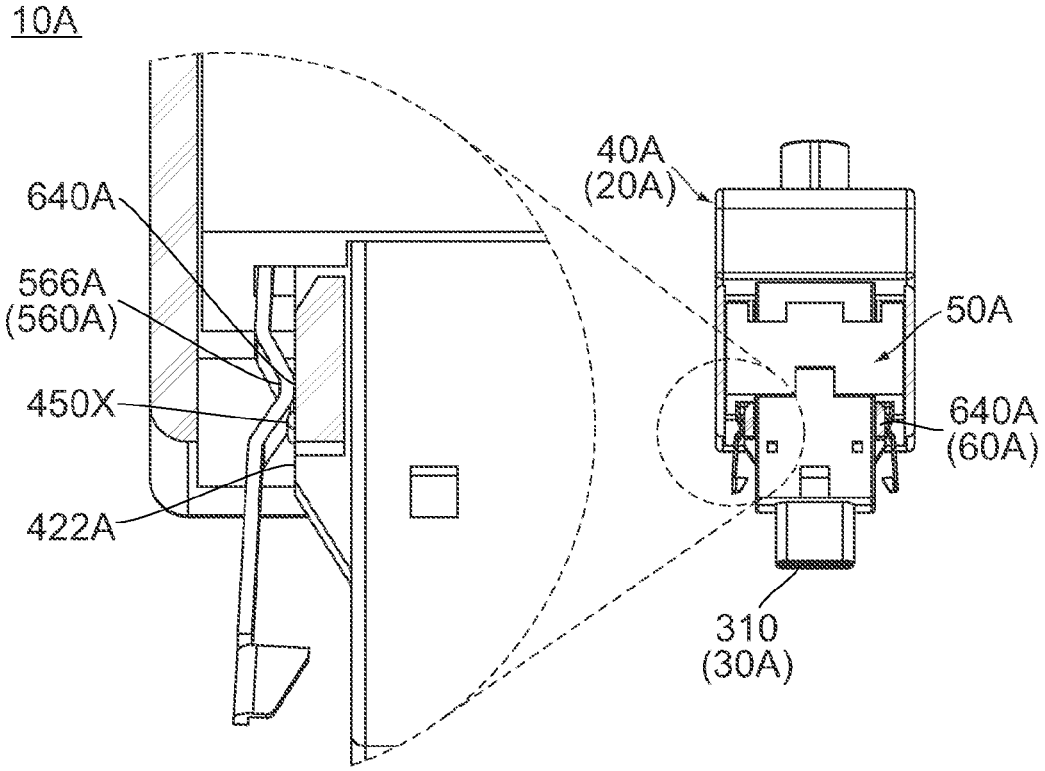
FIG. 59 is a view showing a modification of the connector of FIG. 46, wherein the operated portion and therearound (part enclosed by dashed line) is enlarged to be illustrated.
Figure 60:
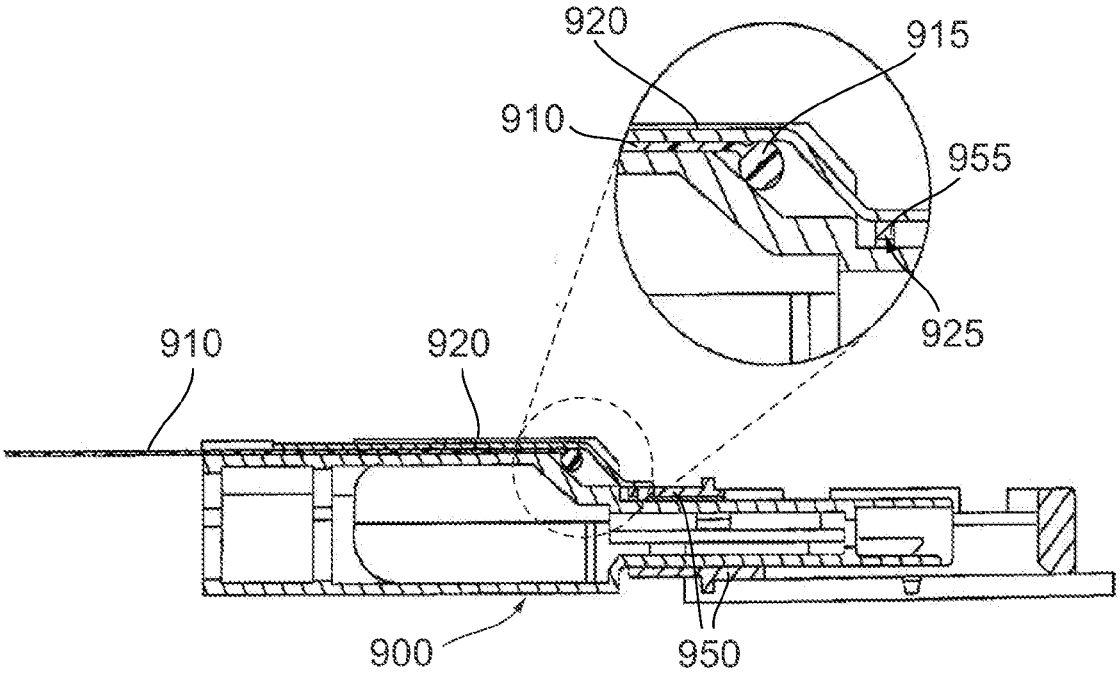
FIG.60 PRIOR ART
FIG. 60 is a cross-sectional view showing a connector of Patent Document 1.

For example, referring to FIGS. 46 and 59, the connector 10A may comprise the temporarily holding portion (rib) 450X similar to that of the first embodiment instead of the temporarily holding portion 450A which is a part of the maintenance portion 422A.

The present invention is further variously applicable in addition to the already explained embodiments and modifications.

For example, referring to FIGS. 24 and 53, each of the lock portion and the mating lock portion may have a structure different from that of the aforementioned embodiments, provided that the lock portion together with the mating lock portion can lock the mated state. More specifically, the lock portion may be a lock hole, and the mating lock portion may be a lock claw.

Moreover, the inclusion relation among the primary member, the movable member and the operating member is not limited to the aforementioned embodiments. For example, the movable member can be arranged outside of the primary member and the operating member. Moreover, the structure of each of the aforementioned various portions such as the restriction portions, the restricted portions, the force applying portions and the force receiving portions can be variously modified depending on the inclusion relation among the primary member, the movable member and the operating member. However, in any one of embodiments, the movement distance D2 of the operating member is equal to the distance which is more than the movement distance D1 by the predetermined distance D3.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A connector mateable with a mating connector when moved forward along a front-rear direction, the mating connector comprising a mating fit portion and a mating lock portion, the connector comprising a primary member, a movable member and an operating member, wherein:

the primary member comprises a connector body;

the connector body comprises a fit portion;

the fit portion is fit to the mating fit portion under a mated state where the connector and the mating connector are mated with each other;

the movable member is movable relative to the primary member between a front position and a rear position of a movement range in the front-rear direction;

the operating member is movable relative to the primary member between a front position and a rear position of an operation range in the front-rear direction and is movable relative to the movable member in the front-rear direction;

the movable member comprises a support portion and a lock portion;

the support portion is resiliently deformable;

the lock portion is supported by the support portion;

the mated state is locked by the lock portion and the mating lock portion when the operating member is positioned at the front position of the operation range and when the movable member is positioned at the front position of the movement range; and the mated state is unlocked when the operating member is positioned rearward of the front position of the operation range by a predetermined distance and when the movable member is positioned at the front position of the movement range.

2. The connector as recited in claim 1, wherein the movable member is positioned at the rear position of the movement range when the operating member is positioned at the rear position of the operation range.

3. The connector as recited in claim 1, wherein:

the primary member comprises a forward-operation restriction portion and a rearward-operation restriction portion;

the forward-operation restriction portion restricts a forward movement of the operating member to define the front position of the operation range; and the rearward-operation restriction portion restricts a rearward movement of the operating member to define the rear position of the operation range.

4. The connector as recited in claim 1, wherein:

the primary member comprises a forward-movement restriction portion; and the forward-movement restriction portion restricts a forward movement of the movable member to define the front position of the movement range.

5. The connector as recited in claim 1, wherein:

the operating member is movable relative to the movable member by the predetermined distance; and a movement distance between the front position and the rear position of the operation range of the operating member is more than another movement distance between the front position and the rear position of the movement range of the movable member by the predetermined distance.

6. The connector as recited in claim 1, wherein the lock portion is a lock claw which extends in a direction intersecting with the front-rear direction.

7. The connector as recited in claim 1, wherein:

the support portion of the movable member is provided with an operated portion;

the operating member is provided with an operating projection;

the operating projection projects outward in a lateral direction perpendicular to the front-rear direction; and when the operating member is positioned rearward of the front position of the operation range by the predetermined distance and when the movable member is positioned at the front position of the movement range, the operated portion is positioned outward of the operating projection in the lateral direction, and the lock portion is moved outward of the mating lock portion in the lateral direction to unlock the mated state.

8. The connector as recited in claim 7, wherein:

the movable member comprises a lock member;

the lock member is a single plate formed with bends;

each of the support portion and the lock portion is a part of the lock member; and the operated portion is a curved portion of the lock member.

9. The connector as recited in claim 7, wherein:

the primary member is provided with a maintenance portion; and when the operating member is positioned rearward of the front position of the operation range by a distance, which is more than the predetermined distance by a predetermined additional distance, and when the movable member is positioned rearward of the front position of the movement range by the predetermined additional distance, the operated portion is positioned outward of the maintenance portion in the lateral direction, and the lock portion is kept under a state where the lock portion is moved outward in the lateral direction.

10. The connector as recited in claim 9, wherein:

the maintenance portion is provided with a temporarily holding portion;

the temporarily holding portion is positioned outward beyond the operating projection of the operating member in the lateral direction; and when the operating member is positioned at the rear position of the operation range, the operated portion is positioned outward of the temporarily holding portion in the lateral direction.

11. The connector as recited in claim 9, wherein:

the maintenance portion is provided with a temporarily holding portion;

the temporarily holding portion projects outward in the lateral direction beyond the operating projection of the operating member; and when the operating member is positioned at the rear position of the operation range, the temporarily holding portion partially covers the operated portion from front.

12. The connector as recited in claim 9, wherein the maintenance portion, except a front end portion thereof, is positioned outward in the lateral direction beyond the operating projection of the operating member.

13. The connector as recited in claim 7, wherein:

the movable member comprises two of the lock portions; and the fit portion of the connector body is positioned between the two lock portions in the lateral direction.

14. The connector as recited in claim 1, wherein:

the movable member comprises a cover; and when the mated state is unlocked, the lock portion is received in the cover.

15. The connector as recited in claim 1, wherein:

the movable member comprises a forward-force receiving portion and a rearward-force receiving portion;

the operating member comprises a forward-force applying portion and a rearward-force applying portion;

a position of the forward-force applying portion in a perpendicular plane perpendicular to the front-rear direction is equal to or overlaps with another position of the forward-force receiving portion in the perpendicular plane;

when the operating member is positioned at the rear position of the operation range and when the movable member is positioned at the rear position of the movement range, the forward-force applying portion is positioned rearward of and apart from the forward-force receiving portion and faces the forward-force receiving portion in the front-rear direction;

when the operating member is moved forward from the rear position of the operation range, the forward-force applying portion applies a forward force to the forward-force receiving portion;

a position of the rearward-force applying portion in the perpendicular plane is equal to or overlaps with another position of the rearward-force receiving portion in the perpendicular plane;

when the operating member is positioned at the front position of the operation range and when the movable member is positioned at the front position of the movement range, the rearward-force applying portion is positioned forward of and apart from the rearward-force receiving portion and faces the rearward-force receiving portion in the front-rear direction; and when the operating member is moved rearward from the front position of the operation range, the rearward-force applying portion applies a rearward force to the rearward-force receiving portion.

16. The connector as recited in claim 1, wherein the operating member is, at least in part, accommodated in the primary member.

17. The connector as recited in claim 16, wherein:

the movable member is, at least in part, accommodated in the primary member; and the operating member is, at least in part, accommodated in the movable member.

18. The connector as recited in claim 1, wherein the primary member is, at least in part, accommodated in the operating member.

19. The connector as recited in claim 18, wherein:

the movable member is, at least in part, accommodated in the operating member; and the primary member is, at least in part, accommodated in the movable member.

20. A connector assembly comprising a connector and a mating connector, wherein:

the connector is mateable with the mating connector when moved forward along a front-rear direction;

the mating connector comprises a mating fit portion and a mating lock portion;

the connector comprises a primary member, a movable member and an operating member;

the primary member comprises a connector body;

the connector body comprises a fit portion;

the fit portion is fit to the mating fit portion under a mated state where the connector and the mating connector are mated with each other;

the movable member is movable relative to the primary member between a front position and a rear position of a movement range in the front-rear direction;

the operating member is movable relative to the primary member between a front position and a rear position of an operation range in the front-rear direction and is movable relative to the movable member in the front-rear direction;

the movable member comprises a support portion and a lock portion;

the support portion is resiliently deformable;

the lock portion is supported by the support portion;

the mated state is locked by the lock portion and the mating lock portion when the operating member is positioned at the front position of the operation range and when the movable member is positioned at the front position of the movement range; and the mated state is unlocked when the operating member is positioned rearward of the front position of the operation range by a predetermined distance and when the movable member is positioned at the front position of the movement range.

* * * * *